US006559824B1

(12) United States Patent
Kubota et al.

(10) Patent No.: US 6,559,824 B1
(45) Date of Patent: May 6, 2003

(54) MATRIX TYPE IMAGE DISPLAY DEVICE

(76) Inventors: Yasushi Kubota, 5-1093-267, Asakuradainishi, Sakurai, Nara (JP), 633-0004; Hajime Washio, 2613-1-107, Ichinomoto-cho, Tenri, Nara (JP), 632-0004; Kazuhiro Maeda, 2613-1-754, Ichinomoto-cho, Tenri, Nara (JP), 632-0004; Graham Andrew Cairns, 22 Bourne Close Cutteslowe, Oxford, Oxford (GB), OX2 8NH; Michael James Brownlow, 124 Church Road Sandford on Thames, Oxford, Oxford (GB), OX4 4YB ( * ) Notice: Subject to any disclaimer, the term of this patent is extended or adjusted under 35 U.S.C. 154(b) by 281 days.

(21) Appl. No.: 09/666,376

(22) Filed: Sep. 20, 2000

(30) Foreign Application Priority Data

Sep. 20, 1999 (JP) ..... 11-266235
Aug. 1, 2000 (JP) ..... 2000-233549

(51) Int. Cl.[7] ..... G09G 3/36
(52) U.S. Cl. ..... 345/100; 345/98
(58) Field of Search ..... 345/87, 88, 89, 345/98, 99, 100, 95, 94

(56) References Cited

U.S. PATENT DOCUMENTS 5,128,974 A 7/1992 Maekawa
5,381,063 A 1/1995 Erhart et al.
5,717,351 A 2/1998 Katsutani
5,754,155 A 5/1998 Kubota
5,828,368 A * 10/1998 Jung ..... 345/99
5,990,857 A * 11/1999 Kubota et al. ..... 345/98

FOREIGN PATENT DOCUMENTS

| | | |
|---|---|---|
| EP | 0 903 722 A2 | 3/1999 |
| JP | 3-147598 | 6/1991 |
| JP | 04-204993 | 7/1992 |
| JP | 6-202588 | 7/1994 |
| JP | 8-201766 | 8/1996 |

OTHER PUBLICATIONS

L1.1: Late–News Paper: *Low Voltage Interface Technology for CGS TFT–LCD With Low Power Consumption*: Y. Kubota, et al., 1116–1119 SID 99 Digest.

* cited by examiner

*Primary Examiner*—Xiao Wu

(57) ABSTRACT

A matrix type image display device has a structure in which the internal states of all of shift registers (the outputs of flip-flops included in the shift registers) in a scanning signal line drive circuit and data signal line drive circuit are made inactive by the use of an initializing signal generated by a NAND gate based on a combination of signals, which do not affect a displayed image, from a control circuit. With this structure, since the shift registers are initialized when power is supplied, it is possible to prevent an indefinite state when power is supplied. Therefore, by selectively inputting signals (such as clock signals) for controlling the shift registers, it is possible to prevent an excessive increase in the signal line load. Consequently, the operation of the image display device can be stabilized. Moreover, it is not necessary to improve the drive ability of an external IC incorporating the control circuit and the supply ability of a power supply circuit, thereby achieving a reduction in the cost and power consumption of the external IC.

44 Claims, 49 Drawing Sheets

MATRIX TYPE IMAGE DISPLAY DEVICE

FIELD OF THE INVENTION

The present invention relates to a matrix type image display device having a structure for stabilizing the operation of a shift register that transfers a digital signal in synchronism with a clock signal, more particularly a structure for preventing an operational error due to indefiniteness of an internal state when power is supplied.

BACKGROUND OF THE INVENTION

The present invention is directed to various image display devices. Here, the present invention is explained by particularly illustrating an active matrix type liquid crystal display device as an example. However, the present invention is not necessarily limited to this example, and is applicable to devices and systems in other fields for the same purposes.

A known conventional image display device is an active matrix drive-type liquid crystal display device. As shown in FIG. 43, this liquid crystal display device includes a pixel array 101, a scanning signal line drive circuit 102, a data signal line drive circuit 103, a pre-charge circuit 104, and a control circuit 105.

The pixel array 101 includes a number of scanning signal lines GL ($GL_j$, $GL_{j+1}$, . . . ) and data signal lines SL ($SL_j$, $SL_{j+1}$, . . . ) that cross each other, and pixels 101*a* (shown as PIX in FIG. 43) arranged in a matrix form. As shown in FIG. 5, the pixel 101*a* is composed of a pixel transistor SW as a switching element and a pixel capacitor $C_P$ including a liquid crystal capacitor $C_L$ (and a storage capacitor $C_S$, if necessary).

The data signal line drive circuit 103 samples an input image signal DAT (data) in synchronism with a control signal such as a clock signal SCK, amplifies it, if necessary, and outputs the resultant signal to each data signal line SL. The scanning signal line drive circuit 102 sequentially selects scanning signal lines GL in synchronism with a control signal such as a clock signal GCK and controls the opening and closing of the pixel transistor SW in the pixel 101*a* so as to write and hold in each pixel 101*a* the image signal DAT output to each data signal line SL. The pre-charge circuit 104 is a circuit provided, if necessary, to support the output of the image signal to the data signal lines SL, and preliminarily charges the data signal lines SL before outputting the image signal DAT from the data signal line drive circuit 103 to the data signal lines SL.

By the way, in the conventional active matrix type liquid crystal display device as described above, an amorphous silicon thin film formed on a transparent substrate such as a glass substrate is used as a material of the pixel transistor SW. Besides, the scanning signal line drive circuit 102 and data signal line drive circuit 103 are formed by external integrated circuits (IC) respectively.

On the other hand, in recent years, in order to meet demands for an improvement of the driving force of the pixel transistor SW for an increase in the size of the screen, a reduction of the mounting cost of the drive ICs and the mounting reliability, a technique for fabricating the pixel array 101 and drive circuits 102 and 103 in a monolithic form by the use of a polycrystalline silicon thin film was developed and reported. Moreover, in order to further increase the size of the screen and reduce the cost, attempts to form the pixel array 101 and drive circuits 102 and 103 by a polycrystalline silicon thin film on the glass substrate at a process temperature of not higher than a distortion point (about 600° C.) of glass have been made.

For example, a liquid crystal display device shown in FIG. 44 employs a structure in which the pixel array 101, scanning signal line drive circuit 102 and data signal line drive circuit 103 are mounted on a glass substrate 107, and the control circuit 105 and power supply circuit 106 are connected to them.

Next, the structure of the data signal line drive circuit 103 will be explained. As the data signal line drive circuit 103, a dot sequential driving-type and line sequential driving-type used according to the type of an input signal have been known. In general, in a polycrystalline silicon TFT panel in which the drive circuits and pixels are formed to be monolithic, a point sequential driving-type drive circuit is often used because of the simpleness of the circuit structure. Therefore, the dot sequential driving-type scanning signal line drive circuit 102 and data signal line drive circuit 103 will be described here.

For example, as shown in FIG. 45, the dot sequential driving-type data signal line drive circuit 103 includes a shift register 111 for sequentially transferring a start signal SST at the timing of the clock signal SCK and inverted clock signal /SCK (the inverted signal of SCK). In this data signal line drive circuit 103, the result of a logical operation of output pulses of adjacent two flip-flops 111*a* in the shift register 111 is obtained by, for example, a NAND gate 111*c*, and an output pulse of the NAND gate 111*c* that has passed through the buffer circuit 112 is supplied as a control signal for a sampling switch 113. The sampling switch 113 fetches the input image signal DAT and outputs it to the data signal lines $SL_n$ (n=1, 2, 3, 4, . . . ) when it is turned on by the control signal.

However, the logic circuit such as the NAND gate 111*c* is provided, if necessary. In other words, if the logical operation is not necessary, the image signal DAT is sampled according to the output pulse of the flip-flop 111*a*.

As shown in FIG. 46, the scanning signal line drive circuit 102 includes a shift register 111 for sequentially transferring a start signal GST at the timing of the clock signal GCK and inverted clock signal /GCK (the inverted signal of GCK). In this scanning signal line drive circuit 102, the result of a logical operation of output signals of adjacent two flip-flops 111*a* in the shift register 111 is obtained by, for example, a NAND gate 111*c*, and a scanning signal is obtained. More specifically, the result of a logical operation of the output pulse of the NAND gate 111*c* and an inverted signal /GEN of an enable signal GEN supplied from the control circuit 105 is obtained by, for example, a NOR gate 114, and the result is output as a scanning signal via a buffer circuit 115 to the scanning signal lines $GL_n$ (n=1, 2, 3, 4, . . . ).

However, if the logical operation is not necessary, the output of the flip-flop 111*a* is used as a scanning signal.

As described above, in both of the data signal line drive circuit 103 and scanning signal line drive circuit 102, the shift register 111 for sequentially transferring a pulse signal is used. This shift register 111 employs a structure in which a plurality of flip-flops 111*a* are connected in series, and is driven by the clock signal SCK, inverted clock signal /SCK, clock signal GCK and inverted clock signal /GCK as shown, for example, in FIGS. 45 and 46.

The flip-flop shown in FIG. 47 is composed of one inverter 121 and two clocked inverters 122 and 123. The clock signal CK and inverted clock signal /CK input to the two clocked inverters 122 and 123 have opposite phases. In adjacent flip-flops, the input clock signals have opposite phases. In general, this type of flip-flop is referred to as a D-type flip-flop.

For example, as shown in FIG. 48, other data signal line drive circuit 103 is formed by an S-R flip-flop 111*b* which is driven by a set signal for causing the inside to be an active state and a reset signal for causing the inside to be an inactive state.

As shown in FIGS. 48 and 49, in an S-R flip-flop 111*b*, the inverted clock signal /CK (/SCK) input according to the control by an output signal G of the flip-flop 111*b* in the preceding stage is used as the set signal, and the output signal of the flip-flop 111*b* in the succeeding stage is used as the reset signal RES. The clock signals of opposite phases are input to adjacent flip-flops 111*b*, respectively. In this flip-flop 111*b*, the inverted clock signal /SCK is used as the inverted clock signal /CK.

In this flip-flop 111*b*, when the active inverted clock signal /CK is input via an N-channel transistor 131 which was turned on by the output signal G, a P-channel transistor 132 is turned on, while N-channel transistors 133 and 134 are turned off. In this case, therefore, a signal of power supply level is output via inverters 135 and 136. Besides, when the set signal becomes inactive and the reset signal RES becomes active, the N-channel transistors 133 and 137 are turned on, while a P-channel transistor 138 is turned off. Consequently, a signal of ground level is output via the inverters 135 and 136.

By the way, in the shift register 111 for use in the above-mentioned data signal line drive circuit 103 (see FIGS. 45 and 48), since the clock signal SCK and inverted clock signal /SCK are input to all of the flip-flops 111*a* or 111*b*, the load capacity of the clock signal line is extremely large. Therefore, it is necessary to use an IC of a great drive ability as an external IC such as a controller IC including therein a control circuit 105 for driving the clock signal line. For this reason, not only the cost is increased, but also the power consumption is increased.

On the other hand, Japanese laid-open patent publication (Tokukaihei) No. 3-147598 (published date: Jun. 24, 1991) discloses a structure in which, in order to reduce the load capacity of the clock signal line, only when the output of each stage (flip-flop) in the shift register is valid (in an active state), the clock signal is input to the flip-flop. More specifically, in this shift register, whether the clock signal is connected to or disconnected from each flip-flop is controlled by the output signal of each flip-flop or a logical combination signal of the output signals of a plurality of adjacent flip-flops.

However, in such a structure, the initial state (voltage level) of the internal node of the shift register is indefinite and may turn into any condition when the power is supplied. In the worst case, all of the internal nodes of the shift register turn into an active state upon the supply of power. This condition continues until a signal corresponding to the inactive state scans the entire shift register so as to initialize the shift register.

In this condition, since the clock signal is input to all of the flip-flops, the load capacity of the clock signal line is extremely large compared with that in a normal condition (a condition in which one pulse signal is scanned in a shift register in which the number of the flip-flops to which the clock signal is input is limited to one or several flip-flops). Thus, if the external IC does not have a sufficient drive ability optimized for a small load capacity, there is a possibility that the clock signal line can not be driven within a predetermined time and the shift register can not be operated.

As described above, in the structure (see FIG. 44) in which the pixel array and the drive circuits are fabricated in a monolithic form on a single glass substrate, there is a tendency to reduce the input voltage (amplitude) in the drive circuit for the purpose of reducing the power consumption and increasing the operation speed like the recent IC. Moreover, in order to simplify the input interface, it is necessary to reduce the amplitude of the input voltage. However, in the drive circuit, in order to obtain a predetermined drive ability, it is necessary to use a higher voltage than the input voltage. Hence, by including a booster circuit (level shift circuit) in each of the flip-flops constituting the shift register, the input voltage is raised.

Here, when a current-driven type level shift circuit is used to increase the operation margin of the level shift circuit, since the transistor in the input stage is always turned on during the operation, a steady-state current flows. For this reason, when a number of nodes in the shift register become active, not only the consumption current becomes extremely large, but also a voltage drop occurs. Thus, there is a possibility that errors occur in the succeeding operation.

It is thus necessary to reset the internal nodes (the output of each flip-flop) of the shift register when the power is supplied. However, if the reset signal is supplied from an external device, not only the number of terminals for inputting the reset signal to a liquid crystal display element in which the drive circuits are mounted is increased, but also the load of the control circuit (controller) is increased.

SUMMARY OF THE INVENTION

It is an object of the present invention is to provide a matrix type image display device which includes a shift register as a part of a drive circuit, and is capable of resetting the internal nodes of the shift register without inputting a reset signal from an external device and capable of reducing the power consumption and cost.

In order to achieve the above object, a first matrix type image display device of the present invention, which is a matrix type image display device including a plurality of pixels arranged in a matrix form; a plurality of data signal lines for supplying image data to be written in the pixels; a plurality of scanning signal lines for controlling writing of the image data in the pixels; a data signal line drive circuit for driving the data signal lines; a scanning signal line drive circuit for driving the scanning signal lines; reset means for resetting an internal state of at least one of the data signal line drive circuit and the scanning signal line drive circuit; and a shift register as a part of the data signal line drive circuit and the scanning signal line drive circuit, is characterized in that the reset means generates a reset signal for resetting the internal state of the shift register that forms at least one of the data signal line drive circuit and the scanning signal line drive circuit, based on a combination of a plurality of signals which are not used during normal driving.

In this structure, since the reset means generates a reset signal based on a specific combination of signals as mentioned above, the shift register provided in the data signal line drive circuit and the scanning signal line drive circuit is reset (the internal nodes are made inactive) by the use of this reset signal. Hence, it is possible to prevent an indefinite state when power is supplied. Moreover, in order to generate the reset signal, it is possible to use existent signals generated in an external control circuit such as a controller. Therefore, if the reset means is provided in the succeeding stage of an input terminal for inputting these signals, it is not necessary to additionally provide an input terminal for the reset signal. It is thus possible to limit the increase in the scale of the external control circuit and the increase in the number of terminals.

In order to achieve the above object, a second matrix type image display device of the present invention, which is a matrix type image display device including a plurality of pixels arranged in a matrix form; a plurality of data signal lines for supplying image data to be written in the pixels; a plurality of scanning signal lines for controlling writing of the image data in the pixels; a data signal line drive circuit for driving the data signal lines; a scanning signal line drive circuit for driving the scanning signal lines; reset means for resetting an internal state of at least one of the data signal line drive circuit and the scanning signal line drive circuit; and a shift register as a part of the data signal line drive circuit and the scanning signal line drive circuit, is characterized in that the reset means generates a reset signal for resetting the internal state of the shift register that forms at least one of the data signal line drive circuit and the scanning signal line drive circuit, based on a combination of a plurality of signals which do not affect a displayed image.

In this structure, examples of a combination of signals which does not affect the displayed image include a combination of signals generated in a period other than an image display period, such as a flyback period, and a combination of signals related to a circuit which is not used for display even in the display period. With the use of such a combination of signals, it is possible to reset the internal state of the shift register without affecting the image display, thereby avoiding an indefinite state when power is supplied.

In order to achieve the above object, a third matrix type image display device, which is a matrix type image display device including a plurality of pixels formed in a matrix form on a single substrate; a plurality of data signal lines for supplying image data to be written in the pixels; a plurality of scanning signal lines for controlling writing of the image data in the pixels; a data signal line drive circuit for driving the data signal lines according to a signal input from outside of the substrate; a scanning signal line drive circuit for driving the scanning signal lines according to signals input from outside of the substrate; a pre-charge circuit for preliminarily charging the data signal lines before being driven, according to signals input from outside of the substrate; reset means for resetting an internal state of at least one of the data signal line drive circuit and the scanning signal line drive circuit; and a shift register as a part of the data signal line drive circuit and the scanning signal line drive circuit, is characterized in that at least one of the data signal line drive circuit, scanning signal line drive circuit and pre-charge circuit is formed on the substrate on which the pixels are formed, and the reset means generates a reset signal for resetting the internal state of the shift register that forms at least one of the data signal line drive circuit and the scanning signal line drive circuit, based on a combination of a plurality of signals which are input from outside of the substrate to at least one of the data signal line drive circuit, scanning signal line drive circuit and pre-charge circuit formed on the substrate.

According to this structure, a reset signal for resetting the internal state of the shift register that forms at least one of the data signal line drive circuit and the scanning signal line drive circuit is generated based on a combination of a plurality of signals which are input from outside of the substrate to at least one of the data signal line drive circuit, scanning signal line drive circuit and pre-charge circuit formed on the substrate. Therefore, in order to reset the internal state of the shift register, it is not necessary to supply the reset signal from outside of the substrate to the circuits on the substrate independently of a signal input to the circuits (data signal line drive circuit, scanning signal line drive circuit and pre-charge circuit) on the substrate from outside of the substrate. It is thus possible to reduce the number of signals supplied to the circuits on the substrate from outside of the substrate.

As a result, the number of signal lines for supplying signals to the circuits on the substrate from outside of the substrate can be decreased, thereby reducing the cost and size of the device. Moreover, it is not necessary to improve the drive ability of the external IC for supplying signals to the circuits on the substrate from outside of the substrate and the supply ability of a power supply circuit, and consequently the cost and power consumption of the external IC can be reduced.

Furthermore, in the third matrix type image display device, at least one of the data signal line drive circuit, scanning signal line drive circuit and pre-charge circuit is formed on the substrate on which the pixels are formed, and therefore at least one of the data signal line drive circuit, scanning signal line drive circuit and pre-charge circuit can be formed on the substrate on which the pixels are to be formed by a single process.

In order to achieve the above object, a fourth matrix type image display device, which is a matrix type image display device including a plurality of pixels formed in a matrix form on a single substrate; a plurality of data signal lines for supplying image data to be written in the pixels; a plurality of scanning signal lines for controlling writing of the image data in the pixels; a data signal line drive circuit for driving the data signal lines according to a signal input from outside of the substrate; a scanning signal line drive circuit for driving the scanning signal lines according to signals input from outside of the substrate; reset means for resetting an internal state of at least one of the data signal line drive circuit and the scanning signal line drive circuit; and a shift register as a part of the data signal line drive circuit and the scanning signal line drive circuit, is characterized in that at least one of the data signal line drive circuit and scanning signal line drive circuit is formed on the substrate on which the pixels are formed, and the reset means generates a reset signal for resetting the internal state of the shift register that forms at least one of the data signal line drive circuit and the scanning signal line drive circuit, based on a combination of a plurality of signals which are input from outside of the substrate to at least one of the data signal line drive circuit and scanning signal line drive circuit formed on the substrate.

According to this structure, a reset signal for resetting the internal state of the shift register that forms at least one of the data signal line drive circuit and the scanning signal line drive circuit is generated based on a combination of a plurality of signals which are input from outside of the substrate to at least one of the data signal line drive circuit and scanning signal line drive circuit formed on the substrate. Therefore, in order to reset the internal state of the shift register, it is not necessary to supply the reset signal from outside of the substrate to the circuits on the substrate independently of a signal input to the circuits (data signal line drive circuit and scanning signal line drive circuit) on the substrate from outside of the substrate. It is thus possible to reduce the number of signals supplied to the circuits on the substrate from outside of the substrate.

As a result, the number of signal lines for supplying signals to the circuits on the substrate from outside of the substrate can be decreased, thereby reducing the cost and size of the device. Moreover, it is not necessary to improve the drive ability of the external IC for supplying signals to the circuits on the substrate from outside of the substrate and the supply ability of a power supply circuit, and consequently the cost and power consumption of the external IC can be reduced.

Furthermore, in the fourth matrix type image display device, at least one of the data signal line drive circuit and scanning signal line drive circuit is formed on the substrate on which the pixels are formed, and therefore at least one of the data signal line drive circuit and scanning signal line drive circuit can be formed on the substrate on which the pixels are to be formed by a single process.

Incidentally, the reset means in the first to fourth matrix type image display devices can be formed by an arithmetic element for converting the polarities of a plurality of signals so as to match the data signal line drive circuit or scanning signal drive circuit and generating a reset signal based on a plurality of signals and resistors or capacitors for biasing at a fixed level, etc.

In order to achieve the above object, a fifth matrix type image display device of the present invention is characterized in that the reset means is capacitors which are added to internal nodes of the shift register that forms at least one of the data signal line drive circuit and the scanning signal line drive circuit, for resetting the internal nodes.

In this structure, since the shift register is initialized (reset) by using the capacitors when power is supplied, it is not necessary to provide a switch for initialization, thereby achieving a reduction in the circuit scale. Furthermore, it is not necessary to generate a signal for driving the initialization switch, thereby simplifying the circuit structure.

In order to achieve the above object, a sixth matrix type image display device of the present invention is characterized in that the reset means is resistors which are added to internal nodes of the shift register that forms at least one of the data signal line drive circuit and the scanning signal line drive circuit, for resetting the internal nodes.

In this structure, since the shift register is initialized (reset) by using the resistors when power is supplied, it is not necessary to provide a switch for initialization, thereby achieving a reduction in the circuit scale. Furthermore, it is not necessary to generate a signal for driving the initialization switch, thereby simplifying the circuit structure.

For a fuller understanding of the nature and advantages of the invention, reference should be made to the ensuing detailed description taken in conjunction with the accompanying drawings.

DESCRIPTION OF THE PREFERABLE EMBODIMENTS

First Embodiment

The following description will explain the first embodiment of the present invention with reference to FIGS. 1 to 18. In this embodiment, the elements having the same functions as the elements of a conventional image display device are designated as the same numerals.

As shown in FIGS. 1 to 4, an image display device of this embodiment includes a pixel array 1, a scanning signal line drive circuit (hereinafter referred to as a scanning line driver) 2, a data signal line drive circuit (hereinafter referred to as a data line driver) 3, a pre-charge circuit 4, and a control circuit 5.

The pixel array 1 includes a number of scanning signal lines GL ($GL_j$, $GL_{j+1}$, . . . ) and data signal lines SL ($SL_j$, $SL_{j+1}$, . . . ) that cross each other, and pixels 1*a* arranged in a matrix form. The pixel 1*a* is formed in a region enclosed by adjacent two scanning signal lines GL and adjacent two data signal lines SL.

Figure 5:
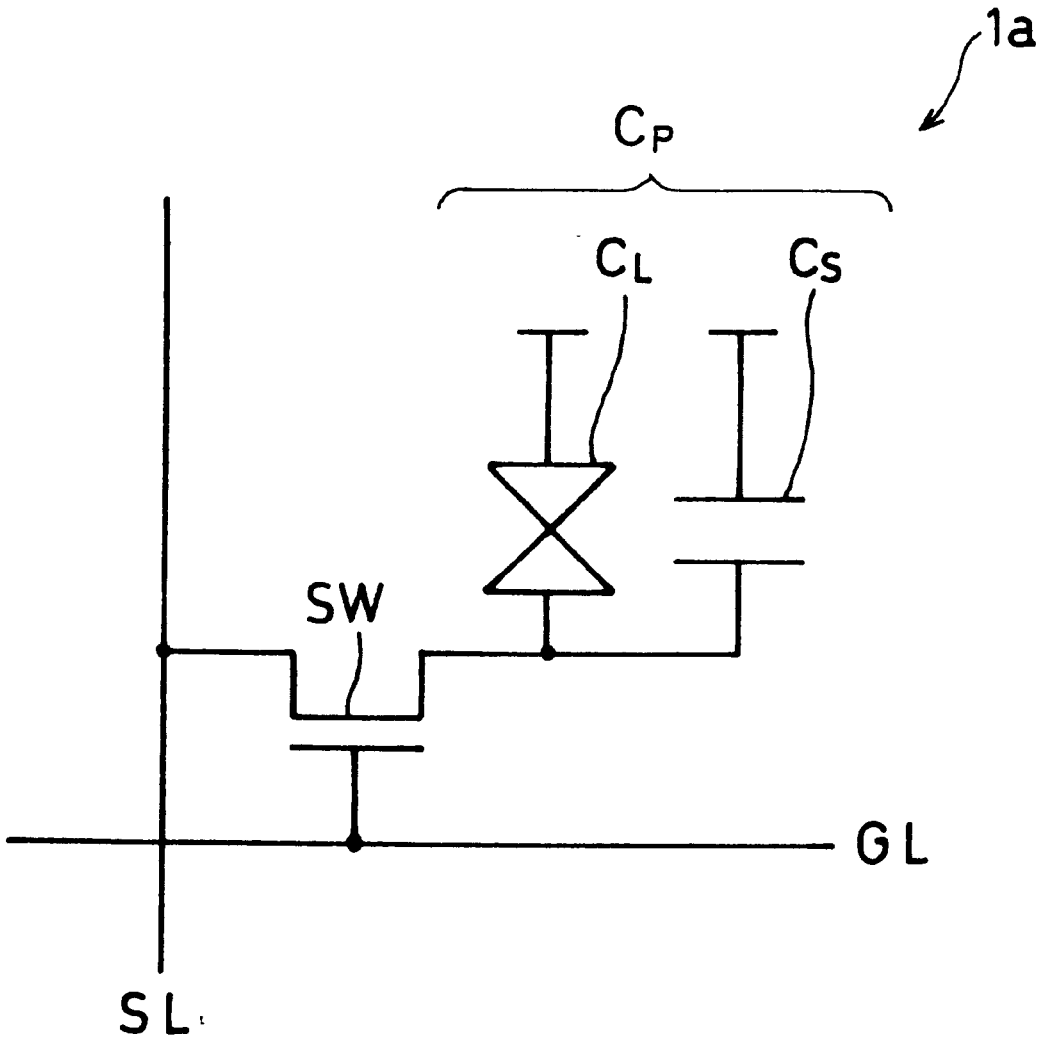
FIG. 5 is a circuit diagram showing the structure of a pixel when the image display devices are active matrix type liquid crystal display devices.

When this image display device is an active matrix type liquid crystal display device, as shown in FIG. 5, the pixel 1*a* is formed by a pixel transistor SW formed of a field-effect transistor as an active switching element for writing in a pixel capacitor $C_P$ (pixel) an image signal DAT (image data) supplied by the data signal lines SL under a control by the scanning signal lines GL, and the pixel capacitor $C_P$ including a liquid crystal capacitor $C_L$ (and a storage capacitor $C_S$, if necessary). In such a pixel 1*a*, the data signal line SL and one of the electrodes of the pixel capacitor $C_P$ are connected to each other through the drain and source of the pixel transistor SW, the gate of the pixel transistor SW is connected to the scanning signal line GL, and the other electrode of the pixel capacitor $C_P$ is connected to a common electrode line (not shown) common to all of the pixels. In this structure, when a voltage is applied to the liquid crystal capacitor $C_L$ in the pixel capacitor $C_P$, the transmittance or reflectance of the liquid crystal is modulated, and an image corresponding to the image signal DAT is displayed on the pixel array 1.

Figure 8:
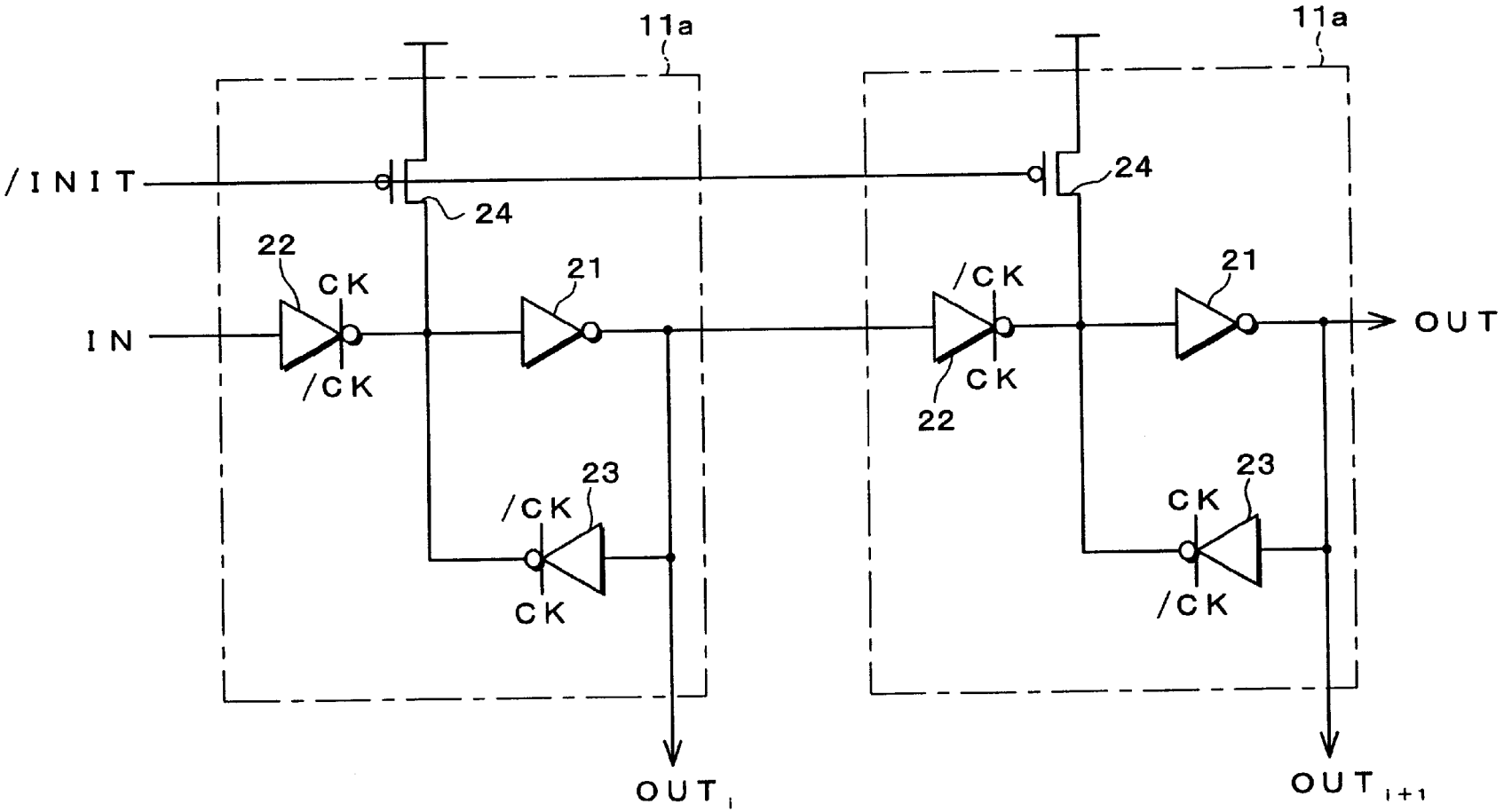
FIG. 8 is a circuit diagram showing the structure of D-type flip-flops constituting a shift register incorporated into the data signal line drive circuit.

The scanning line driver 2 sequentially generates scanning signals supplied to the scanning signal lines $GL_j$, $GL_{j+1}$ . . . connected to the pixels on the respective rows based on a clock signal GCK, enable signal GEN and start signal (start pulse) GST from the control circuit 5. The enable signal GEN is a control signal that enables an operation of the scanning line driver 2. For example, with the inclusion of the shift register 11 as shown in FIG. 8, the scanning line driver 2 shifts the start signal GST (start signal) in synchronism with the clock signal GCK so as to provide a scanning signal. The scanning signal is obtained when the output signal in each stage of the shift register 11 and the enable signal GEN are both active.

Figure 7:
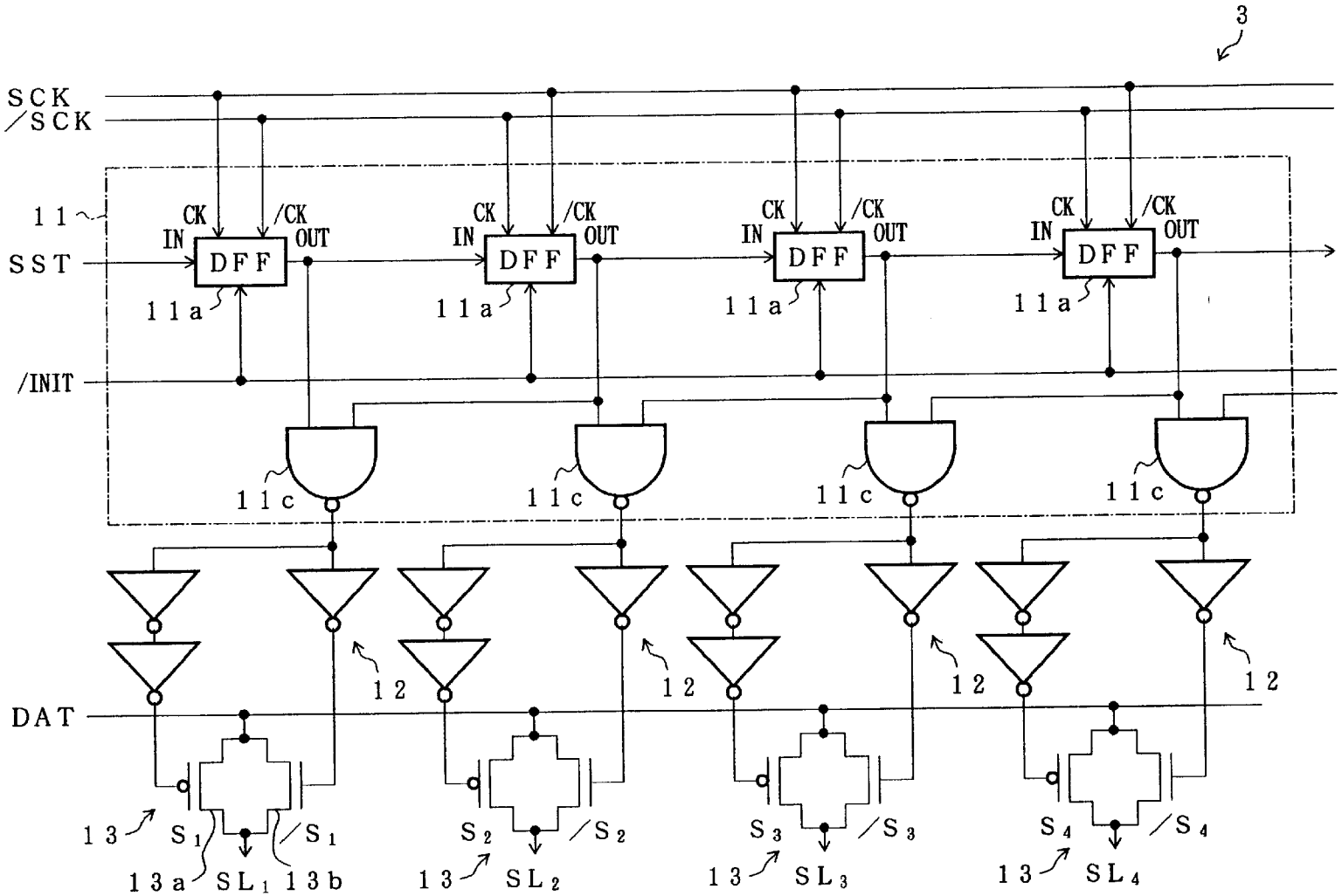
FIG. 7 is a circuit diagram showing a structure of a data signal line drive circuit provided in each of the image display devices.

The data line driver 3 samples the image signal DAT (image data) supplied from the control circuit 5 based on the clock signal SCK and start signal (start pulse) SST from the control circuit 5, and outputs the resultant signal to the data signal lines $SL_i$, $SL_{i+1}$ . . . connected to the pixels on the respective columns. For example, with the inclusion of the shift register 11 as shown in FIG. 7, this data line driver 3 shifts the start signal SST (start signal) in synchronism with the clock signal SCK so as to provide a signal for sampling the image signal DAT.

Figure 6:
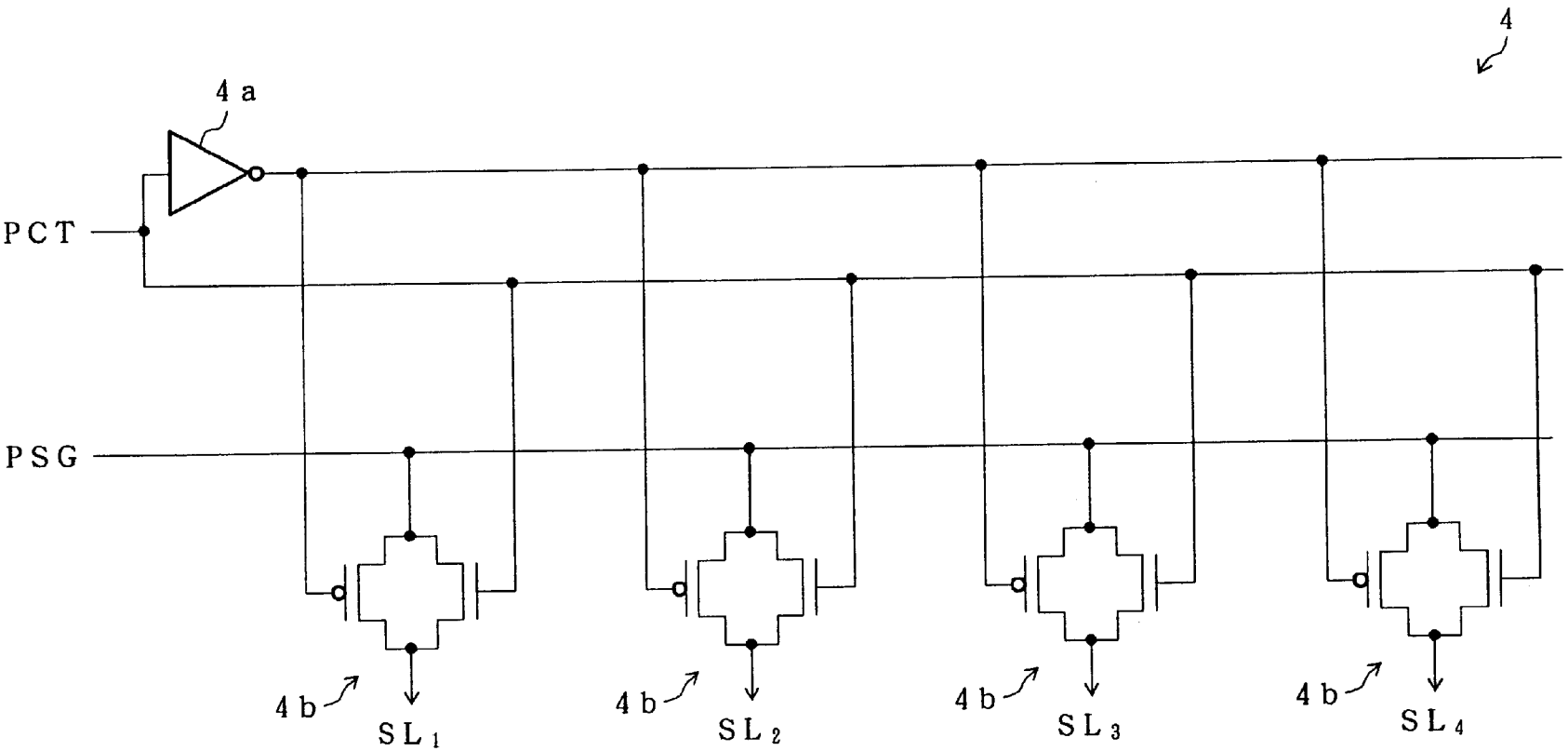
FIG. 6 is a circuit diagram showing the structure of a pre-charge circuit provided in each of the image display devices.

The pre-charge circuit 4 is a circuit for preliminarily charging the data signal lines SL prior to outputting an image signal to assist the output of the image signal to the data signal lines SL. As shown in FIG. 6, the pre-charge circuit 4 includes an inverter 4*a* and a plurality of analog switches 4*b*. The inverter 4*a* inverts a pre-charge control signal PCT supplied from the control circuit 5. The analog switch 4*b* is provided for each data signal line SL, and is opened and closed according to the pre-charge control signal PCT and the inverted signal thereof. In a period when the pre-charge signal PCT is active, a charge level signal PSG is fed to the analog switch 4*b* and output to the data signal lines $SL_n$ (n=1, 2, 3, 4 . . . ). As a result, the data signal lines $SL_n$ are preliminarily charged to an electric potential of the charge level signal PSG.

Incidentally, preliminary charging may not be required according as the specifications (the screen size, the number of pixels, the frequency of an input signal, etc.) of a liquid crystal display device. In such a case, the pre-charge circuit 4 is unnecessary.

The control circuit 5 is a circuit for generating various control signals for controlling the operations of the scanning line driver 2, data line driver 3 and pre-charge circuit 4. As the control signals, the clock signals GCK, SCK, start signals GST, SST, enable signal GEN, image signal DAT, pre-charge control signal PCT and charge level signal PSG are prepared.

Each image display device further includes a NAND gate 8 for generating an initializing signal (reset signal) /INIT for initializing (resetting) a later-described shift register 11 (see FIG. 7) in the data line driver 3. An initializing signal /INIT which is active when it is low level is generated by a combination of different kinds of signals from the control circuit 5. Therefore, the NAND gate 8 is supplied with two different kinds of signals from the control circuit 5, and outputs NAND of the signals as the initializing signal /INIT to the scanning line driver 2 and data line driver 3.

Figure 1:
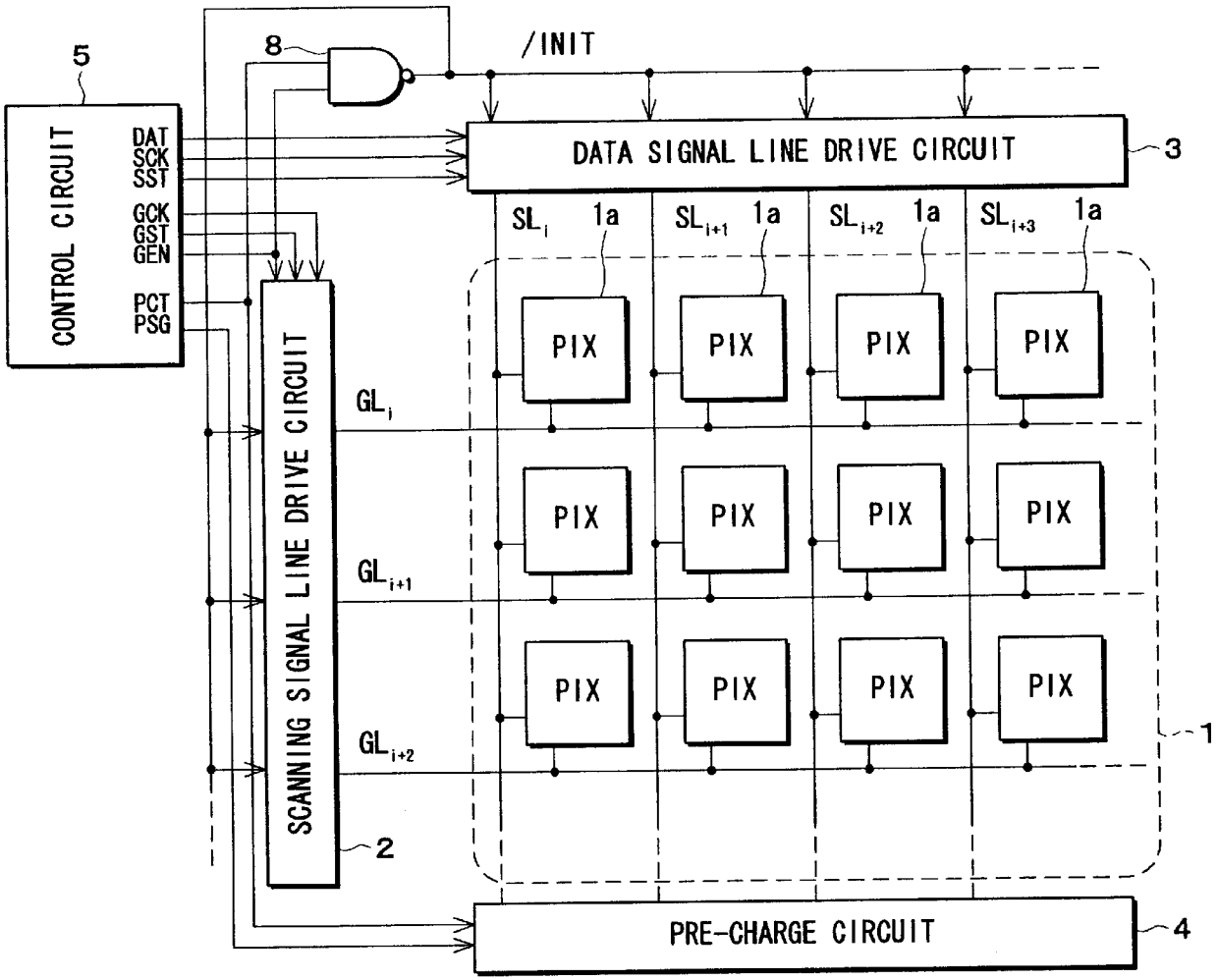
FIG. 1 is a block diagram showing the structure of a first example of an image display device according to the first and fifth embodiments of the present invention.

For instance, in the image display device shown in FIG. 1, the initializing signal /INIT is generated based on the enable signal GEN and pre-charge control signal PCT. In the image display device shown in FIG. 2, the initializing signal /INIT is generated based on the start signal GST and pre-charge control signal PCT. In the image display signal shown in FIG. 3, the initializing signal /INIT is generated based on the start signal SST and pre-charge control signal PCT. In the image display signal shown in FIG. 4, the initializing signal /INIT is generated based on the start signals GST, SST.

A combination of these control signals used as the basis for generating the initializing signal /INIT (reset signal) is a combination which is not used in a normal image display period or arranged not to affect the displayed image. Therefore, it can be used only for the purpose of initializing the shift register 11.

Next, the following description will explain the data line driver 3 and the scanning line driver 2.

FIG. 7 shows the data line driver 3 using dot sequential driving. This data line driver 3 includes a shift register 11, a buffer circuit 12 and a sampling switch 13.

The shift register 11 includes a plurality of D-type flip-flops (shown as DFF in FIG. 7) 11*a* connected in series, and a plurality of NAND gates 11*c*. The flip-flops 11*a* sequentially transfer input signals IN in synchronism with the timing of the clock signal CK (SCK) and the inverted clock signal /CK (/SCK) so as to output them as output signals OUT ($N_1$, $N_2$, $N_3$, $N_4$ . . . ).

More specifically, as shown in FIG. 8, the D-type flip-flop 11*a* is composed of one inverter 21, two clocked inverters 22, 23, and a P-channel transistor 24. The clocked inverter 22 and the inverter 21 are connected in series, while the clocked inverter 23 and the inverter 21 are connected in parallel so that the directions of the input and the output of the inverters 23 and 21 are opposite. The P-channel transistor 24 is connected so that the drain is connected to a power supply line, the source is connected between the output of the clocked inverter 22 and the input of the inverter 21, and the gate is supplied with the initializing signal /INIT. The clocked signals input to the two clocked inverters 22 and 23 are set to have the opposite phases. Moreover, in adjacent flip-flops 11*a*, the clocked signals input to the two clocked inverters 22 and 23 are set to have the opposite phases. In the flip-flop 11*a* configured as described above, since the internal node is initialized to a high electric potential by the initializing signal /INIT at the time the power is supplied, the respective outputs are inactive. Incidentally, the initializing signal /INIT is active when it is in a low level. In other words, when the initializing signal /INIT is in a low level, the internal node of the flip-flop 11*a* is initialized.

Both of the input signal IN and output signal OUT of one flip-flop 11*a* are supplied to one of the inputs of the NAND gate 11*c*, and the output signal OUT of the flip-flop 11*a* in the next stage is supplied to the other input. The NAND gate 11*c* may not be required according as the design specifications of the clock signal SCK, inverted clock signal /SCK and start signal SST, the structure of the shift register 11, etc. In this case, the output signal OUT of each of the flip-flops 11*a* is directly supplied to the buffer circuit 12.

The buffer circuit 12 includes two branching signal paths, an even-number of inverters arranged on one of the signal paths and an odd-number of inverters arranged on the other signal path. The buffer circuit 12 thus configured holds and amplifies the output signal OUT output from each output stage of the shift register 11, and inverts the output signal OUT on the signal path on which an odd-number of the inverters are arranged. The number of inverters on each of the signal paths is not limited to that shown in the drawing.

The sampling switch 13 has a structure in which the P-channel transistor 13*a* and the N-channel transistor 13*b* are connected complementarily in parallel. In such a sampling switch 13, the P-channel transistor 13*a* and N-channel transistor 13*b* are opened and closed according to two signals $S_n$, $/S_n$ (n=1, 2, 3, 4, . . . ) of opposite phases output from the buffer circuit 12. The image signal DAT fetched by a timing of turning on the sampling switch 13 is output to the data signal lines $SL_n$ (n=1, 2, 3, 4, . . . ).

Figure 9:
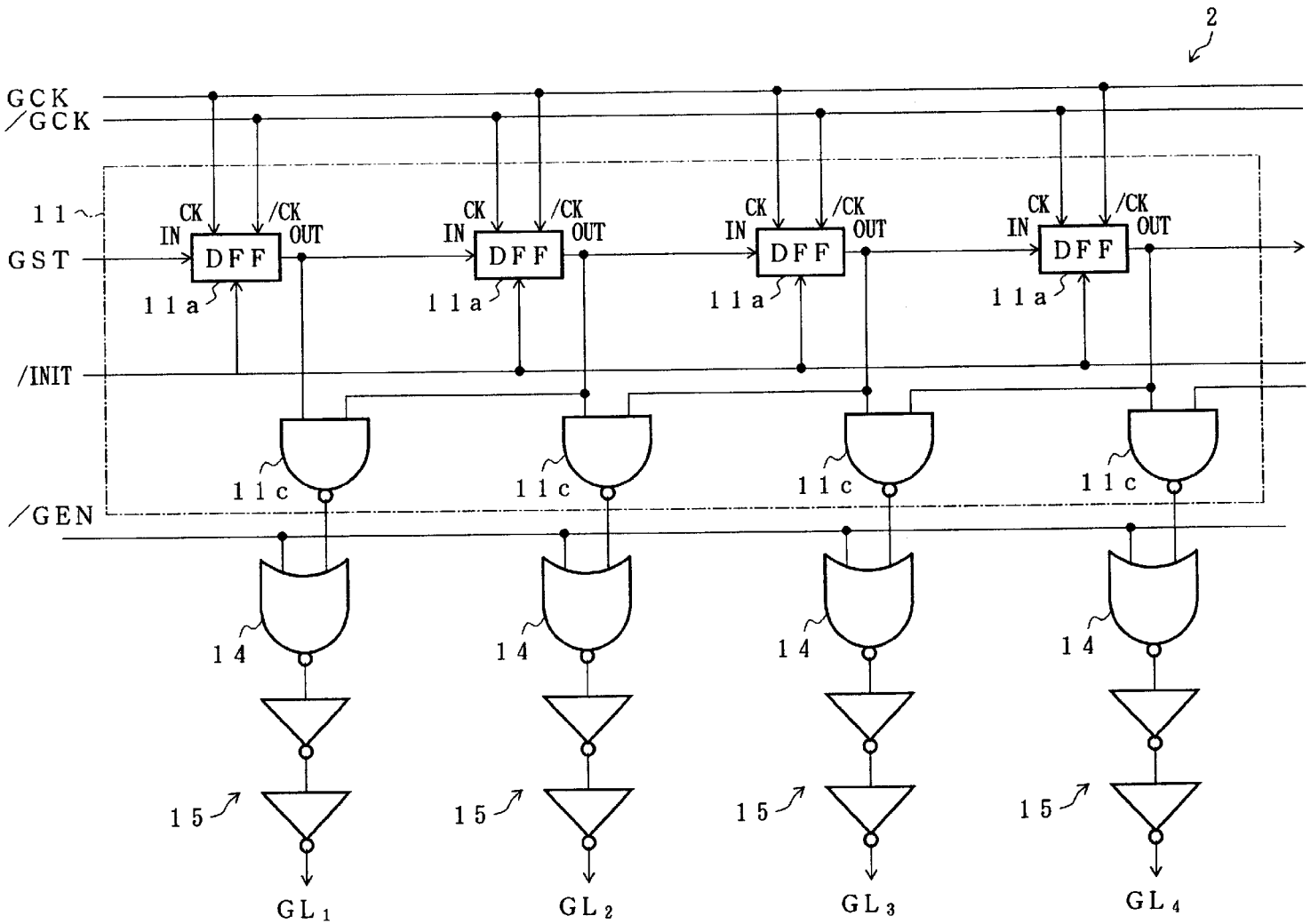
FIG. 9 is a circuit diagram showing the structure of a scanning signal line drive circuit provided in each of the image display devices.

FIG. 9 shows the scanning line driver 2. This scanning line driver 2 includes a shift register 11, a NOR gate 14 and a buffer circuit 15.

The NOR gate 14 outputs NOR of the signal output from each output stage of the shift register 11 and the inverted enable signal /GEN which is an inverted signal of the enable signal GEN. Accordingly, the scanning line driver 2 outputs a scanning signal with a constant pulse width regulated by the pulse width of the inverted enable signal /GEN. The buffer circuit 15 includes at least one inverter, holds and amplifies the output signal of the NOR gate 14.

Figure 10:
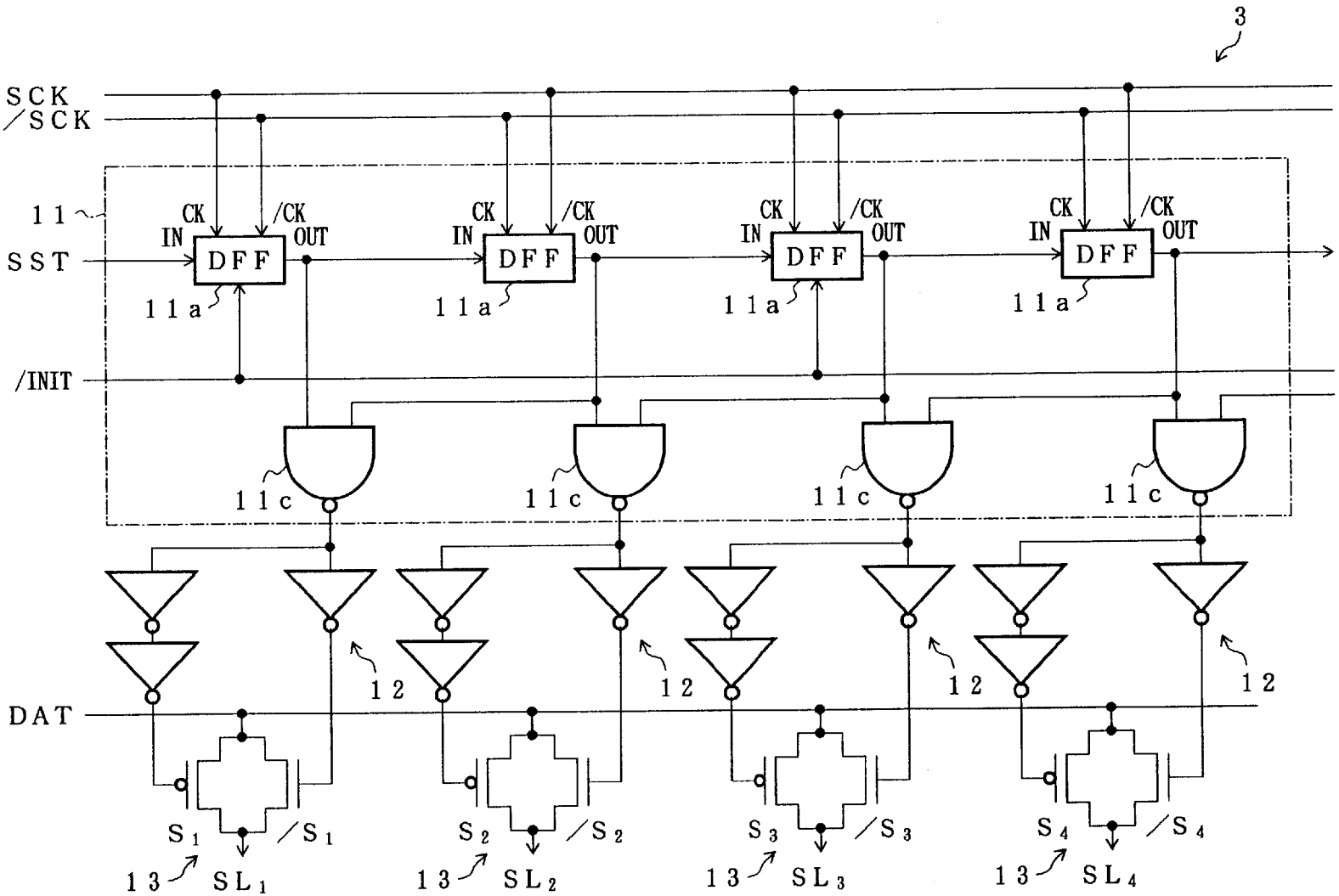
FIG. 10 is a circuit diagram showing another structure of the data signal line drive circuit provided in each of the image display devices.

FIG. 10 shows another structural example of the shift register 11 of the present invention. Like the shift register 11 shown in FIG. 9, this shift register 11 includes flip-flops 11*a*, but the initializing signal /INIT is input to the flip-flops 11*a* of every other stage. Even when the flip-flops 11*a* of every other stages are initialized, no trouble occurs in the operation because the flip-flop 11*a* in the next stage can be initialized by the output of the initialized flip-flop 11*a*, depending on the conditions of the clock signal.

The following description will explain this specific example with reference to the shift register 11 including the D-type flip-flops 11*a*. If the initialization switch, for example, the flip-flop 11*a* including a transistor for initializing an internal node, such as the P-channel transistor 24 shown in FIG. 8, is present only in a stage that is synchronized with the clock signal CK (but not the inverted clock signal /CK), then the output of the initialized flip-flop 11*a* is input to the next stage by making the clock signal CK inactive in the initializing period. Therefore, even when the flip-flop 11*a* having no initialization switch is provided in the next stage, the internal state of the flip-flop 11*a* is initialized.

Thus, by reducing the number of flip-flops 11*a* to be initialized, it is possible to produce merits that the number of switches used for initialization and the load of the initializing signal line are decreased.

Subsequently, the operation of this image display device will be explained.

Figure 11:
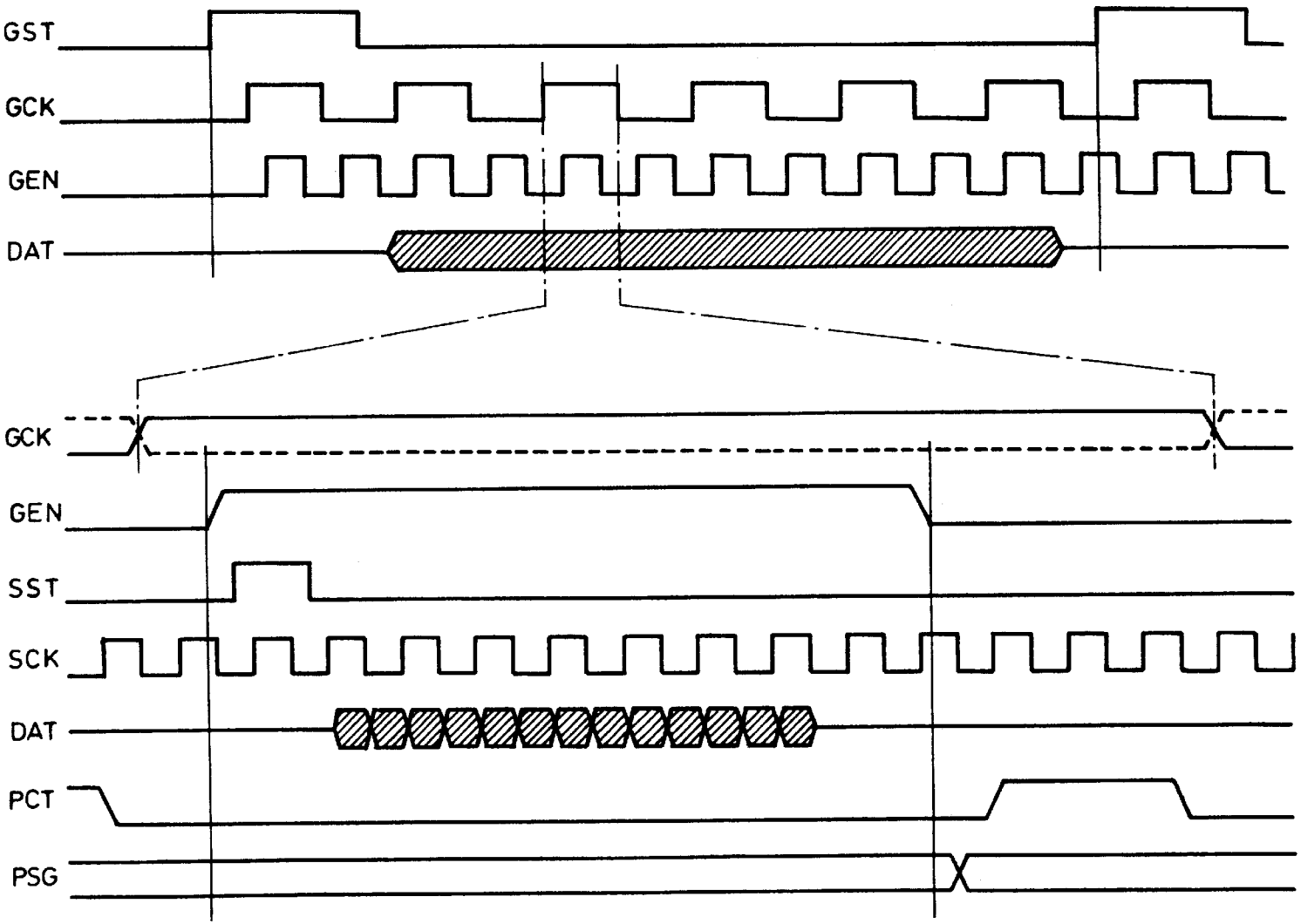
FIG. 11 is a timing chart showing an operation of a drive system including the scanning signal line drive circuit, data signal line drive circuit and pre-charge circuit.

The control signals output from the control circuit 5 are shown in the timing chart of FIG. 11. Here, the hatching portion indicates a period in which the image signal DAT is effective, i.e., a period in which the data used for display is being input, and the other periods are blanking periods (flyback periods). The lower timing chart in FIG. 11 indicates control signals based on the clock signal GCK, which are drawn by extending the time axis.

The data signal line SL is preliminarily charged to the level of the charge level signal PSG when the pre-charge control signal PCT is active. Thereafter, the image signal DAT is written to the data signal line SL. When the enable signal GEN (the inverted enable signal /GEN in the case of the scanning driver 2 shown in FIG. 9) is active, the image signal DAT is written from the data signal line SL to the pixel 1*a*. Thus, during normal driving, i.e., when the image display device is being operated normally, it is evident from this timing chart that the enable signal GEN and pre-charge control signal PCT are not made active simultaneously. Therefore, as shown in FIG. 1, the NAND signal (the initializing signal /INIT) of the enable signal GEN and pre-charge control signal PCT can be used as a reset signal for the shift registers 11 constituting the scanning line driver 2 and the data line driver 3.

Figure 12:
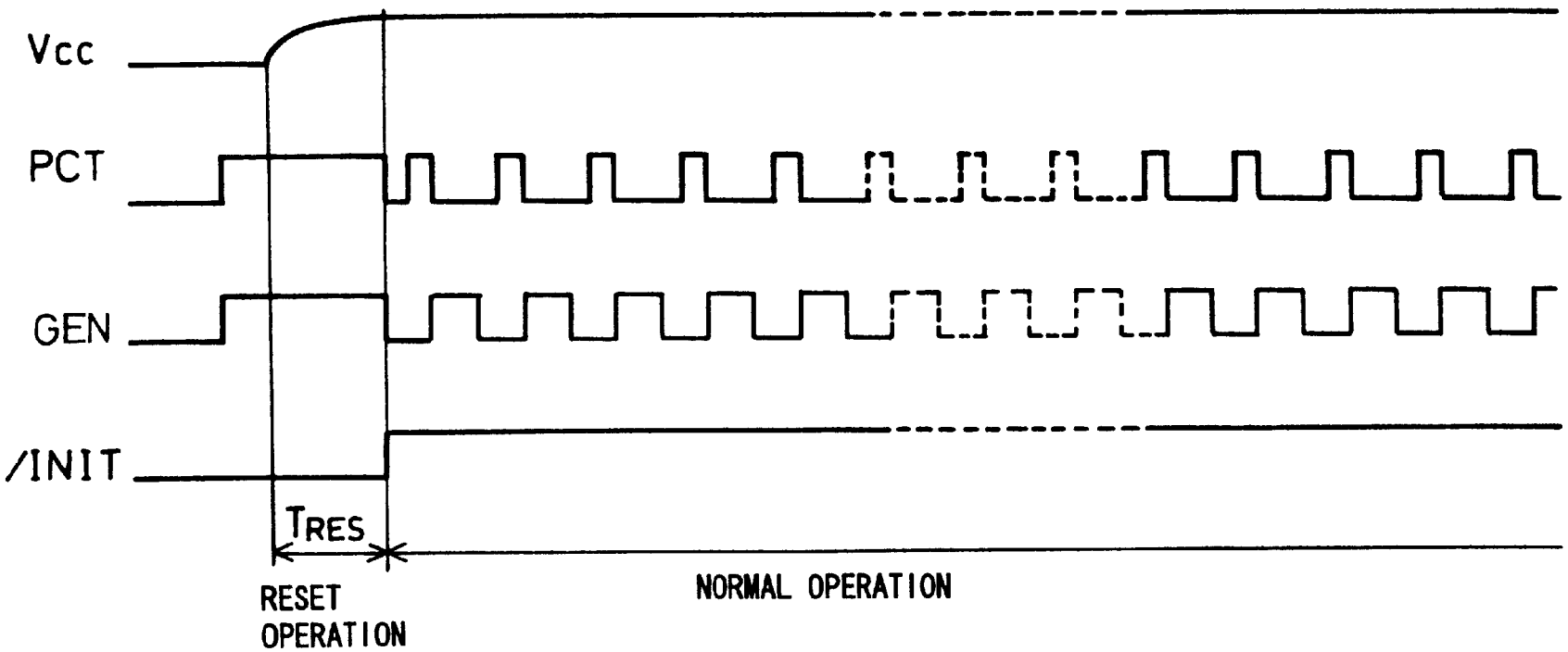
FIG. 12 is a timing chart showing an operation of the drive system when a reset signal is generated based on an enable signal supplied to the scanning signal line drive circuit and a pre-charge control signal supplied to the pre-charge circuit.
Figure 13:
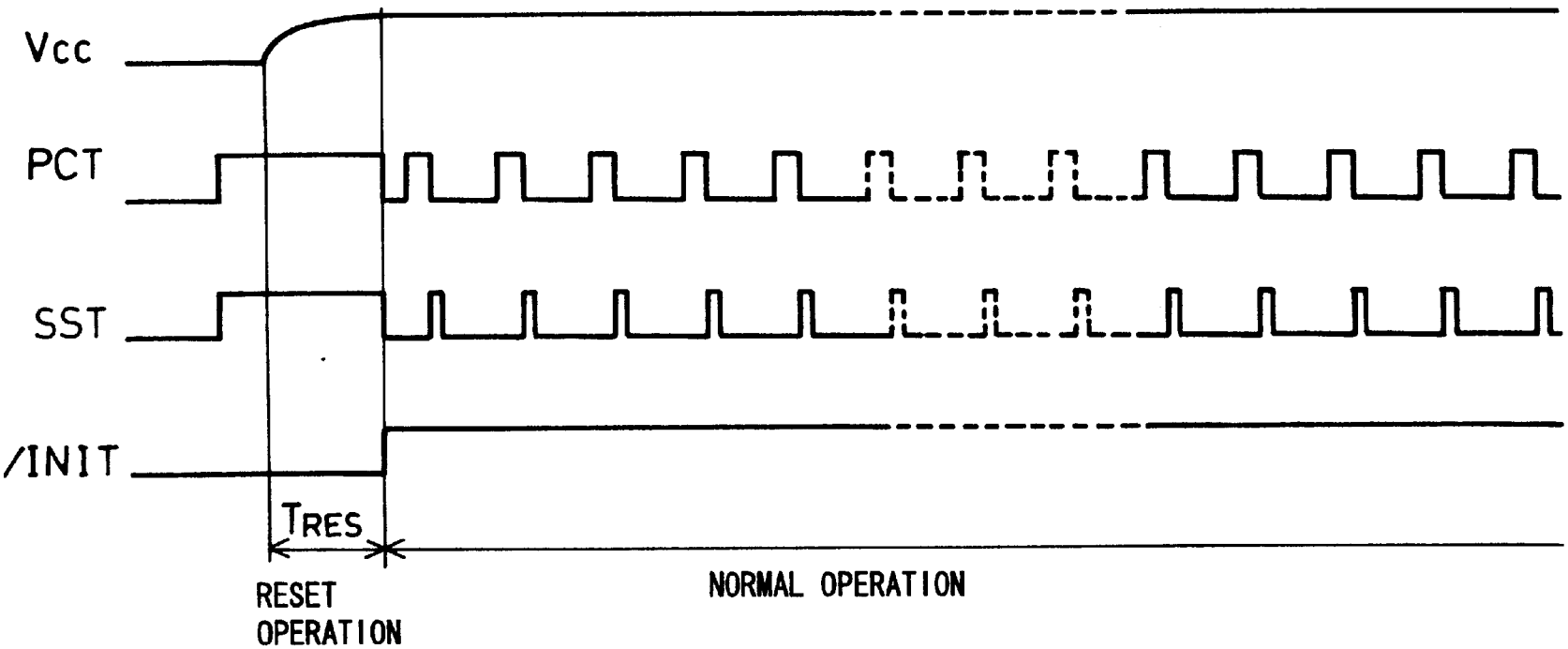
FIG. 13 is a timing chart showing an operation of the drive system when a reset signal is generated based on a start signal supplied to the data signal line drive circuit and the pre-charge control signal.
Figure 14:
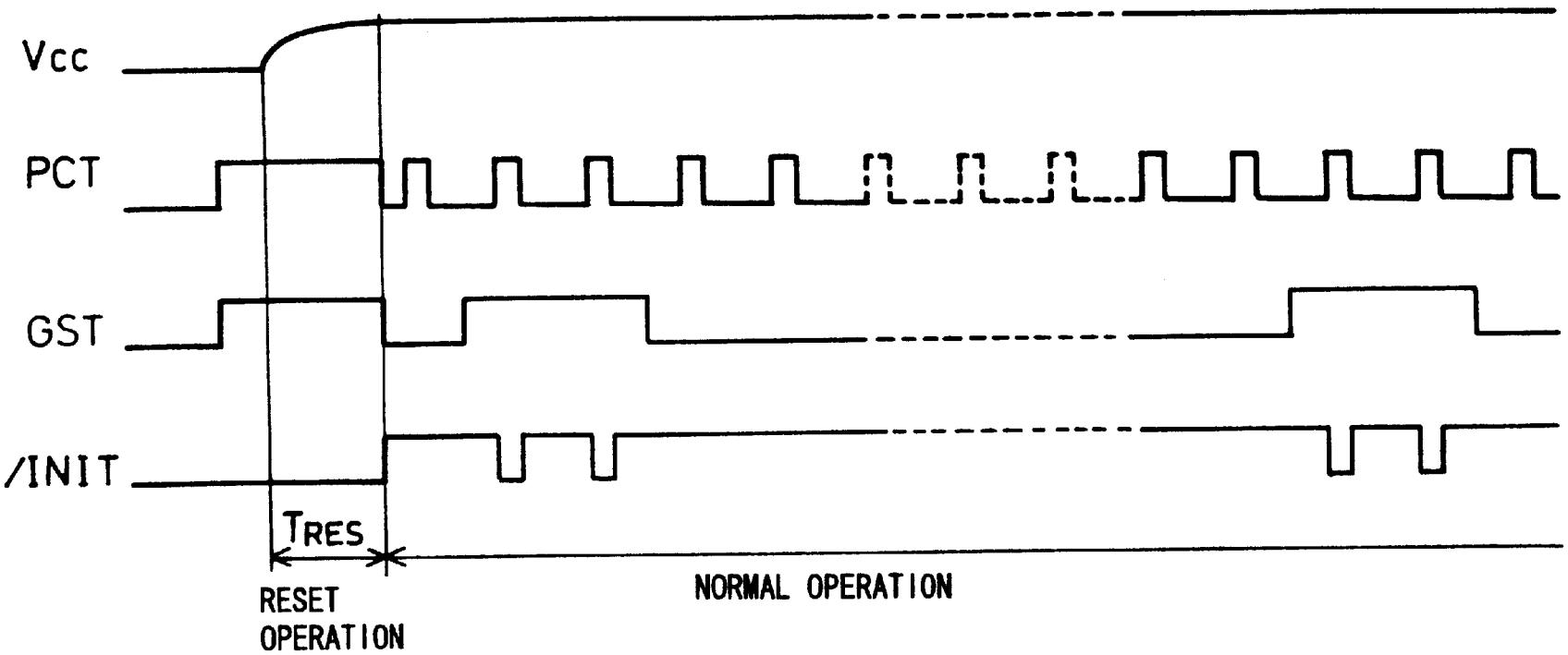
FIG. 14 is a timing chart showing an operation of the drive system when a reset signal is generated based on a start signal supplied to the scanning signal line drive circuit and the pre-charge control signal.
Figure 15:
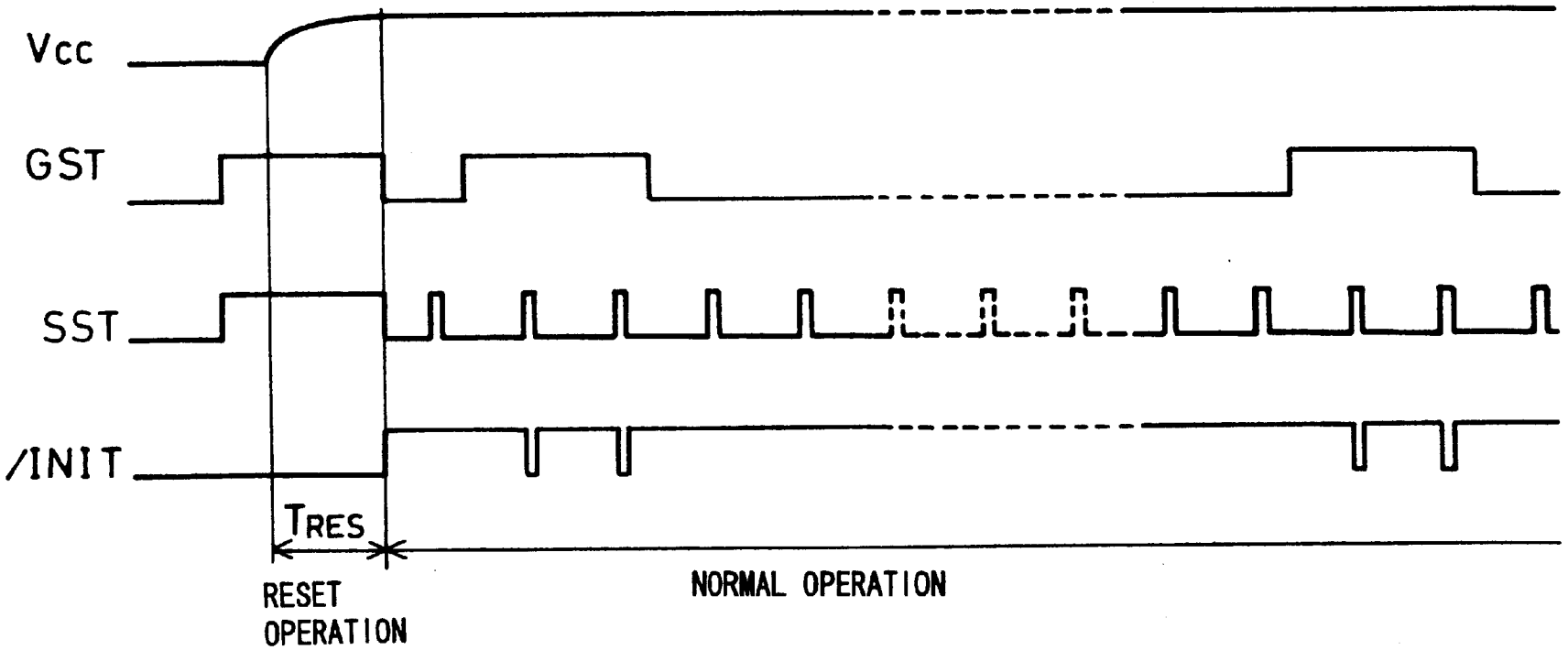
FIG. 15 is a timing chart showing an operation of the drive system when a reset signal is generated based on two start signals supplied to both of the drive circuits, respectively.
Figure 16:
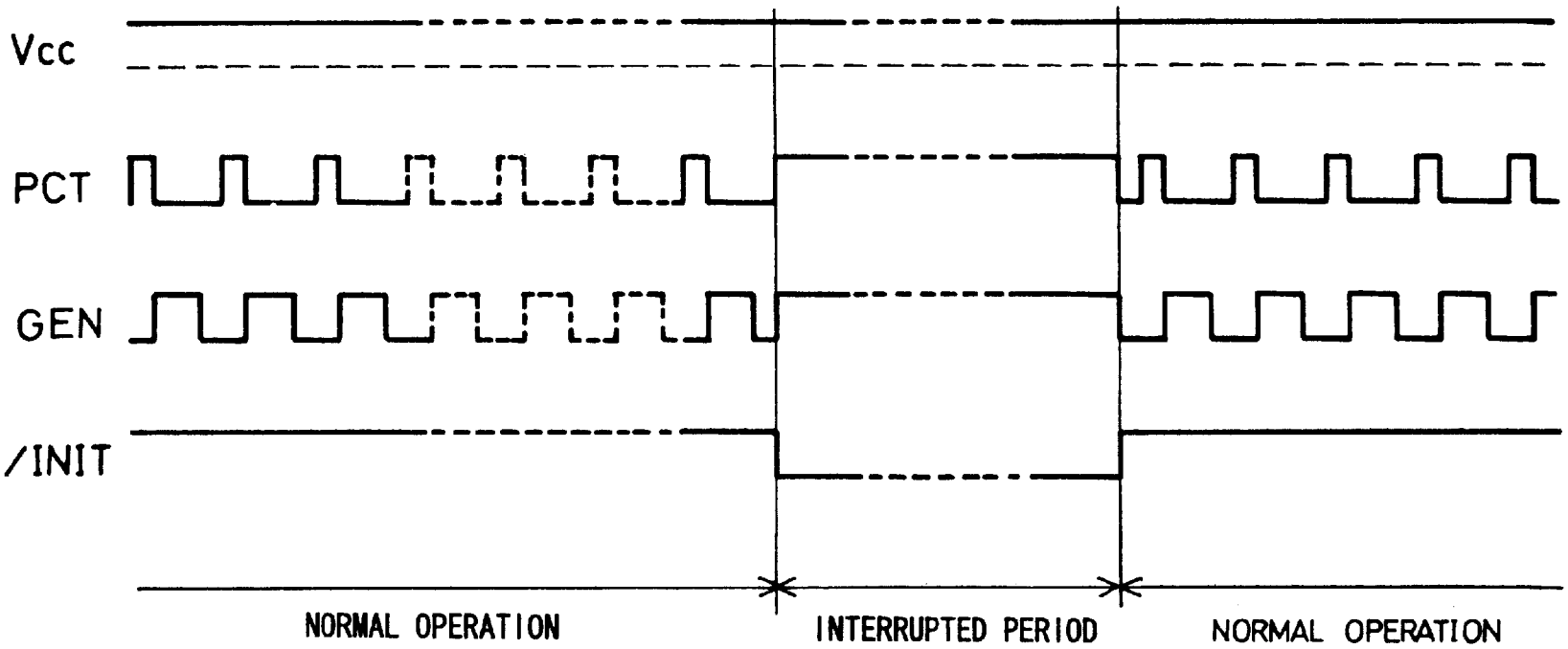
FIG. 16 is a timing chart showing an operation of the drive system for performing resetting while interrupting a normal display operation when a reset signal is generated based on the enable signal and the pre-charge control signal.

In this case, when the power is supplied to the image display device, a reset operation is performed as shown in the timing chart of FIG. 12. More specifically, in a predetermined period (reset period $T_{RES}$) after the supply of power, since both of the enable signal GEN and pre-charge control signal PCT are active (high level), the initializing signal /INIT of low level is output from the NAND gate 8 and the reset operation is performed. After the reset period, at least one of the enable signal GEN and pre-charge control signal PCT becomes inactive (low level), and then the initializing signal /INIT also becomes inactive. Consequently, the process proceeds to the normal operation.

Figure 3:
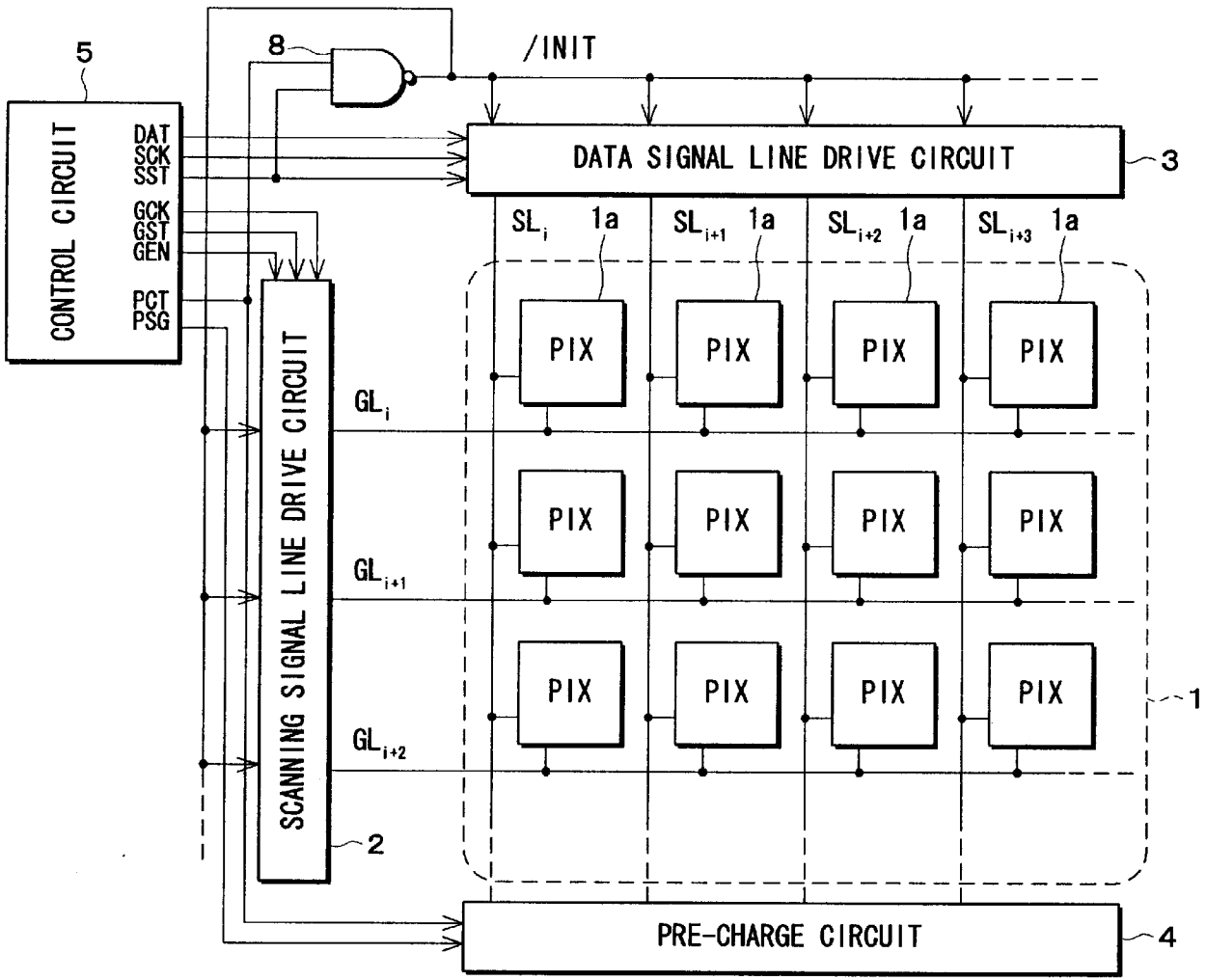
FIG. 3 is a block diagram showing the structure of a third example of an image display device according to the first and fifth embodiments of the present invention.

Moreover, as shown in FIG. 11, the start signal SST and pre-charge control signal PCT are not made active at the same time. Therefore, as shown in FIG. 3, the product signal (initializing signal /INIT) of the start signal SST and pre-charge control signal PCT can be used as a reset signal for the shift register 11. In this case, in the predetermined period (reset period $T_{RES}$) after the supply of power to the image display device, as shown in the timing chart of FIG. 13, both of the start signal SST and pre-charge control signal PCT become active, and the reset operation is performed. Moreover, after the reset period, at least one of the start signal SST and pre-charge control signal PCT becomes inactive, and the process proceeds to the normal operation.

Figure 2:
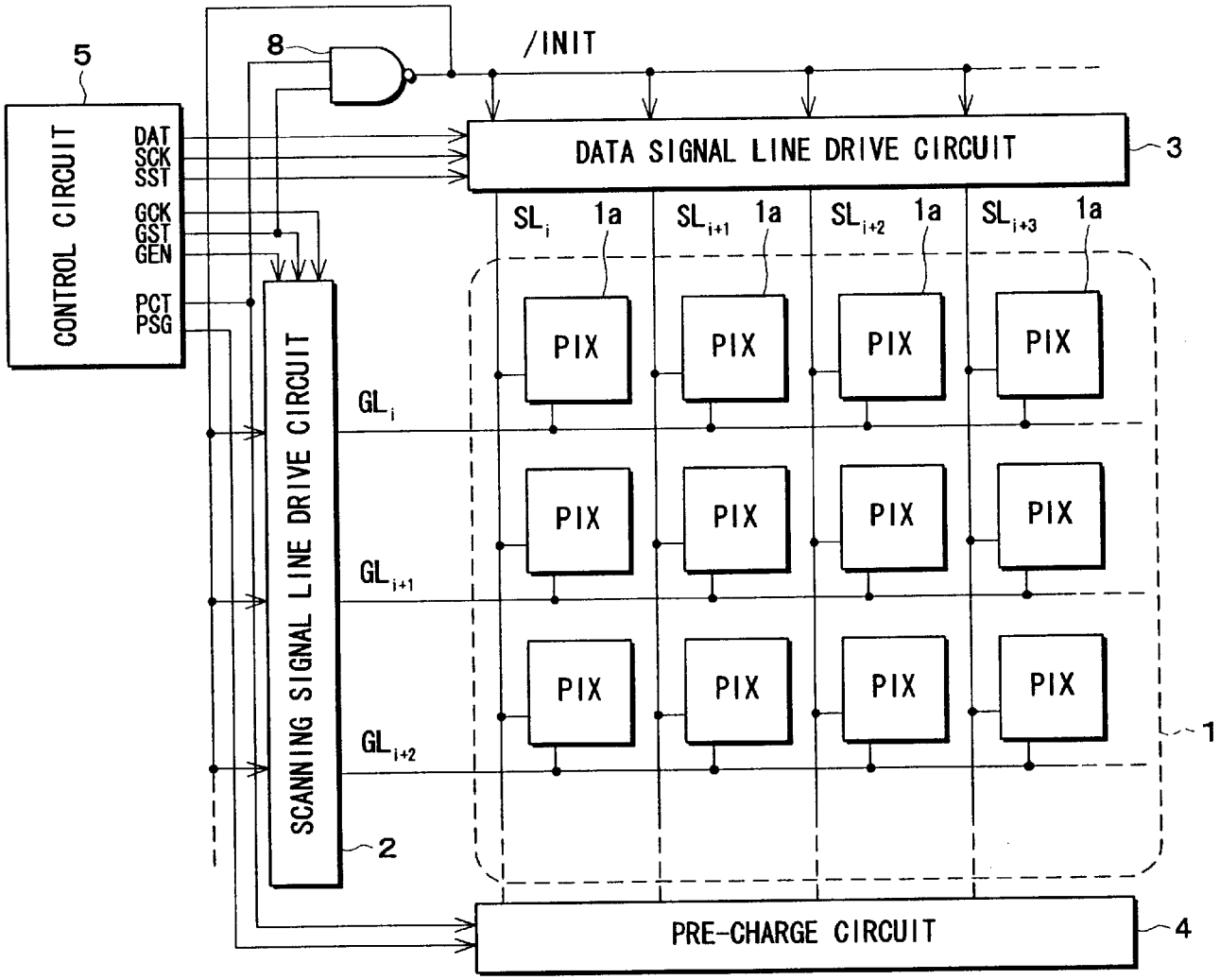
FIG. 2 is a block diagram showing the structure of a second example of an image display device according to the first and fifth embodiments of the present invention.

Furthermore, as shown in FIG. 11, it is possible to make such an arrangement that the start signal GST and pre-charge control signal PCT are not made active at the same time in most of periods during the normal driving. More specifically, in a period in which the start signal GST is active, since the image signal DAT is not valid, it is possible to obtain such a timing that the pre-charge control signal PCT is kept inactive. Thus, as shown in FIG. 2, the NAND signal (initializing signal /INIT) of the start signal GST and pre-charge control signal PCT can be used as a reset signal for the shift register 11. In this case, in the predetermined period (reset period $T_{RES}$) during the supply of power to the image display device, as shown in the timing chart of FIG. 14, both of the start signal GST and pre-charge control signal PCT become active, and the reset operation is performed. Incidentally, during the normal driving, the initializing signal /INIT becomes active temporarily. However, in this period, since the image signal DAT is not valid, this reset operation does not affect the displayed image.

Here, in order to make the image signal DAT invalid in a period in which the start signal GST is active, the start signal GST is shifted in the first-stage flip-flop 11*a* (dummy flip-flop) as shown in FIG. 9 instead of using the start signal GST as it is for the generation of a scanning signal. This is common to the applications in which the start signal GST is combined with other signal (for example, the next example shown in the timing chart of FIG. 15).

Figure 4:
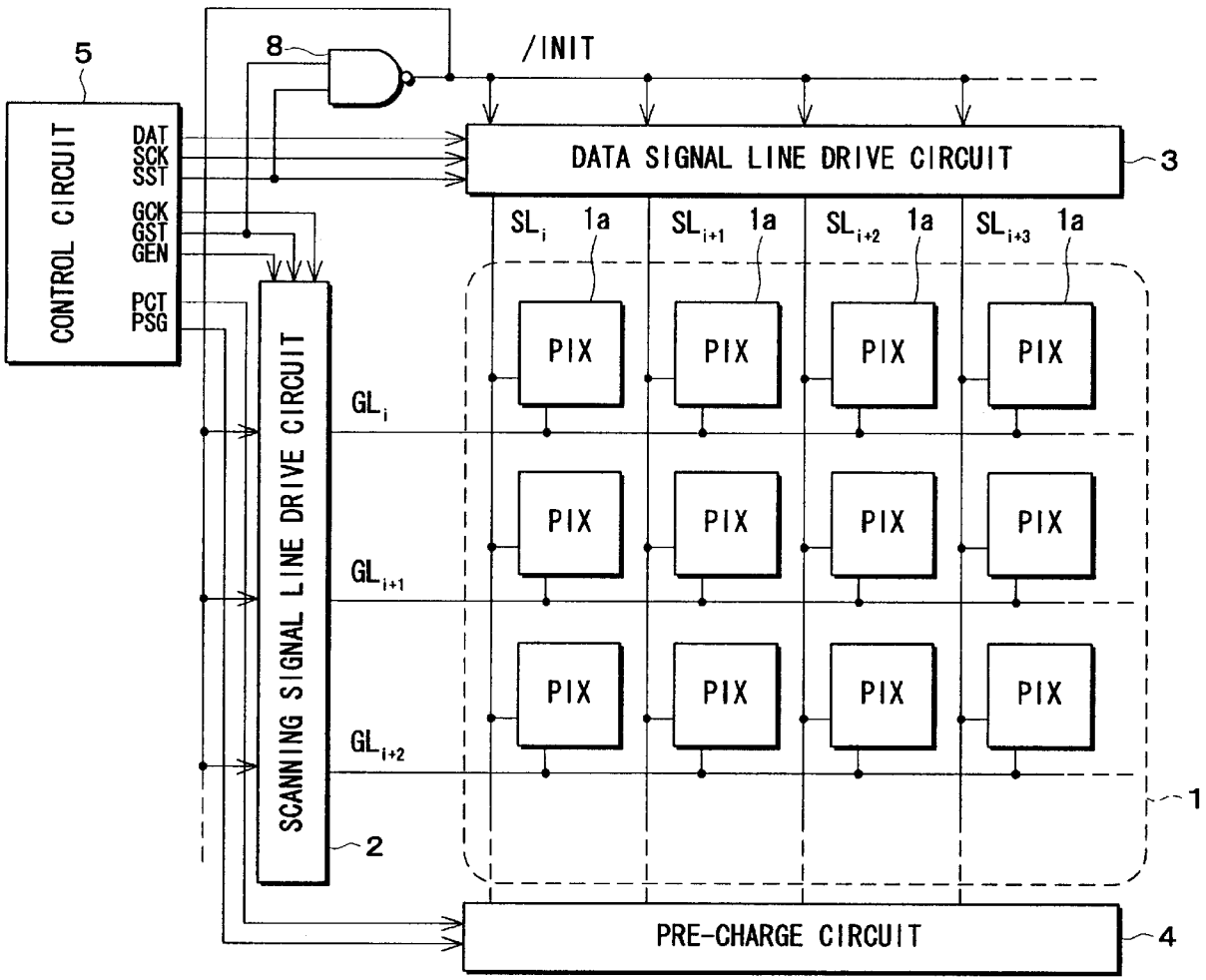
FIG. 4 is a block diagram showing the structure of a fourth example of an image display device according to the first and fifth embodiments of the present invention.

Besides, as shown in FIG. 11, it is possible to make such an arrangement that the start signal GST and start signal SST do not become active at the same time in most of the periods during the normal driving. More specifically, in a period in which the start signal GST is active, since the image signal DAT is not valid, it is possible to obtain such a timing that the start signal SST is kept inactive. Thus, as shown in FIG. 4, the initializing signal /INIT as the NAND signal of the start signal GST and start signal SST can be used as a reset signal for the shift register 11. In this case, in the predetermined period (reset period $T_{RES}$) during the supply of power to the image display device, as shown in the timing chart of FIG. 15, both of the start signal GST and start signal SST become active, and the reset operation is performed. Incidentally, during the normal driving, the initializing signal /INIT becomes active temporarily. However, since the image signal DAT is not valid in this period, this reset operation does not affect the displayed image in this period.

The above examples illustrate the initialization performed when the power is supplied. However, the initialization of the shift register 11 is not necessarily performed when power is supplied, and can be performed in a similar manner when the display operation is interrupted during the normal operation period. In this case, as shown by the timing chart of FIG. 16, for example, in the period that the display operation is interrupted (the image signal DAT is not valid), at an interval of the display period (normal operation), the initializing signal /INIT can be changed to active by forcefully changing the enable signal GEN and pre-charge control signal PCT to active. Thus, the reset operation is performed during the display interrupted period which is not the normal driving period.

Besides, in this case, there is a possibility that either of the flip-flop 11*a* in the shift register 11 remains active. At this time, as described later, if a part of the circuits (for example, a level shift circuit) is operated, it may increase the current consumption or increase the deterioration of only a part of the transistors constituting the drive circuit with time and cause an instable operation. In contrast, by initializing the shift register 11 when the display operation is interrupted, such problems can be avoided.

Regarding the reset period, it needs to be at least a length in which the all stages of the shift register 11 can be certainly initialized, but needs to be limited to such a length as not to affect the image display, for example, a length that does not cause the time from the supply of power to the display of an image to be too long. In this embodiment, in order to certainly initialize all stages of the shift register 11, the reset period $T_{RES}$ shown in FIGS. 12 to 15 needs to be 1 $\mu$sec or more, but is limited to 100 msec or less so as not to viciously affect the image display.

As described above, in this image display device, it is possible to generate the reset signal based on a combination of signals which are not used in the normal display operation. In this case, there is no need to input the reset signal from an external device. It is therefore possible to prevent an unnecessary increase in the load of the signal line for supplying a signal for controlling the shift register 11 from the control circuit 5 to the scanning line driver 2 and data line driver 3. Consequently, the operation of the image display device is stabilized. Moreover, since there is no need to increase the drive ability of the external IC incorporating the control circuit 5 and the supply ability of the power supply circuit, the cost and power consumption of the external IC are reduced.

Figure 17:
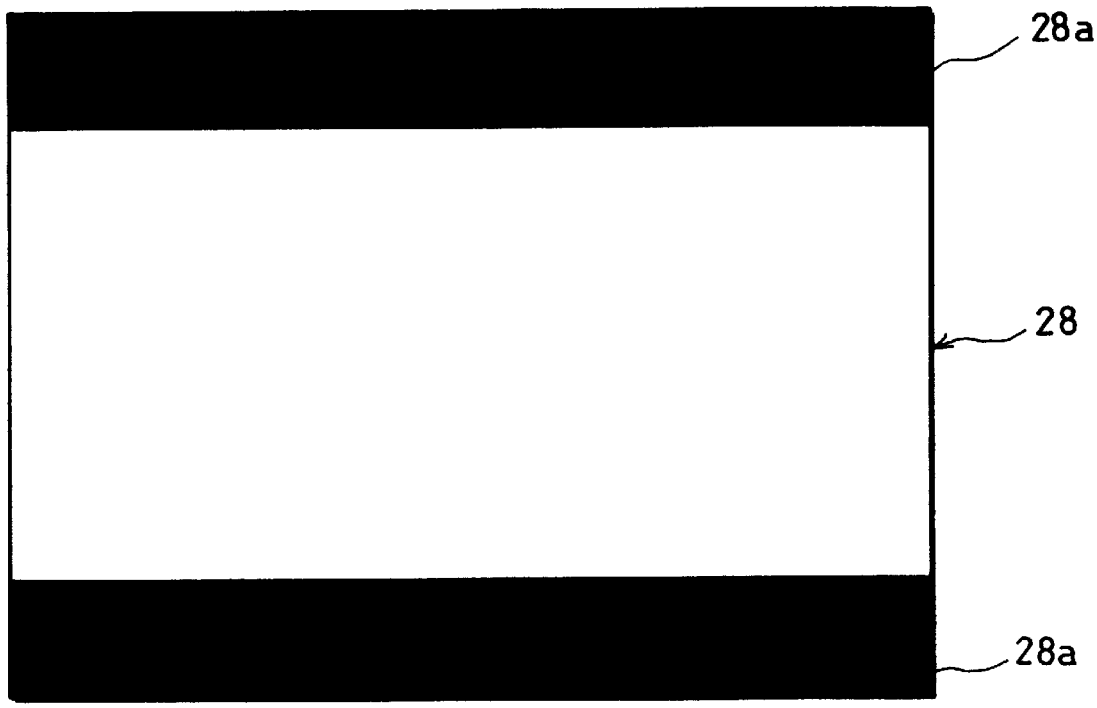
FIG. 17 is an explanatory view showing an example of a display screen in a display mode in which a side-black section is displayed in the upper and lower regions of the screen.

Here, the following description will explain a display mode for providing a different display state. In this display mode, as shown in FIG. 17, side-black sections 28*a* of a predetermined width are displayed in upper and lower regions of the screen 28. This display mode corresponds to a display of an image of an aspect ratio of 16:9 on an image display device of an aspect ratio of 4:3. The display of such side-black sections 28*a* is achieved by outputting a side-black display-use image signal DAT from the pre-charge control circuit 4 to the data signal lines SL. More specifically, in a side-black period, the data line driver 3 is in a suspended state in which the image signal is not output to the data signal lines SL and the charge level signal PSG set to a black display level is output to all of data signal lines SL at a time from the pre-charge circuit 4.

Figure 18:
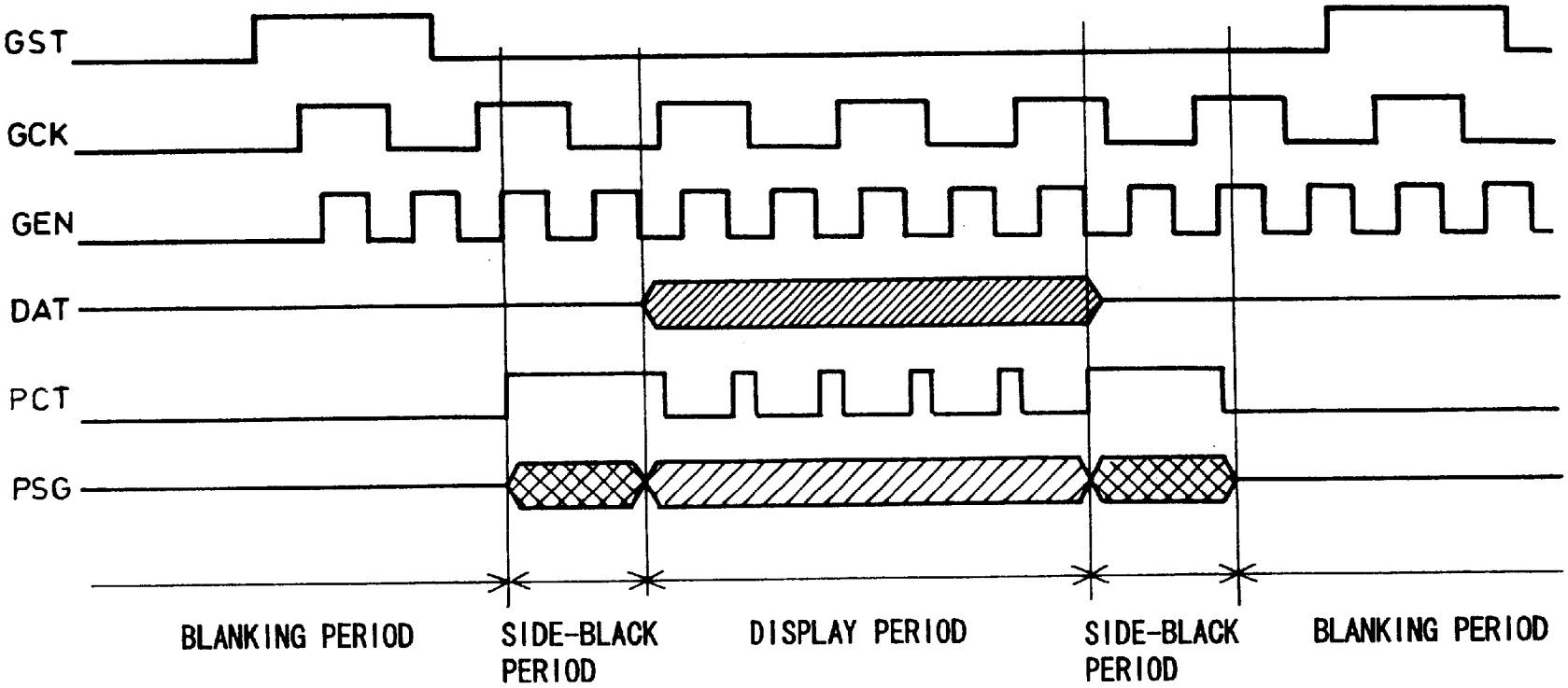
FIG. 18 is a timing chart showing an operation of the drive system in the above display mode.

At this time, as shown by the timing chart of FIG. 18, there is a period in which the enable signal GEN and pre-charge control signal PCT are active at the same time. Therefore, if the initialization of the shift register 11 is performed by the NAND signal of the enable signal GEN and pre-charge control signal PCT, the shift register 11 suspends its operation because it is initialized during the side-black period. However, in the side-black period, since the data line driver 3 is not operated, there is no problem even when the shift register 11 of the data line driver 3 is initialized. On the other hand, when the operation of the shift register 11 of the scanning line driver 2 is suspended by initialization, the side-black sections 28*a* can not be displayed. Therefore, the initialization in the side-black period is inappropriate.

Hence, in the image display device including the display mode for displaying the side-black sections 28*a*, it is necessary to arrange at least the shift register 11 of the scanning line driver 2 not to be initialized during the operation of this display mode. For instance, it is possible to provide means for cutting off the supply path of the initialization signal /INIT from the NAND gate 8, for example, a switch, during the operation in the above display mode.

Alternatively, in order to prevent the initialization of the shift register 11 of the scanning line driver 2 during the operation in the above display mode, the scanning line driver 2 may not have the initialization function. The reasons for this are that the operation frequency of the scanning line driver 2 is smaller than that of the data line driver 3 on a 2-to 3-digit scale, and therefore an erroneous operation is less likely to occur and the increase in the power consumption is small even if the signal line load is not reduced by initialization.

Hence, in this embodiment, it is possible to generate a reset signal based on a combination of signals which are present as a combination of signals during the normal driving (i.e., signals which become active simultaneously during the normal driving) but do not affect the displayed image. Even in this case, it is not necessary to input the reset signal from an external device.

Second Embodiment

The following description will explain the second embodiment of the present invention with reference to FIGS. 19 to 22. In this embodiment and following embodiments, the elements having the same functions as those in the above-mentioned first embodiment will be designated as the same codes and the explanation thereof will be omitted.

Figure 19:
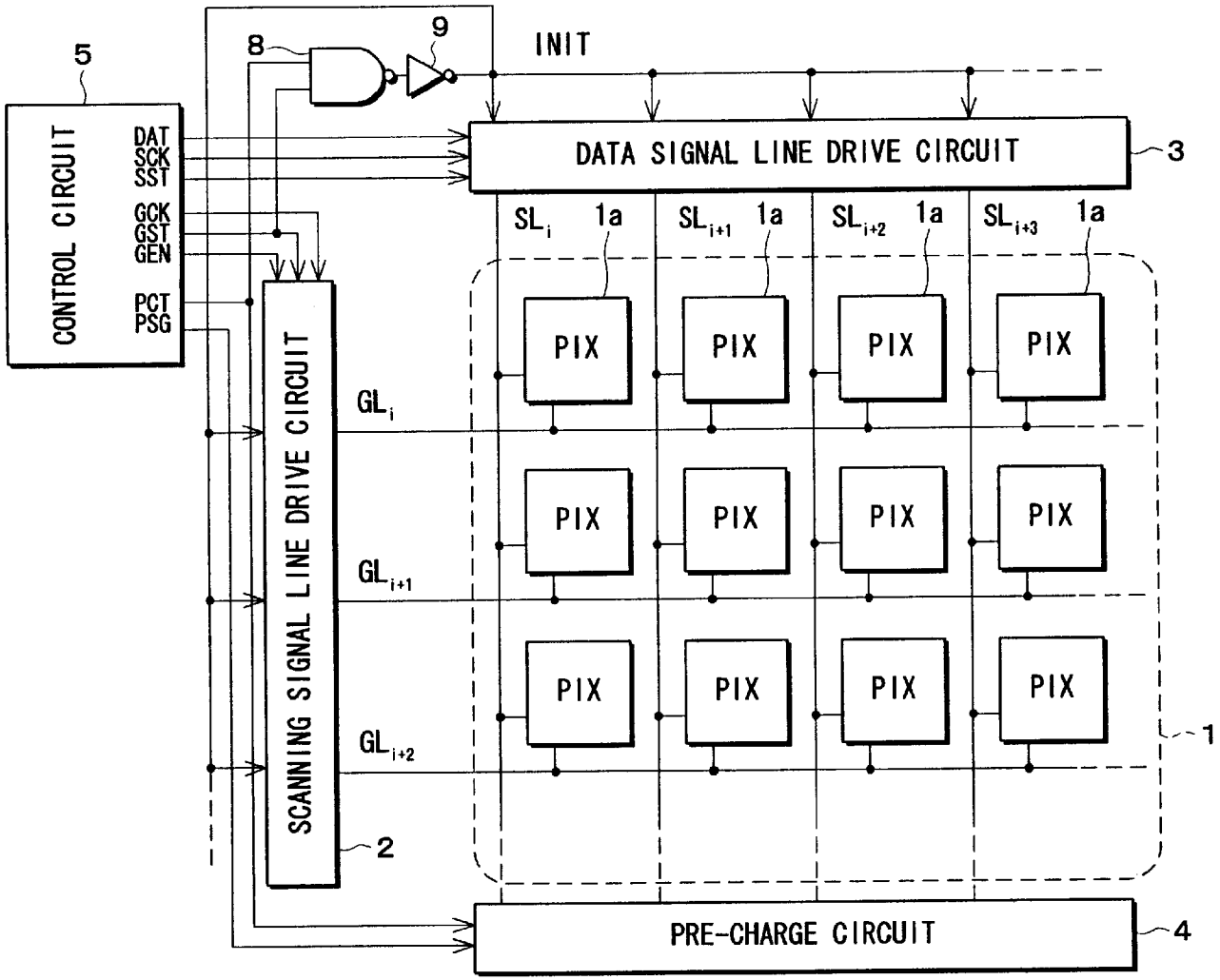
FIG. 19 is a block diagram showing a structure of an image display device according to the second embodiment of the present invention.

Like the above-mentioned image display devices (see FIG. 1 to FIG. 4), as shown in FIG. 19, an image display device of this embodiment includes a pixel array 1, a scanning line driver 2, a data line driver 3, a pre-charge circuit 4, a control circuit 5 and an NAND gate 8. Moreover, this image display device further includes an inverter 9. This inverter 9 inverts an output signal (/INIT) of the NAND gate 8 to produce an initializing signal INIT which is active when it is high level and outputs the initializing signal /INIT.

Besides, for the sake of explanation, like the image display device of FIG. 1, FIG. 19 shows only an example using a combination of the enable signal GEN and pre-charge control signal PCT. However, the combination of signals is not necessarily limited to this example. In other words, the combinations of signals used in the image display devices of FIGS. 2 to 4 can also be applied to this image display device. Furthermore, it is possible to adopt the same structure for the scanning line driver 2 of this embodiment, and also those of the third and fifth embodiments.

Figure 20:
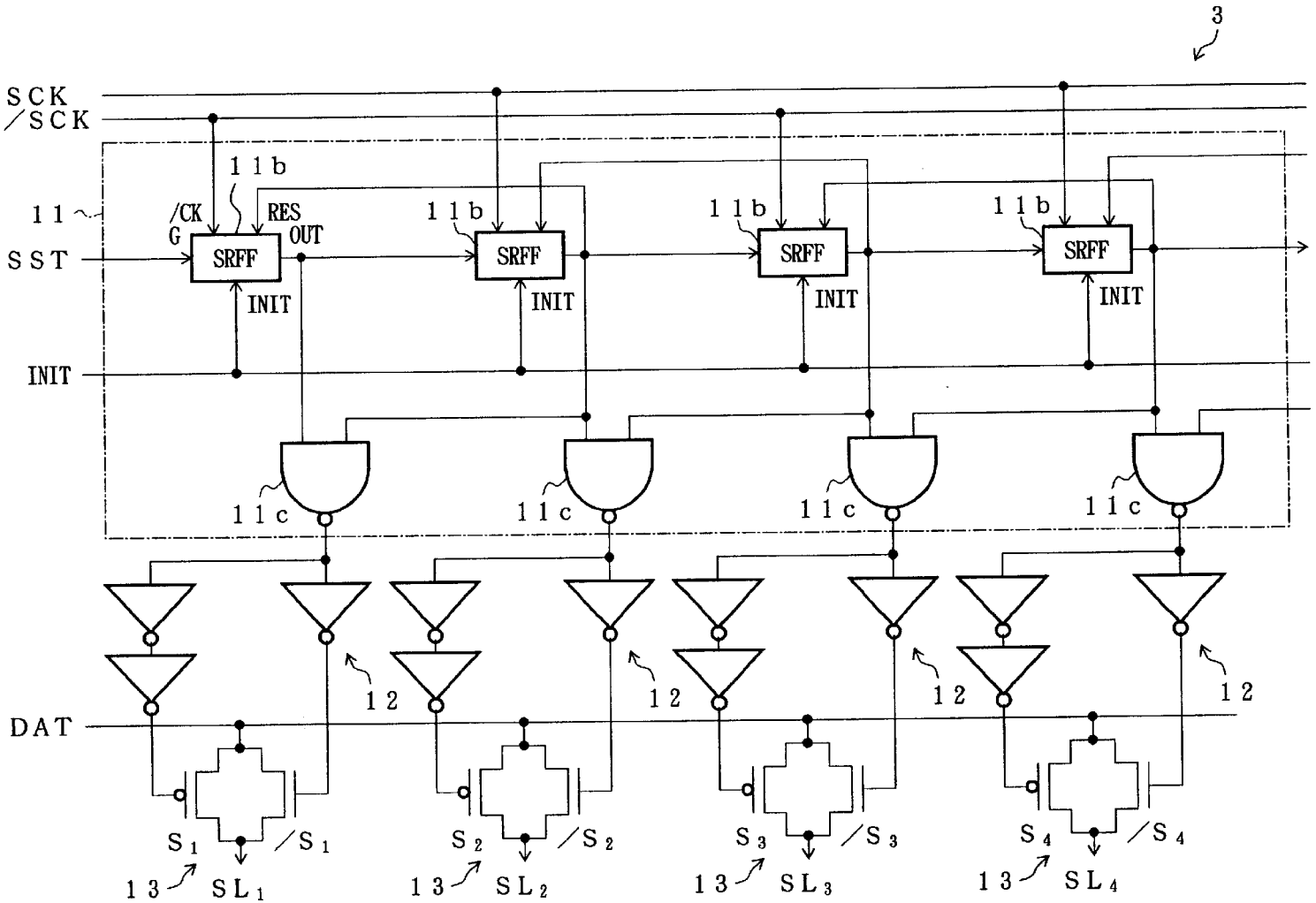
FIG. 20 is a circuit diagram showing a structure of a data signal line drive circuit provided in the image display device of FIG. 19.

As shown in FIG. 20, the shift register 11 in the data line driver 3 of this image display device includes S-R (set-reset) flip-flops (shown as SRFF in FIG. 20) 11*b* in place of the D-type flip-flops 11*a*. In this shift register 11, a signal input to the flip-flop 11*b* in a stage from the flip-flop lib in the preceding stage is used as an activating signal G for the flip-flop 11*b* in the stage, and an output signal OUT of the flip-flop 11*b* in the succeeding stage is used as a reset signal RES for the flip-flop 11*b* in the stage. Moreover, clock signals having mutually opposite phases are input to adjacent flip-flops 11*b*, respectively.

Besides, the shift register 11 in the scanning line driver 2 is configured in the same manner.

Figure 21:
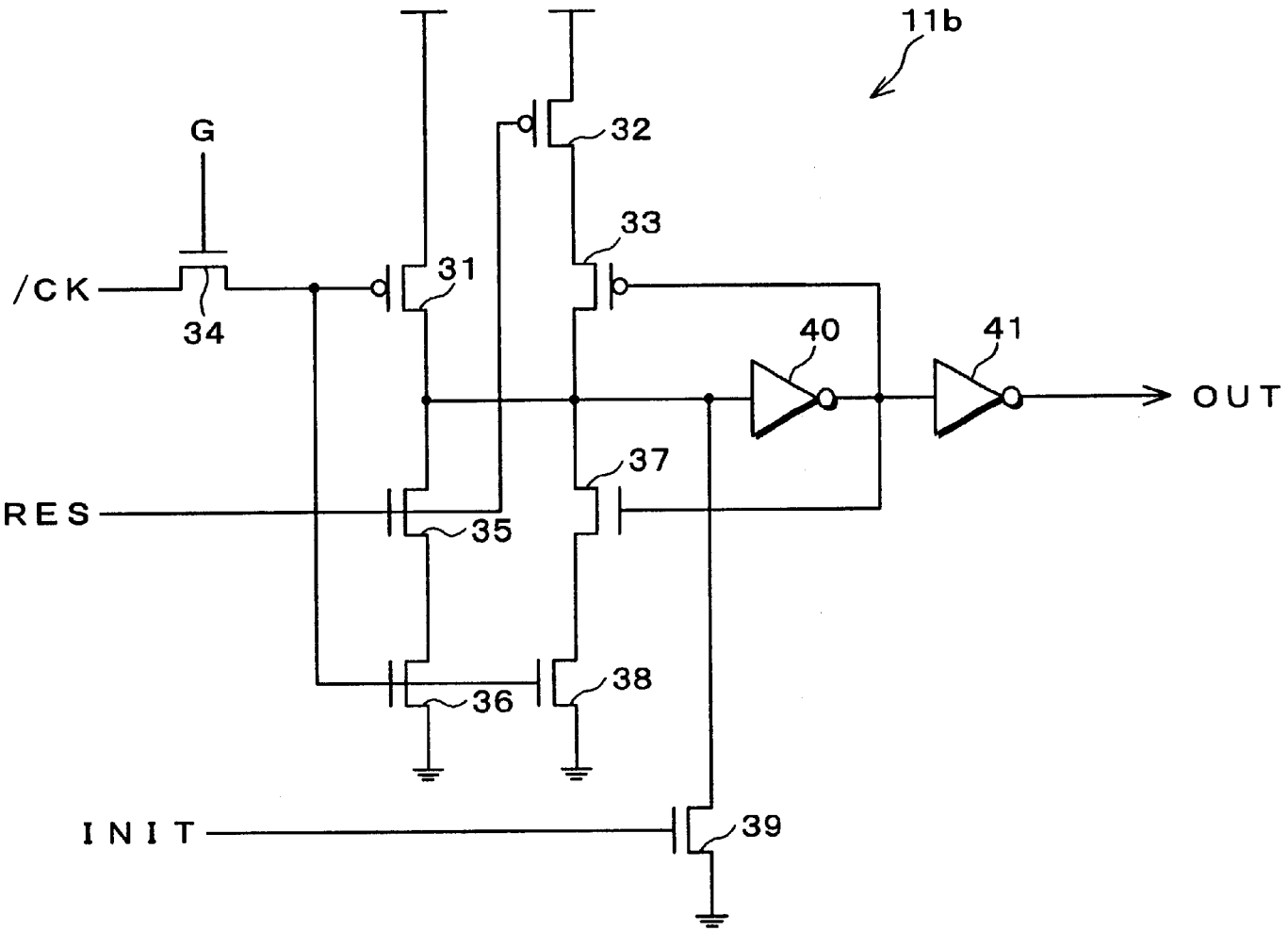
FIG. 21 is a circuit diagram showing a structure of an R-S flip-flop constituting a shift register incorporated into the data signal line drive circuit of FIG. 20.

More specifically, as shown in FIG. 21, the S-R flip-flop 11*b* includes P-channel transistors 31 to 33, N-channel transistors 34 to 39, and inverters 40 and 41. In this flip-flop 11*b*, a clock signal SCK or an inverted clock signal /SCK is used as the clock signal /CK.

The P-channel transistor 31 and the N-channel transistors 35 and 36 are connected in series between a power supply line and a ground line. Similarly, the P-channel transistors 32 and 33 and the N-channel transistors 37 and 38 are connected in series between the power supply line and the ground line. The connection point of the transistors 31 and 35 and the connection point of the transistors 33 and 37 are connected to the ground line via the N-channel transistor 39 and also connected to the input terminal of the inverter 40. The gates of the P-channel transistor 33 and N-channel transistor 37 are connected to the output terminal of the inverter 40 (the input terminal of the inverter 41).

The clock signal /CK is input to the gates of the P-channel transistor 31 and N-channel transistors 36 and 38 via the N-channel transistor 34. The reset signal RES is input to the gates of the P-channel transistor 32 and N-channel transistor 35. The initializing signal INIT is input to the gate of the N-channel transistor 39.

The flip-flop 11*b* configured as described above is set in the period in which both of the activating signal G and clock signal /CK are active simultaneously, and consequently the output (OUT) becomes active. Meanwhile, the flip-flop 11*b* is reset in the period in which the reset signal RES is active, and consequently the output becomes inactive. By repeating this operation, the start signal SST (GST) is sequentially transferred to the succeeding stages. Moreover, when the internal nodes of the flip-flops 11*b* are initialized to a low electric potential by the initializing signal INIT at the time power is supplied, the respective outputs become inactive.

Figure 22:
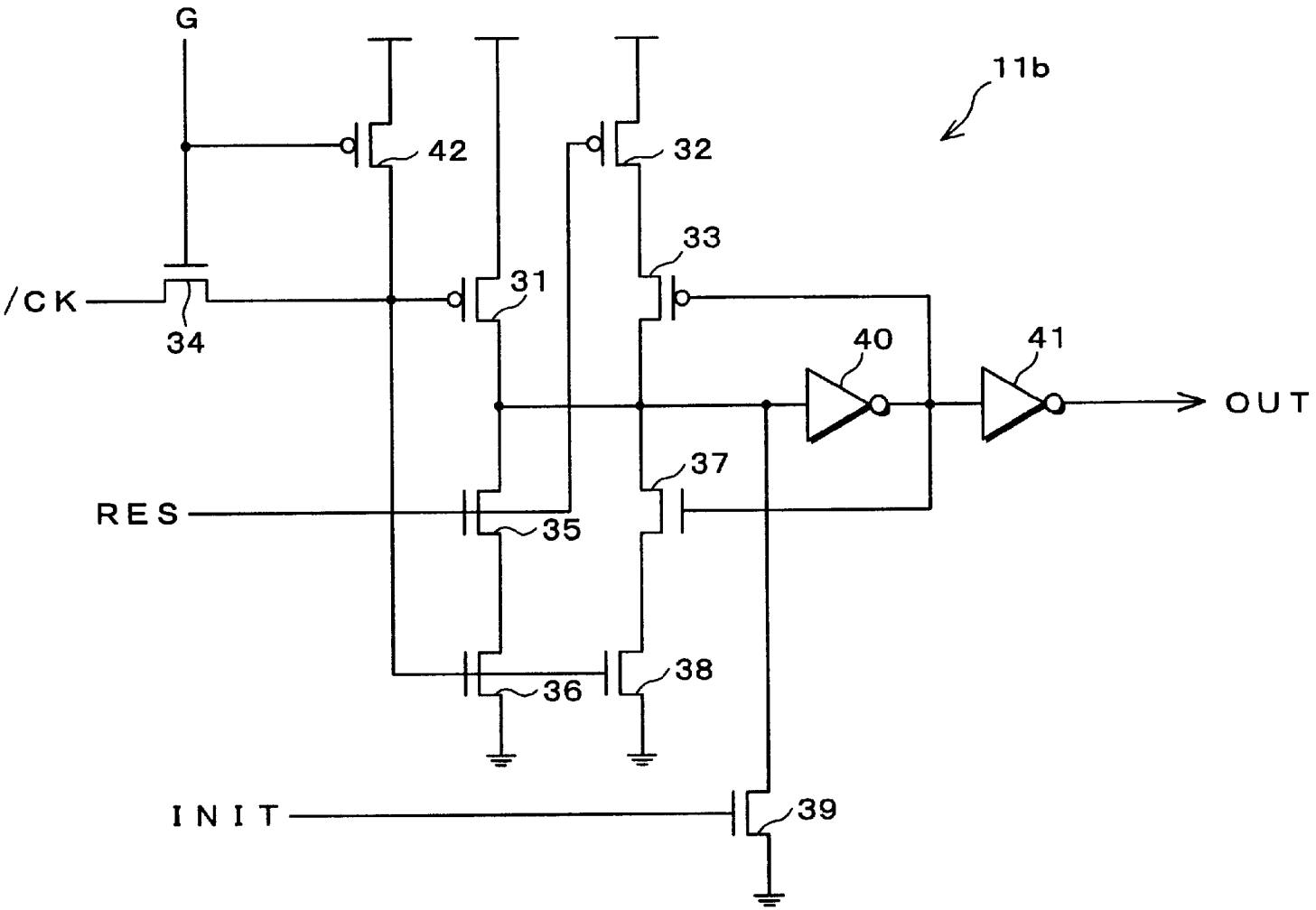
FIG. 22 is a circuit diagram showing another structure of an R-S flip-flop constituting a shift register incorporated into the data signal line drive circuit of FIG. 20.

As shown in FIG. 22, other S-R flip-flop 11*b* further includes a P-channel transistor 42. This P-channel transistor 42 is connected between the power supply line and the gates of the P-channel transistor 31 and N-channel transistors 36 and 38. Moreover, the above-mentioned activating signal G is also input to the gate of the P-channel transistor 42.

In the flip-flop 11*a* thus configured, the activating signal G has the function of controlling the input of the clock signal /CK and resetting the internal state simultaneously. In other words, when the activating signal G is active, if the clock signal /CK is input, the flip-flop 11*b* is set. On the other hand, when the activating signal G is inactive, the input of the clock signal /CK is cut off and the level of the set signal (inverted) is changed to a high electric potential via the P-channel transistor 42 to make the internal state inactive. Accordingly, a stable flip-flop operation can be achieved.

In the shift register 11 using the S-R flip-flops 11*b* like the image display device of this embodiment, like the image display device of the first embodiment, it is possible to reset the internal state without additionally supplying a reset signal from an external device. Thus, by adopting the above configuration, not only the operational stability of the image display device is achieved, but also the cost and power consumption of the external IC can be reduced.

Incidentally, the flip-flip 11*b* is not necessarily limited to the circuits shown as examples in FIGS. 21 and 22, and includes similar circuit having the same function.

Third Embodiment

Figure 23:
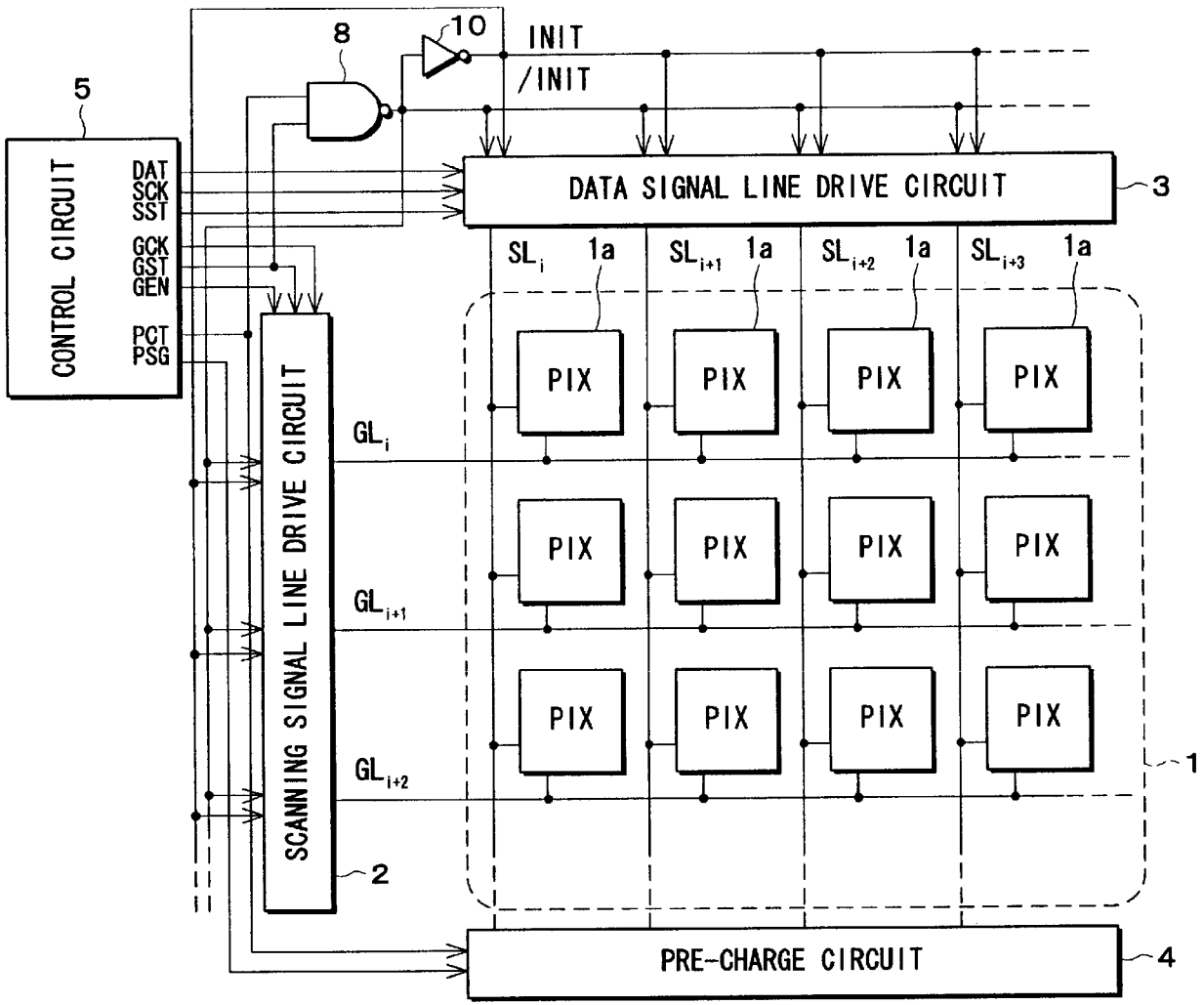
FIG. 23 is a block diagram showing a structure of an image display device according to the third embodiment of the present invention.
Figure 24:
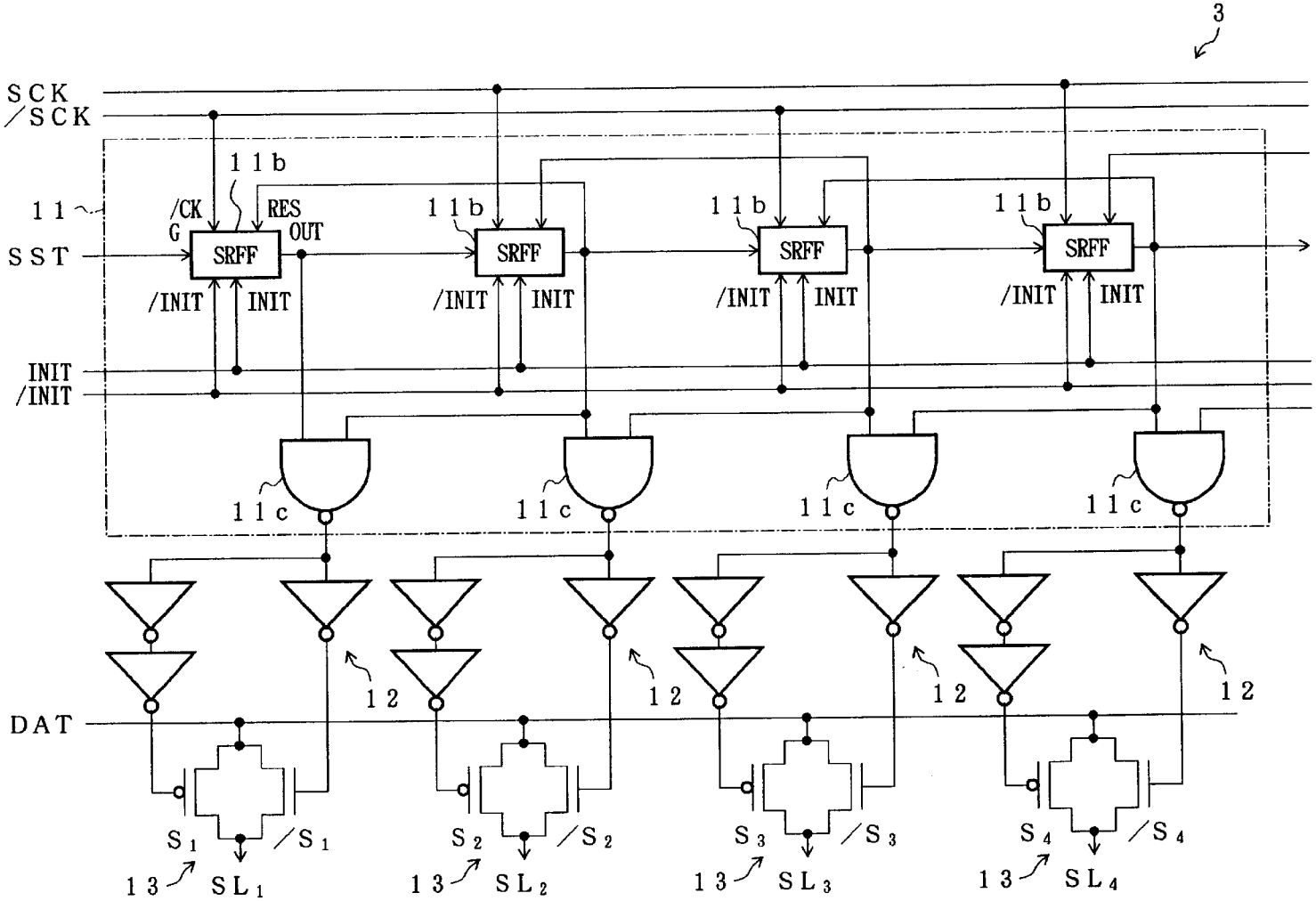
FIG. 24 is a circuit diagram showing a structure of a data signal line drive circuit provided in the image display device of FIG. 23.
Figure 25:
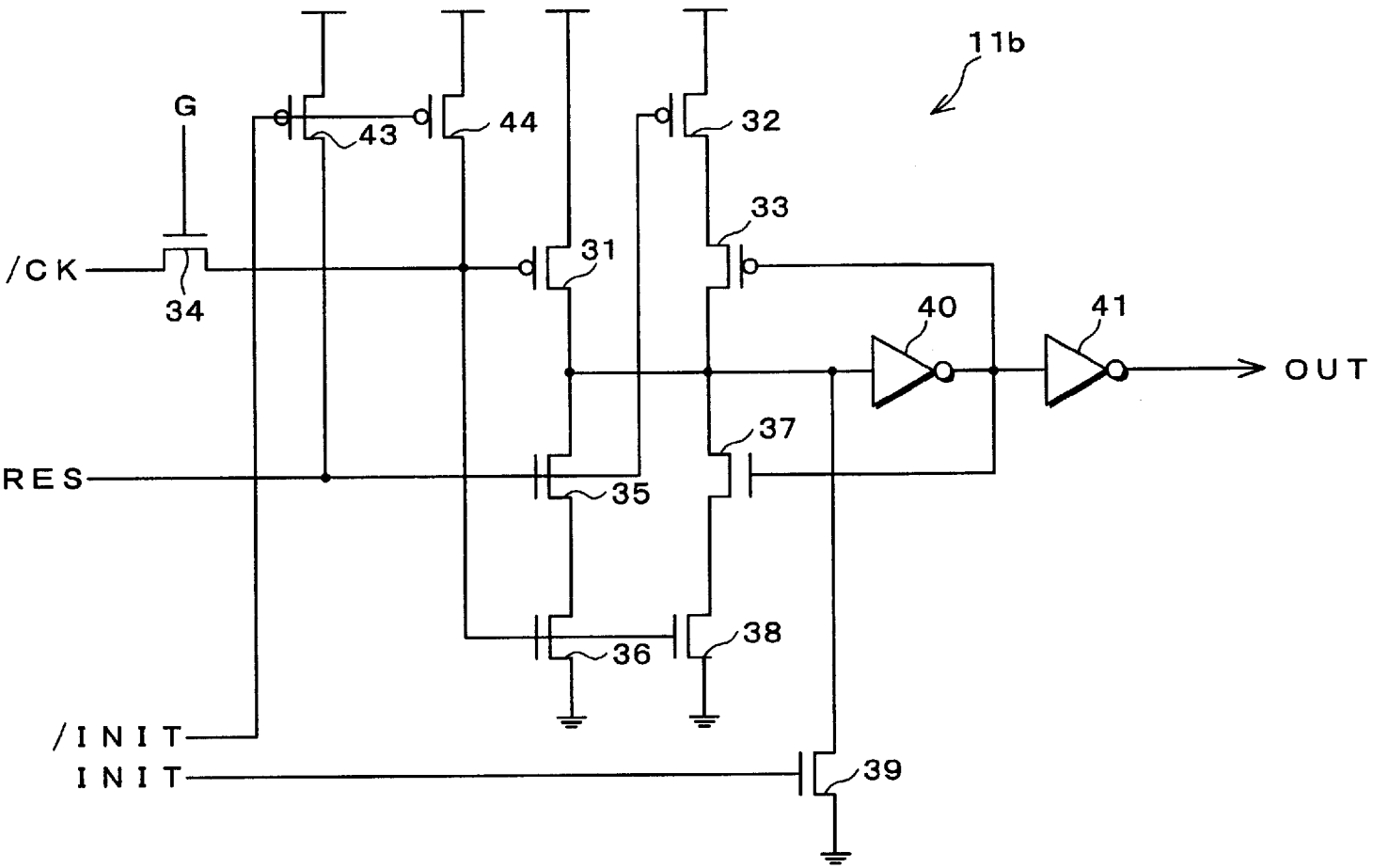
FIG. 25 is a circuit diagram showing a structure of an R-S flip-flop constituting a shift register incorporated into the data signal line drive circuit of FIG. 24.

The following description will explain the third embodiment of the present invention with reference to FIGS. 23 to 25.

Like the above-mentioned image display devices (see FIG. 1 to FIG. 4), as shown in FIG. 23, an image display device of this embodiment includes a pixel array 1, a scanning line driver 2, a data line driver 3, a pre-charge circuit 4, a control circuit 5 and an NAND gate 8. Moreover, this image display device further includes an inverter 10. This inverter 10 is disposed in parallel with the output path of the initializing signal /INIT, inverts an output signal (/INIT) of the NAND gate 8 to produce an initializing signal INIT which is active when it is high level and outputs the initializing signal /INIT. Therefore, unlike the shift register 11 shown in FIG. 20, two types of initializing signals INIT and /INIT are supplied to the shift registers 11 in the scanning line driver 2 and data line driver 3 as shown in FIG. 24.

Besides, like the second embodiment, in this embodiment, for the sake of explanation, FIG. 23 shows only an example using a combination of the enable signal GEN and pre-charge control signal PCT as in the image display device of FIG. 1.

As shown in FIG. 25, the S-R flip-flop 11*b* provided in the shift register 11 further includes P-channel transistors 43 and 44 in addition to the structure of the shift register 11*b* shown in FIG. 21. The P-channel transistor 43 is connected between the power supply line and the supply line of the reset signal RES. The P-channel transistor 42 is connected between the power supply line and the gates of the P-channel transistor 31 and N-channel transistors 36 and 38. Besides, the initializing signal /INIT is input to the gates of the P-channel transistors 43 and 44.

In the flip-flop 11*a* thus configured, when the initializing signal /INIT is active, the levels of the set signal (inverted) and reset signal are changed to a high electric potential via the P-channel transistors 44 and 43, respectively, to make the internal state inactive. In other words, this flip-flop 11*b* is arranged to initialize not only the internal node but also an input node (the set signal and reset signal) With this arrangement, it is possible to prevent the potential level of the internal node which has been initialized once from being changed by the output of the flip-flop 11*b* in the previous stage, Accordingly, the shift register 11 can be certainly initialized.

In the image display device of this embodiment, like the image display devices of the first and second embodiment, it is possible to reset the internal state without additionally supplying a reset signal from an external device. It is thus possible to achieve not only the operational stability of the image display device, but also a reduction in the cost and power consumption of the external IC.

Incidentally, the flip-flip 11*b* is not necessarily limited to the circuit shown in FIG. 25, and includes a similar circuit having the same function. Moreover, needless to say, the structure for initializing the set signal and reset signal is not limited to the circuit illustrated as an example.

Fourth Embodiment

The following description will explain the fourth embodiment of the present invention with reference to FIGS. 26 to 33.

Figure 26:
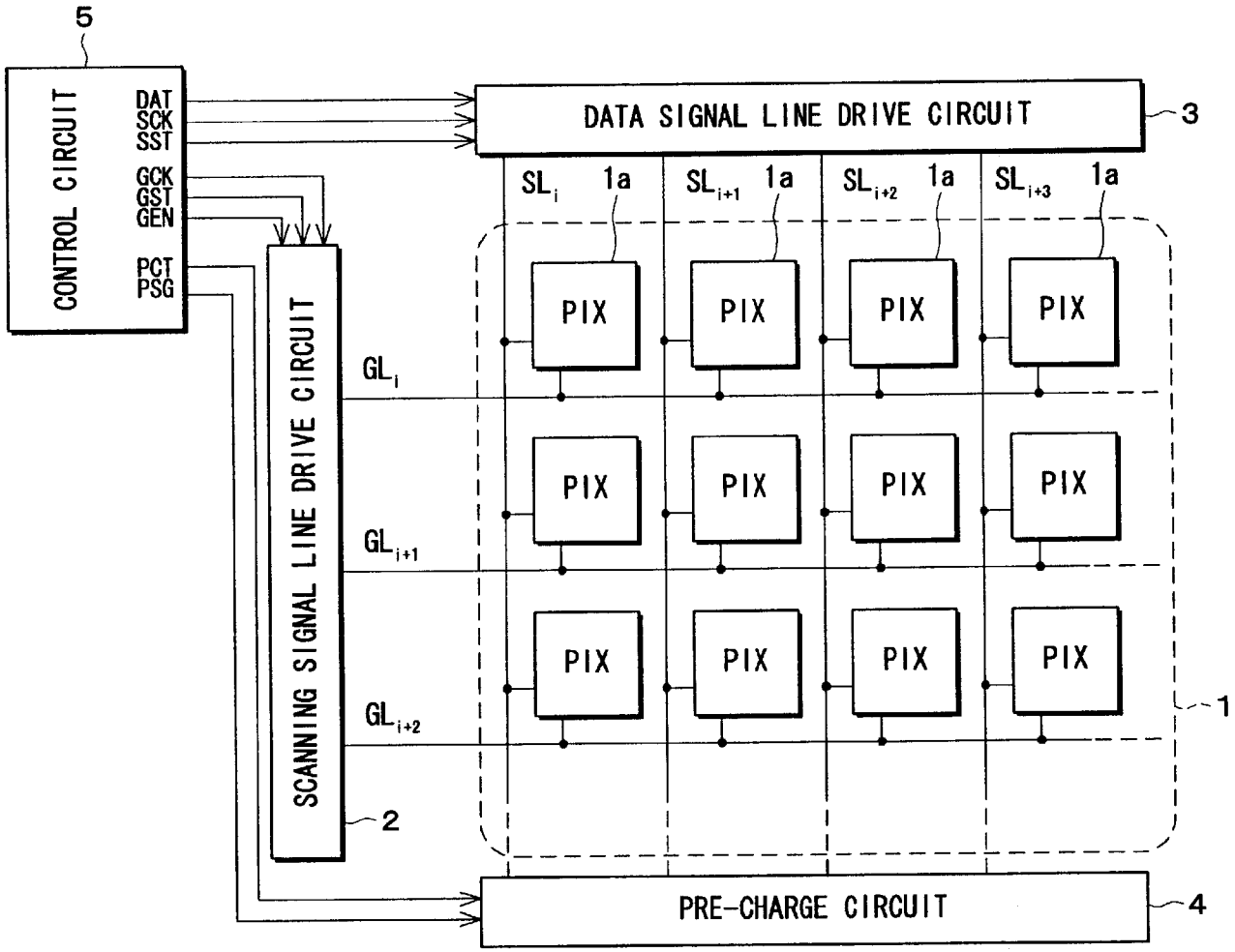
FIG. 26 is a block diagram showing a structure of an image display device according to the fourth embodiment of the present invention.

Like the above-mentioned image display devices (see FIG. 1 to FIG. 4), as shown in FIG. 26, an image display device of this embodiment includes a pixel array 1, a scanning line driver 2, a data line driver 3, a pre-charge circuit 4 and a control circuit 5, but does not have an NAND gate 8. Hence, the initializing signal /INIT is not supplied to the shift registers in the scanning line driver 2 and the data line driver 3.

Figure 27:
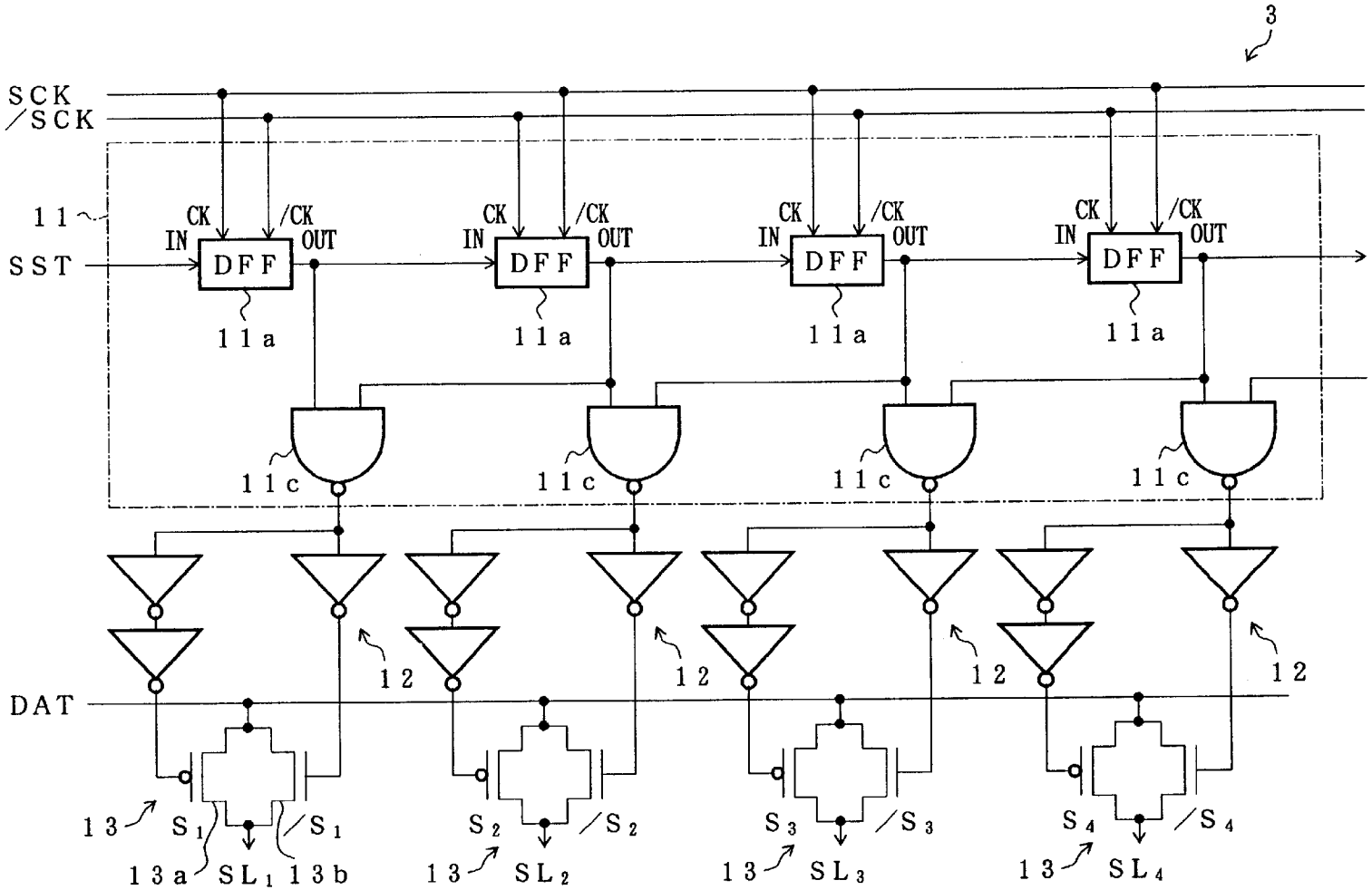
FIG. 27 is a circuit diagram showing a structure of a data signal line drive circuit provided in the image display device of FIG. 26.

As shown in FIG. 27, although the shift register 11 in the data line driver 3 of this image display device has substantially the same structure as the shift register 11 (see FIG. 7) of the first embodiment, the initializing signal /INIT is not supplied to each flip-flop 11*a*.

Figure 28:
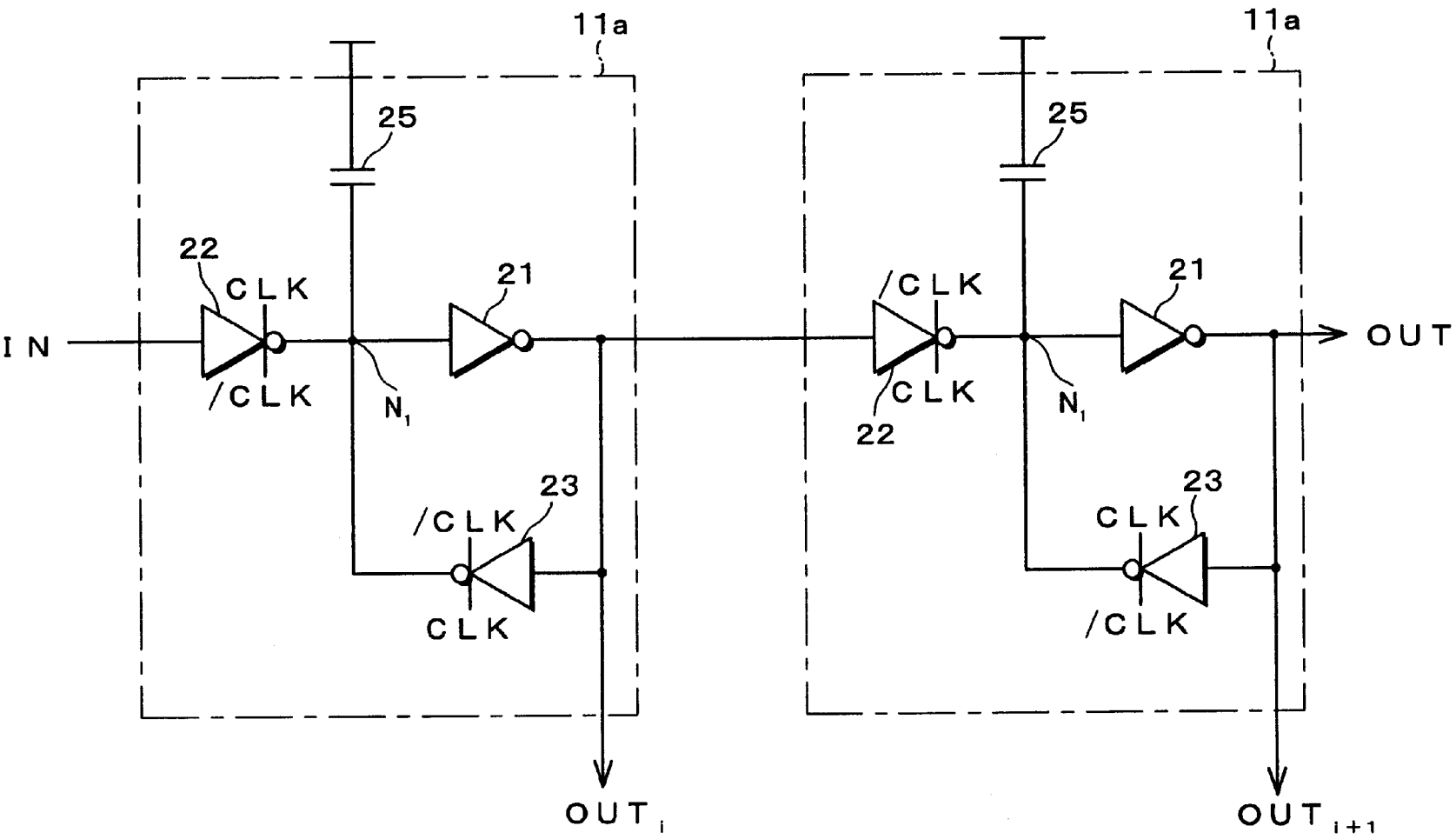
FIG. 28 is a circuit diagram showing a structure of a D-type flip-flop constituting a shift register of the data signal line drive circuit of FIG. 27.

As shown in FIG. 28, the D-type flip-flop 11*a* provided in this shift register 11 includes the inverter 21 and clocked inverters 22 and 23 like the flip-flop 11*a* of the first embodiment (see FIG. 8), and further includes a capacitive element 25 (capacitor) in place of the P-channel transistor 24. The capacitive element 25 is connected between the power supply line and an internal node $N_1$ positioned between the inverter 21 and the clocked inverter 22. In the flip-flop 11*a* thus configured, when the potential level of the power supply line is increased at the time power is supplied, the electric potential of the internal node $N_1$ coupled to the power supply line via the capacitive element 25 is also increased, thereby initializing the output to an inactive state.

Figure 29:
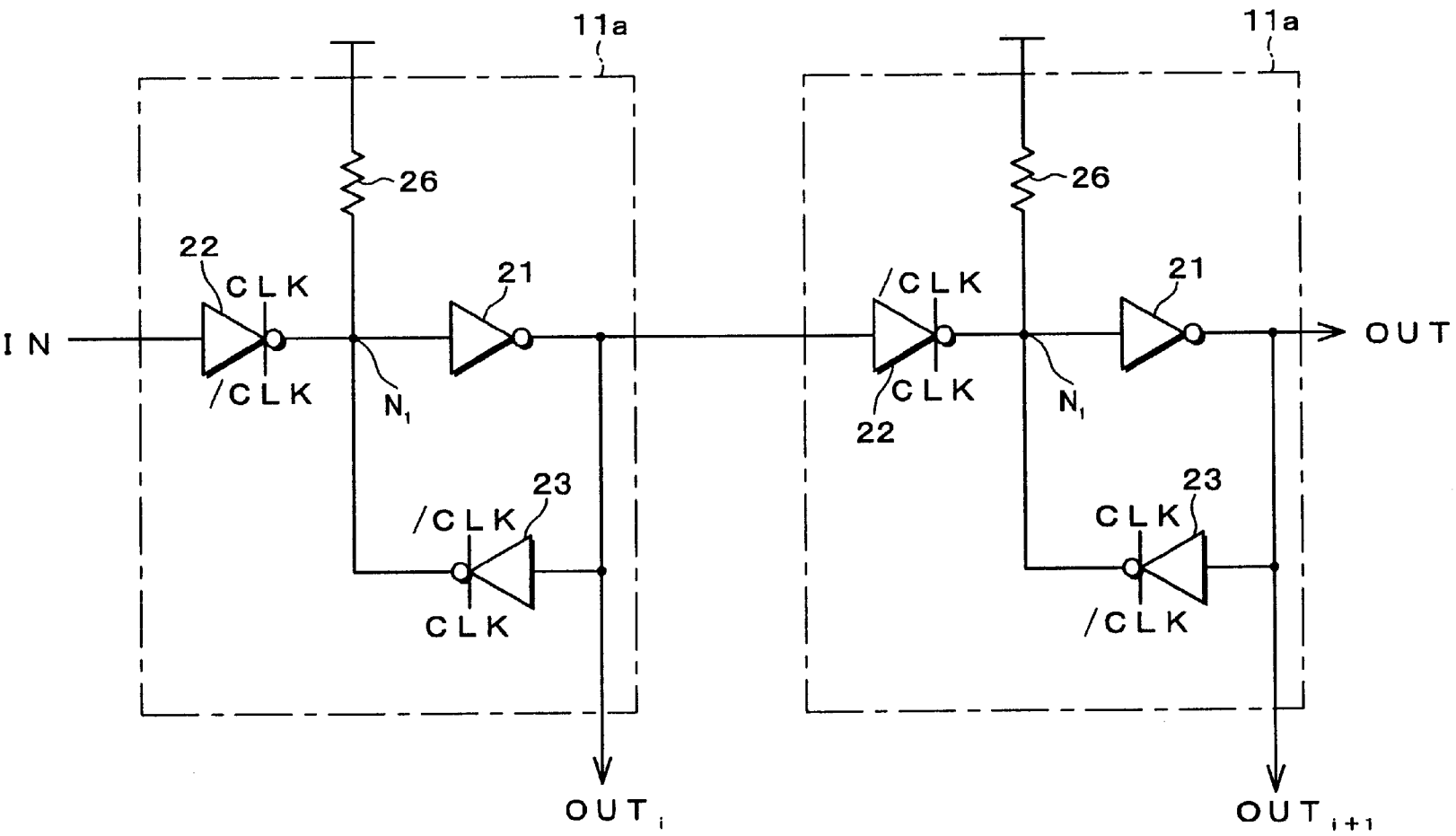
FIG. 29 is a circuit diagram showing another structure of the D-type flip-flop constituting the shift register of the data signal line drive circuit of FIG. 27.

As shown in FIG. 29, other flip-flop 11*a* in this image display device includes a resistive element 26 (resistor) in place of the capacitive element 25. This resistive element 26 is also connected between the power supply line and the internal node $N_1$. In the flip-flop 11*a* thus configured, when the potential level of the power supply line is increased at the time power is supplied, the electric potential of the internal node $N_1$ is also increased via the resistive element 26, thereby initializing the output to an inactive state.

Figure 30:
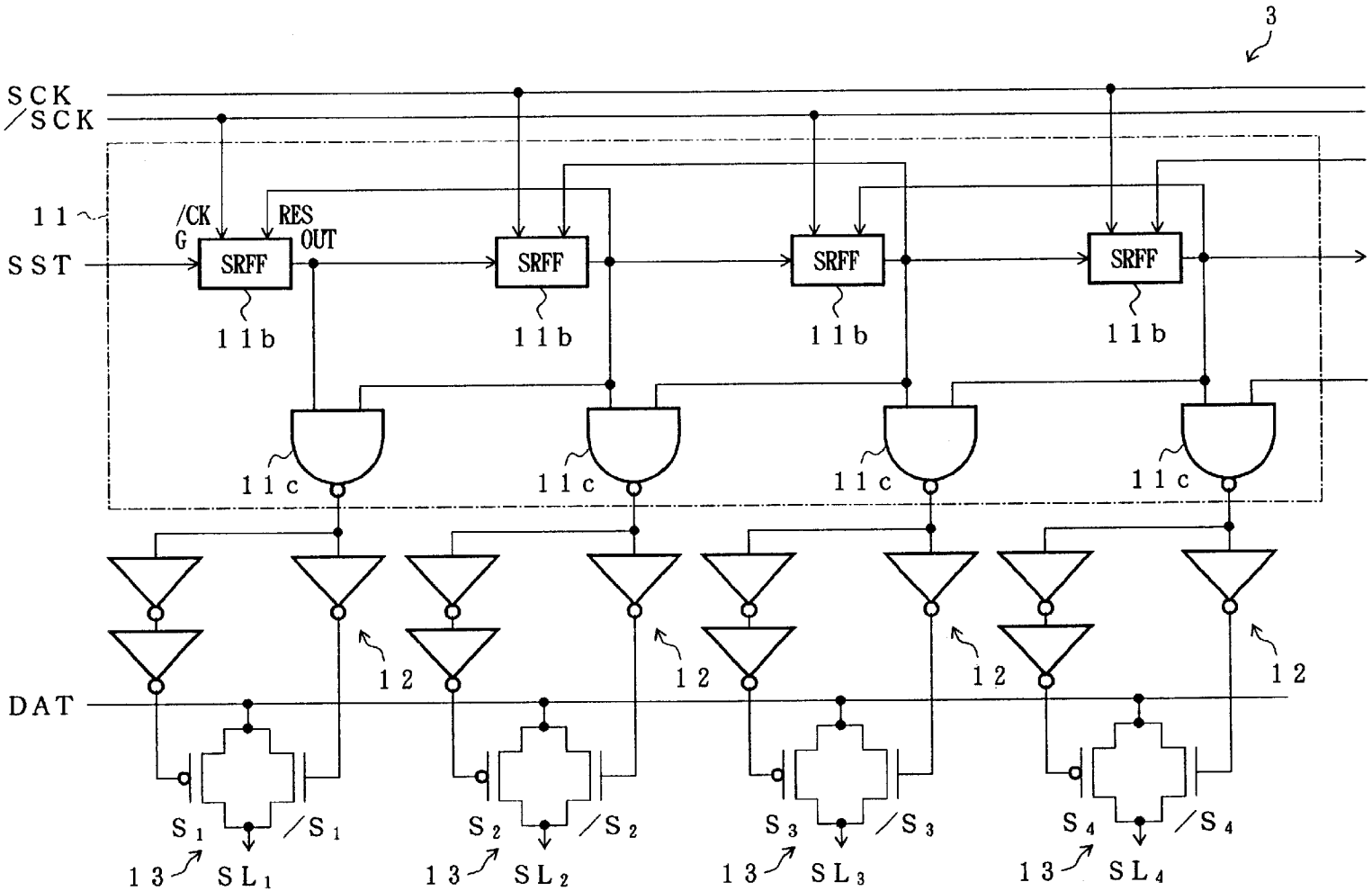
FIG. 30 is a circuit diagram showing another structure of the data signal line drive circuit provided in the image display device of FIG. 26.

As shown in FIG. 30, although the shift register 11 of the data line driver 3 of this image display device has substantially the same structure as the shift register 11 (see FIG. 20) of the second embodiment, the initializing signal INIT is not supplied to each flip-flop 11*a*.

Figure 31:
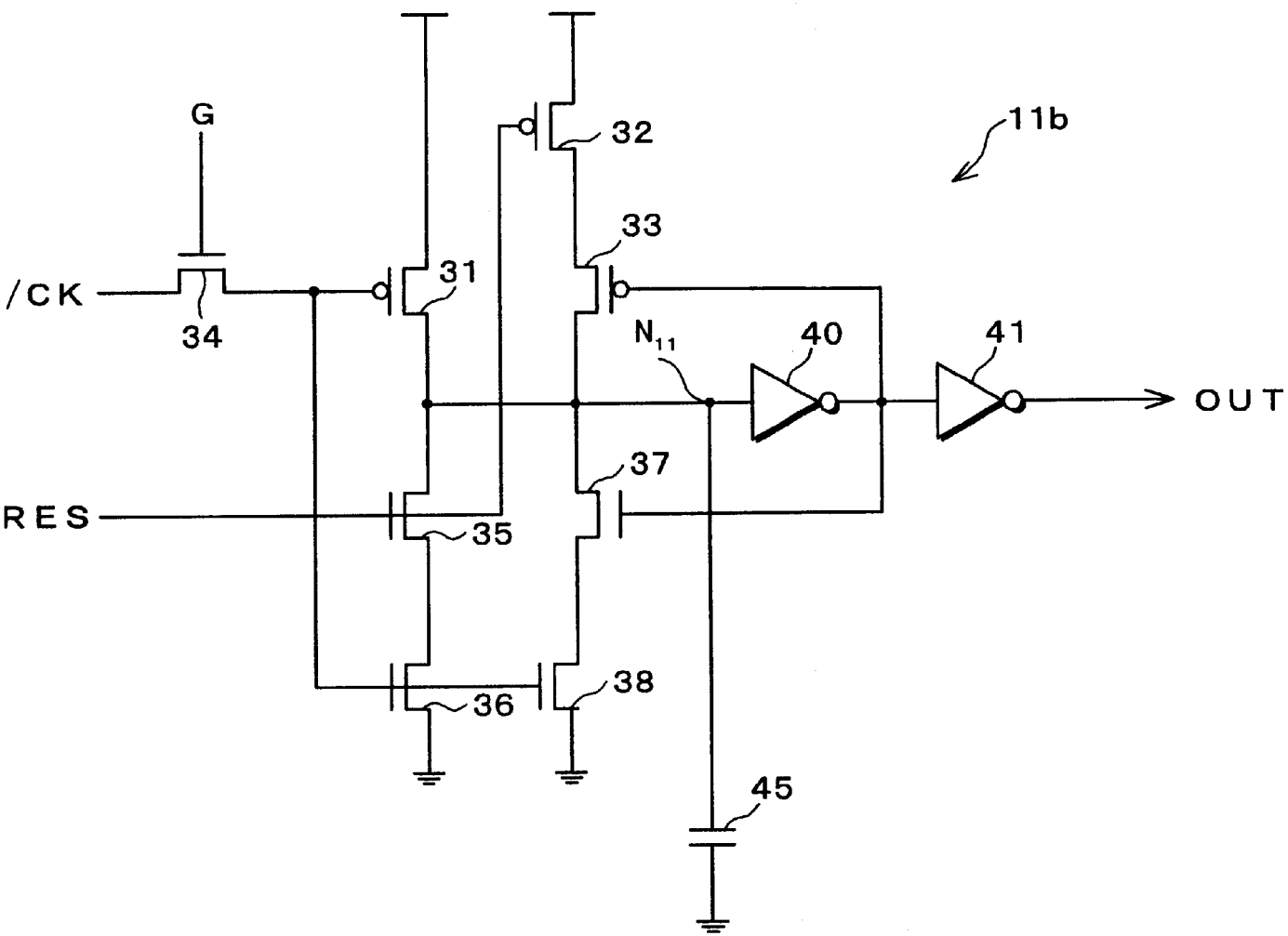
FIG. 31 is a circuit diagram showing a structure of an R-S flip-flop constituting a shift register incorporated into the data signal line drive circuit of FIG. 27.

As shown in FIG. 31, the S-R flip-flop 11*b* provided in this shift register 11 includes a capacitive element 45 (capacitor) in place of the N-channel transistor 39 in the flip-flop 11*b* (see FIG. 21) of the second embodiment. This capacitive element 45 is connected between the internal node $N_{11}$ as the input terminal of the inverter 40 and the ground line. In the flip-flop 11*b* thus configured, even when the potential level of the power supply line is increased at the time power is supplied, the electric potential of the internal node $N_{11}$ is fixed at the grounding potential due to coupling via the capacitive element 45, thereby initializing the output to an inactive state.

Figure 32:
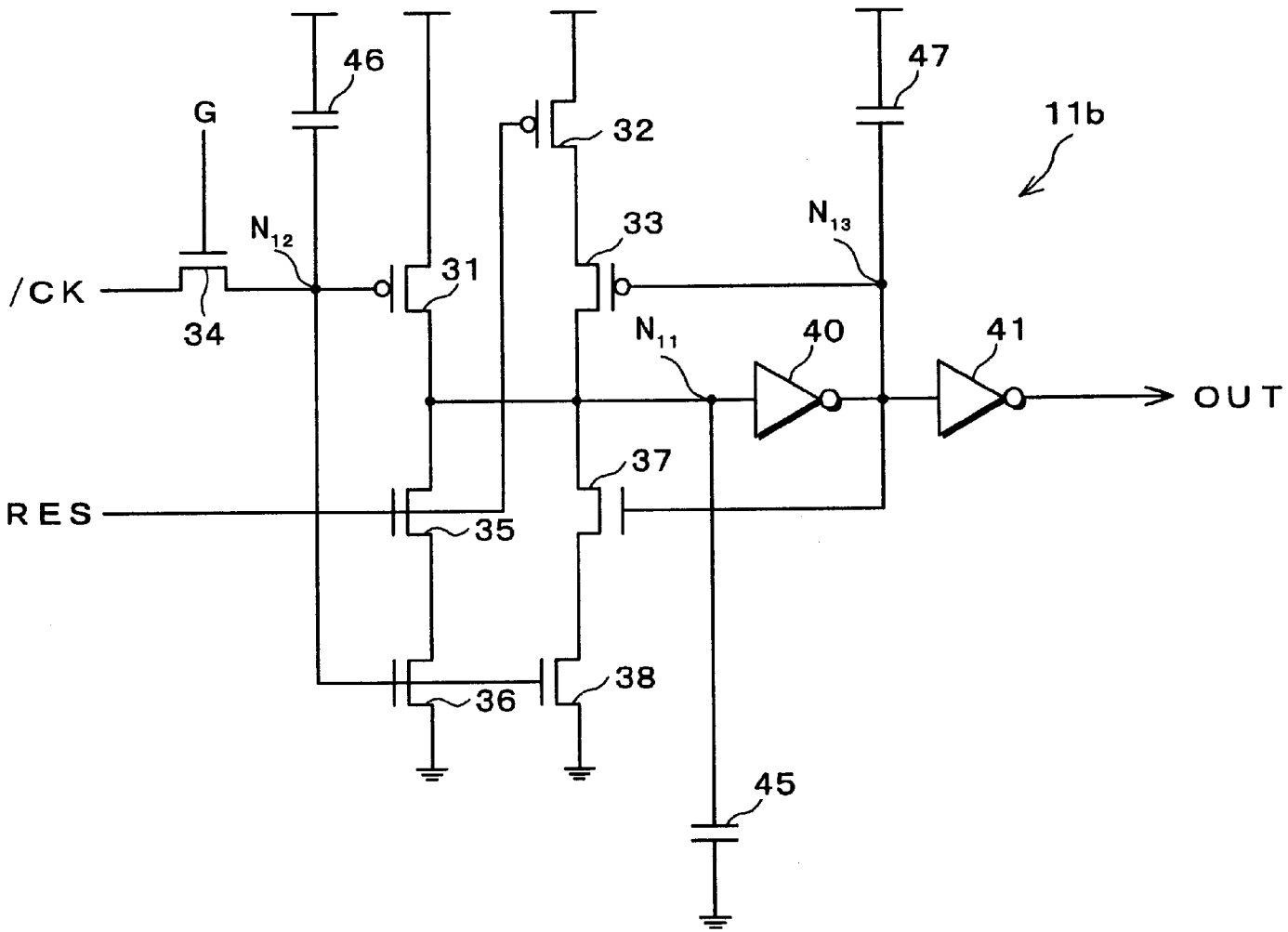
FIG. 32 is a circuit diagram showing another structure of the R-S flip-flop constituting the shift register incorporated into the data signal line drive circuit of FIG. 27.
Figure 33:
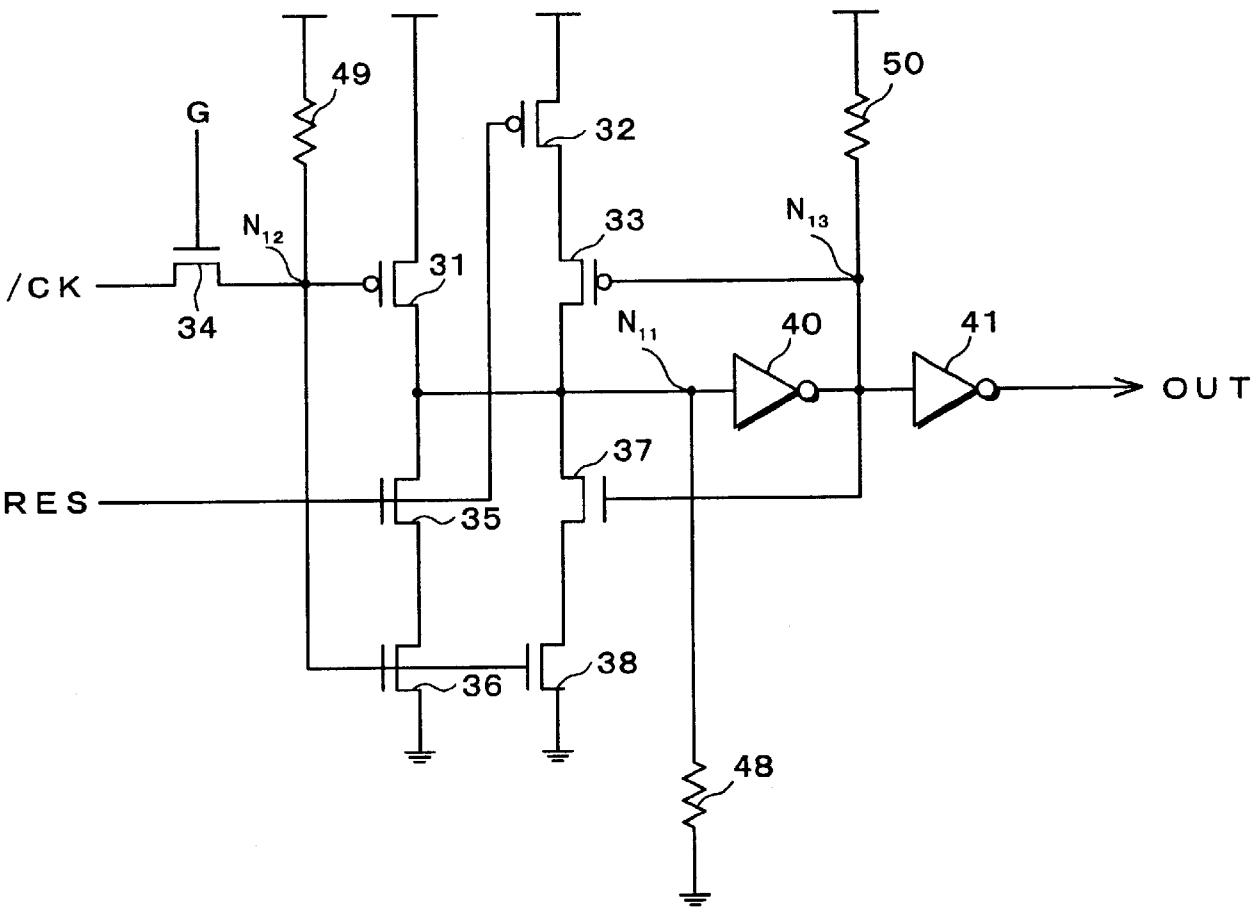
FIG. 33 is a circuit diagram showing still another structure of the R-S flip-flop constituting the shift register incorporated into the data signal line drive circuit of FIG. 27.

As shown in FIG. 32, other flip-flop 11*b* in this image display device further includes capacitive elements (capacitors) 46 and 47. The capacitive element 46 is connected between the internal node $N_{12}$ as the gate of the P-channel transistor 31 and the power supply line, while the capacitive element 47 is connected between the internal node $N_{13}$ as the gate of the P-channel transistor 33 and the power supply line. In the flip-flop 11*b* thus configured, when the potential level of the power supply line is increased at the time power is supplied, not only the electric potential of the internal node $N_{11}$ is fixed at the ground potential via the capacitive element 45, but also the electric potential of the internal nodes $N_{12}$ and $N_{13}$ is fixed at the power supply potential via the capacitive elements 46 and 47, thereby initializing the output to an inactive state. As shown in FIG. 33, still another flip-flop 11*b* in this image display device further includes resistive elements (resistors) 48 to 50 in place of the capacitive elements 45 to 47. In the flip-flop 11*b* thus configured, when the potential level of the power supply line is increased at the time power is supplied, the electric potential of the internal node $N_{11}$ is fixed at the ground potential via the resistive element 48, and the electric potential of the internal node $N_{12}$ and $N_{13}$ are fixed at the power supply potential via the resistive elements 49 and 50, thereby initializing the output to an inactive state.

As described above, the flip-flops 11*a* and 11*b* of this embodiment initialize the internal node by the capacitive or resistive element even when the initializing signal is not supplied from an external device. Therefore, like the image display devices of the above-mentioned embodiments, the image display device of this embodiment can reset the internal state without additionally supplying a reset signal from an external device. Consequently, it is possible to achieve not only the operational stability of the image display device, but also a reduction in the cost and power consumption of the external IC. Moreover, since signal wiring and a switch are not required for initialization, it is possible to prevent a complication in the circuit structure and an increase in the wiring load capacity.

Incidentally, although this embodiment explains the shift register 11 in the data line driver 3, the shift register 11 of the scanning line driver 2 also includes the flip-flop 11*a* or 11*b* similar to the above.

Fifth Embodiment

The following description will explain the fifth embodiment of the present invention with reference to FIGS. 1 to 4 and FIGS. 34 to 39.

Figure 34:
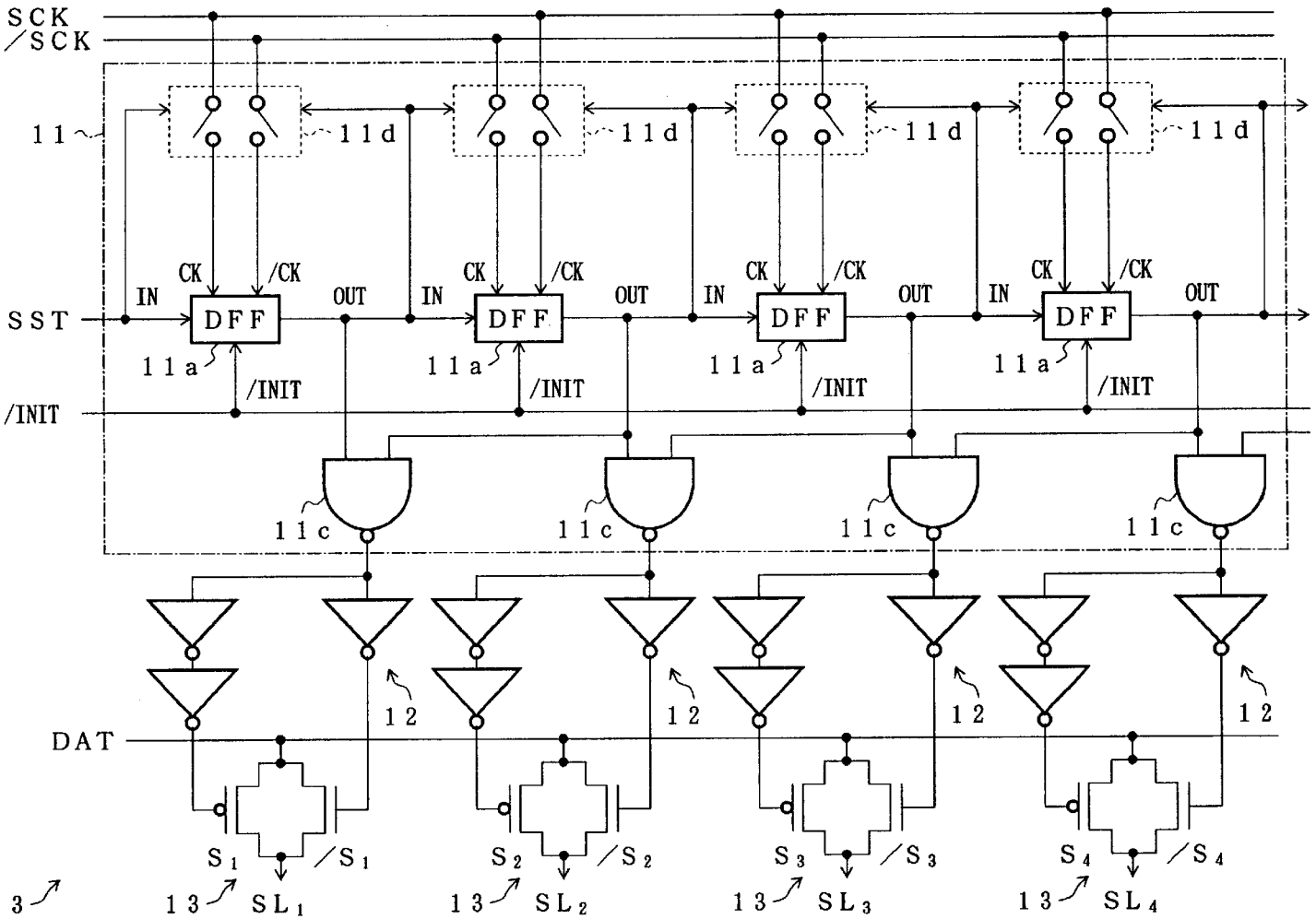
FIG. 34 is a circuit diagram showing a structure of a data signal line drive circuit provided in an image display device according to the fifth embodiment of the present invention.

Like the above-mentioned image display devices of the first embodiment, as shown in FIGS. 1 to 4, an image display device of this embodiment includes a pixel array 1, a scanning line driver 2, a data line driver 3, a pre-charge circuit 4, a control circuit 5, and a NAND gate 8. Moreover, in the data line driver 3 of this image display device, as shown in FIG. 34, the shift register 11 includes transfer gates 11*d*.

The transfer gate lid is provided for each flip-flop 11*a*, and includes a first signal path for inputting the clock signal SCK (CK) and a second signal path for inputting the inverted clock signal /SCK (/CK). The opening and closing of the first signal path and second signal path are controlled, for example, by a combination signal (for example, the sum signal) of an input signal IN input to the flip-flop 11*a* in the same stage (the output signal OUT from the flop-flop 11*a* in the preceding stage) and the output signal OUT from the flip-flop 11*a* in this stage.

In the shift register 11 thus configured, since the first and second signal paths are closed by the input signal IN input to the flip-flop 11*a*, the clock signal SCK and inverted clock signal /SCK are input to the flip-flop 11*a* via the transfer gate 11*d*. On the other hand, since the first and second signal paths are closed by the output signal OUT output from the flip-flop 11*a*, the clock signal SCK and inverted clock signal /SCK are input to the flip-flop 11*a* via the transfer gate 11*d*.

By the inclusion of such a transfer gate 11*d*, in the shift register 11, the clock signal SCK and inverted clock signal /SCK are supplied only to the flip-flop 11*a* to be operated, and therefore the load capacity of the clock signal line can be significantly reduced in comparison with a structure in which the clock signal SCK and inverted clock signal /SCK are supplied to all of the flip-flops 11*a*. It is thus possible to reduce the power consumption and the drive ability of the control circuit 5. Moreover, since the delay in the clock signal line is reduced, the operation margin of the shift register 11 can be increased.

Here, in the shift register 11 including the D-type flip-flop 11*a*, the transfer gate 11*d* is turned on when at least either of the output of the flip-flop 11*a* in the preceding stage (the input to the present stage) or the flip-flop 11*a* in the present stage is active. The reason for this is that the clock signal needs to be input in both the cases when the internal state of each flip-flop 11*a* changes into active and changes into inactive.

Figure 35:
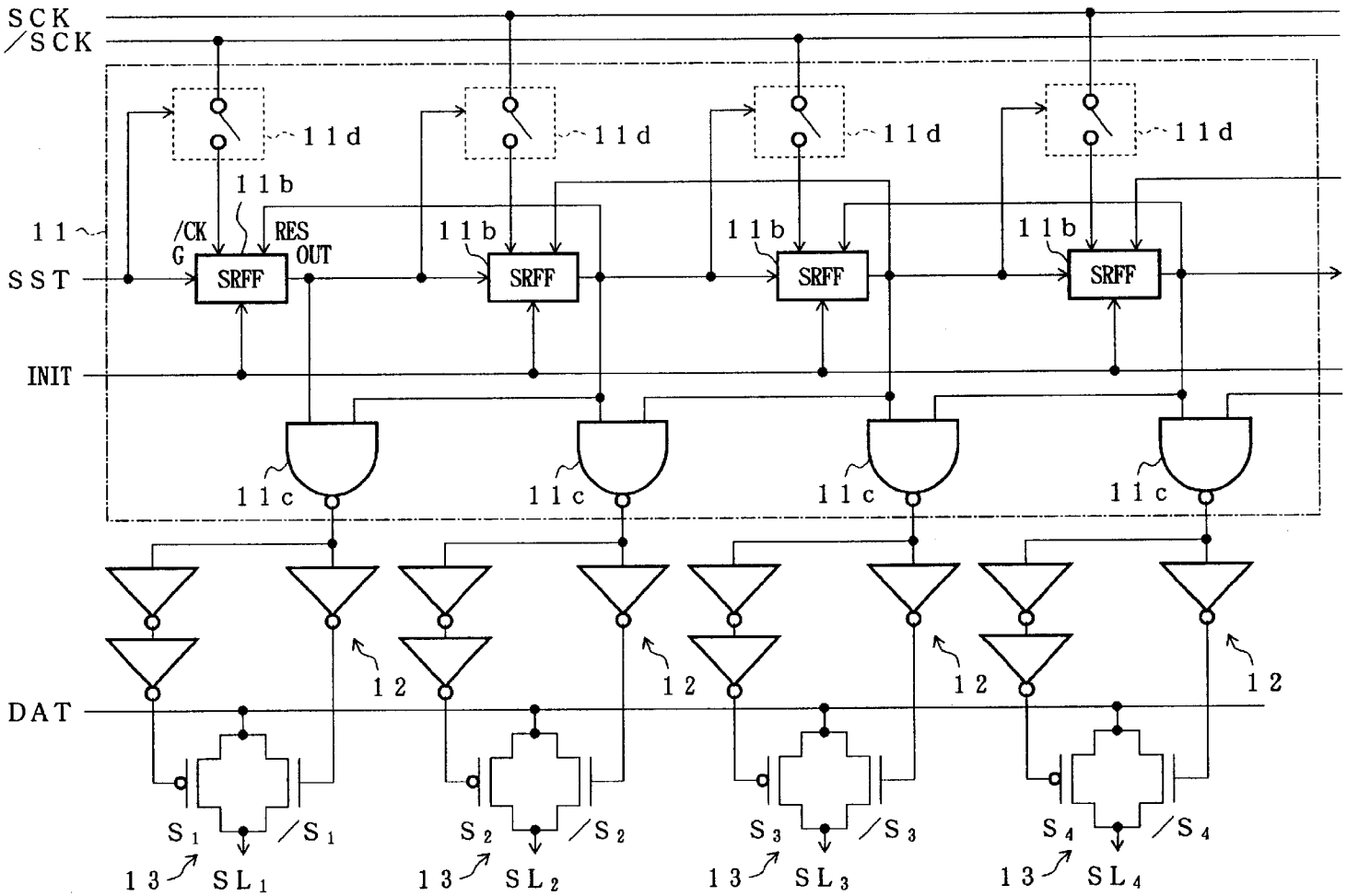
FIG. 35 is a circuit diagram showing another structure of the data signal line drive circuit provided in the image display device according to the fifth embodiment of the present invention.

On the other hand, in the case of the S-R flip-flop 11*b*, as described in the second embodiment, the input of the clock signal is controlled by the output signal of the flip-flop 11*b* in the preceding stage (see, for example, FIGS. 20 and 21). For instance, for the sake of simplifying the explanation, as shown in FIG. 35, if the clock signal is arranged to be input to this flip-flop 11*b* via the transfer gate 11*d*, the transfer gate 11*d* is turned on when the output of the flip-flop 11*b* in the preceding stage is active. The reason for this is that the clock signal needs to be input only when the internal state of each flip-flop 11*b* changes into active. On the other hand, when the internal state changes into inactive, since the output of the flip-flop 11*b* in the succeeding stage is used, the clock signal is not necessary.

However, even in the S-R flip-flops 11*b*, there is a flip-flop of a type in which the input of the clock signal is necessary for both of the cases when the internal state changes into active and changes into inactive like the above-mentioned D-type flip-flop 11*a*. Therefore, in the shift register 11 using such a S-R flip-flop, it is necessary to turn on the transfer gate 11*d* when at least either of the output of the flip-flop in the preceding stage or the output of the flip-flop in the present stage is active.

Hence, in the shift registers 11 having the S-R flip-flops 11*b* (the second to fourth embodiments), it is possible to limit the input of the clock signal in substantially the same manner as the shift register 11 having the above-mentioned transfer gates 11*d*.

Incidentally, the signals for controlling the transfer gate 11*d* are not limited to the above-described example, and other signals can be used. For instance, even when the output of the flip-flop in two stages before the present stage or in the succeeding stage is active, the transfer gate 11*d* in the present stage may be turned on. Thus, in this embodiment, it is possible to use the output signal of the flip-flop of one stage or a plurality of stages including at least the previous stage of the flip-flop to which the clock signals are to be input.

However, keeping the transfer gate 11*d* in an ON state for an unnecessarily long time increases the load. Thus, such a state must be avoided.

Figure 36:
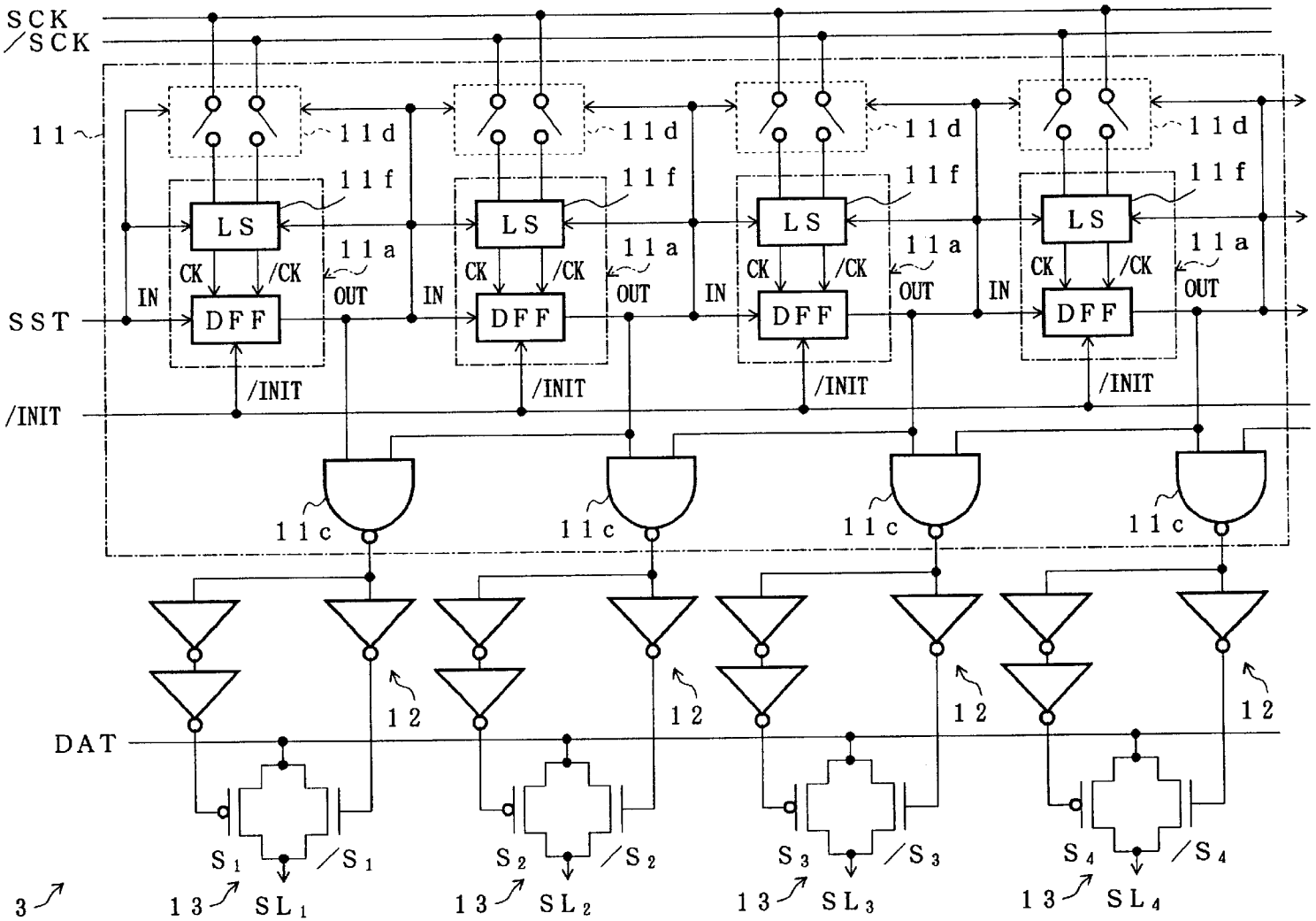
FIG. 36 is a circuit diagram showing still another structure of the data signal line drive circuit provided in the image display device according to the fifth embodiment of the present invention.

As shown in FIG. 36, the shift register 11 in other data line driver 3 of this image display device includes a flip-flop 11*a* incorporating a level shift circuit (shown as LS in FIG. 36) 11*f* as a booster circuit. In this image display device, the amplitudes of the clock signal SCK and inverted clock signal /SCK are arranged to be smaller than the amplitude of the power supply voltage applied to the data line driver 3. Therefore, after passing through the transfer gate 11*d*, the clock signal SCK and inverted clock signal /SCK are raised (boosted) to the power supply voltage by the level shift circuit 11*f*.

By including such a level shift circuit 11*f*, the amplitudes of the clock signal SCK and inverted clock signal /SCK are equal to the output amplitude of the control circuit 5 (external controller). It is thus unnecessary to add a level shifting IC between the control circuit 5 and a drive system (particularly, the scanning line driver 2, data line driver 3 and pre-charge circuit 4). Consequently, the interface is simplified and the cost is reduced.

As the level shift circuit 11*f*, there are two types of circuits: a current-driven-type circuit in which a current always flows; and a voltage-driven-type circuit in which a current flows only when the signal is changed. The current-driven-type level shift circuit has a greater operational margin. Therefore, as described later, in order to achieve a stable operation by a structure formed by a polycrystalline silicon thin-film transistor which has a lower drive ability than an MOS transistor on a single crystal silicon, it is preferable to use the current-driven-type level shift circuit.

However, the level shift circuit 11*f* is incorporated into each of the flip-flops 11*a* constituting the shift register 11, and the number of the level shift circuits 11*f* is several hundred or more. Hence, when the level shift circuit 11*f* is formed by a current-driven-type circuit, the current consumption is extremely large. For instance, in the 2- to 4-inch image display devices used in camcorders and portable information devices, the current consumed by the image display device on the whole is not more than several mA, but a current of not less than tens of mA may flow when all of the level shift circuits are operated. As a result, not only the power consumption is considerably increased, but also there is a possibility that the drive circuit is not operated due to a lowering of the power supply level caused by the excess current.

It is thus necessary to minimize the number of the level shift circuits 11*f* to be operated simultaneously. In order to achieve this, it is effective to control the operation of the level shift circuit 11*f* by the same signal as the signal for controlling the transfer gate 11*d*. In such a structure, the clock signal is input only to a flip-flop 11*a* to be operated and raised to a necessary level, while the clock signal is not input to the flip-flips 11*a* in the other stages and the operation of the level shift circuit 11*f* is suspended, and thus the current does not flow.

Figure 37:
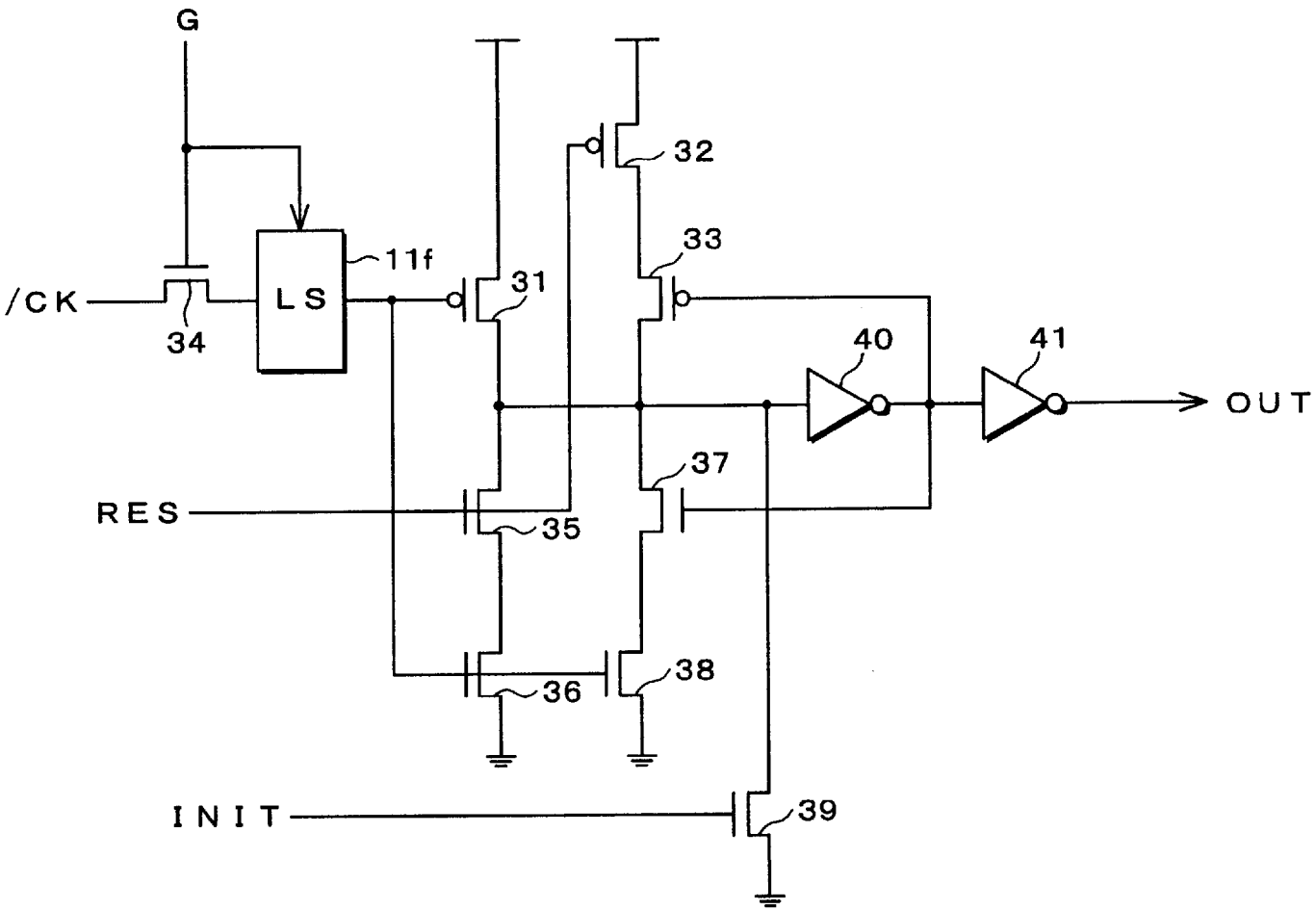
FIG. 37 is a circuit diagram showing a structure of an R-S flip-flop provided in place of the D-type flip-flop of the shift register of the data signal line drive circuit of FIG. 36.

In order to achieve this structure, if the D-type flip-flop 11*a* is used, as shown in FIG. 36, it is possible to provide the level shift circuit 11*f* whose operation is controllable in the succeeding stage of the transfer gate 11*d*. Besides, if the S-R flip-flop 11*b* is used in place of the flip-flop 11*a* in the shift register 11 shown in FIG. 36, it is possible to position the level shift circuit 11*f* between the N-channel transistor 34 and P-channel transistor 31 in the flip-flop 11*b* as shown in FIG. 37. This level shift circuit 11*f* is operated by an activating signal G. Thus, the flip-flop 11*b* is configured as a circuit having both the level shift function and the function of the transfer gate 11*d*.

Here, a method of suspending the operation of the flip-flop includes (1) changing the level of the input signal to the level shift circuit to a level at which a steady-state current does not flow, and (2) cutting off the power supply path to the level shift circuit.

Figure 38:
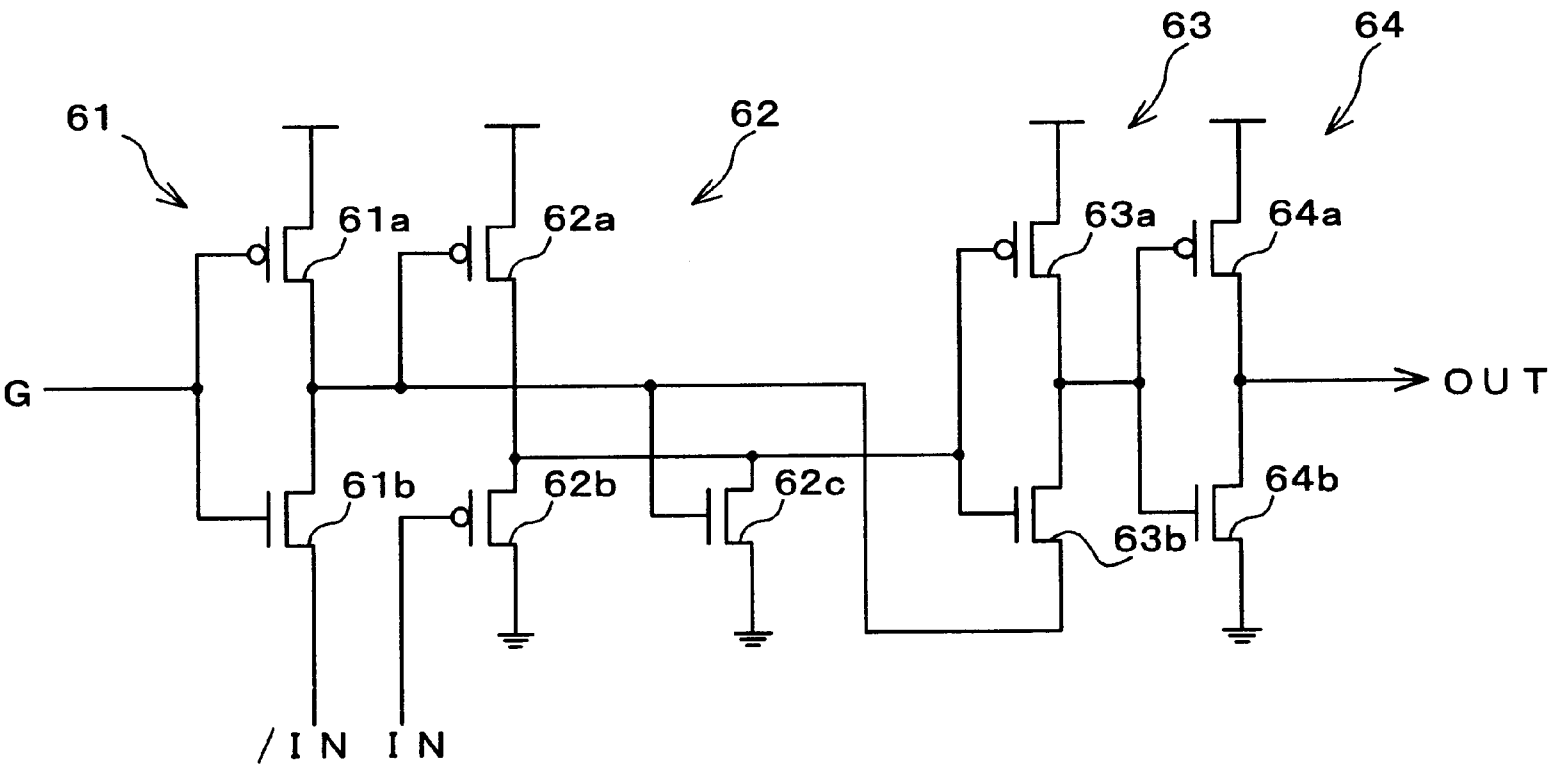
FIG. 38 is a circuit diagram showing a structure of a level shift circuit incorporated into the flip-flop of the shift register of the data signal line drive circuit of FIG. 36.

In order to achieve (1), it is possible to use, for example, a level shift circuit as shown in FIG. 38.

This level shift circuit is formed by input circuits 61, 62 and output circuits 63, 64. The input circuit 61 is a part to which an input signal /IN is input, and is composed of a P-channel transistor 61*a* and an N-channel transistor 61*b*. The input circuit 62 is a part to which an input signal IN is input, and is composed of P-channel transistors 62*a*, 62*b* and an N-channel transistor 62*c*. The output circuit 63 is composed of a P-channel transistor 63*a* and an N-channel transistor 63*b*. The output circuit 64 is composed of a P-channel transistor 64*a* and an N-channel transistor 64*b*.

In the level shift circuit thus configured, the operation varies according to the state of the activating signal G. When the activating signal G is active, this level shift circuit is supplied with the input signals IN and /IN from the input circuits 61 and 62, and operates as a normal level shift circuit. On the other hand, when the activating signal G is inactive, this level shift circuit is supplied with signals of the power supply level (not intermediate level) from the input circuits 61 and 62, and therefore a feedthrough current does not flow.

Figure 39:
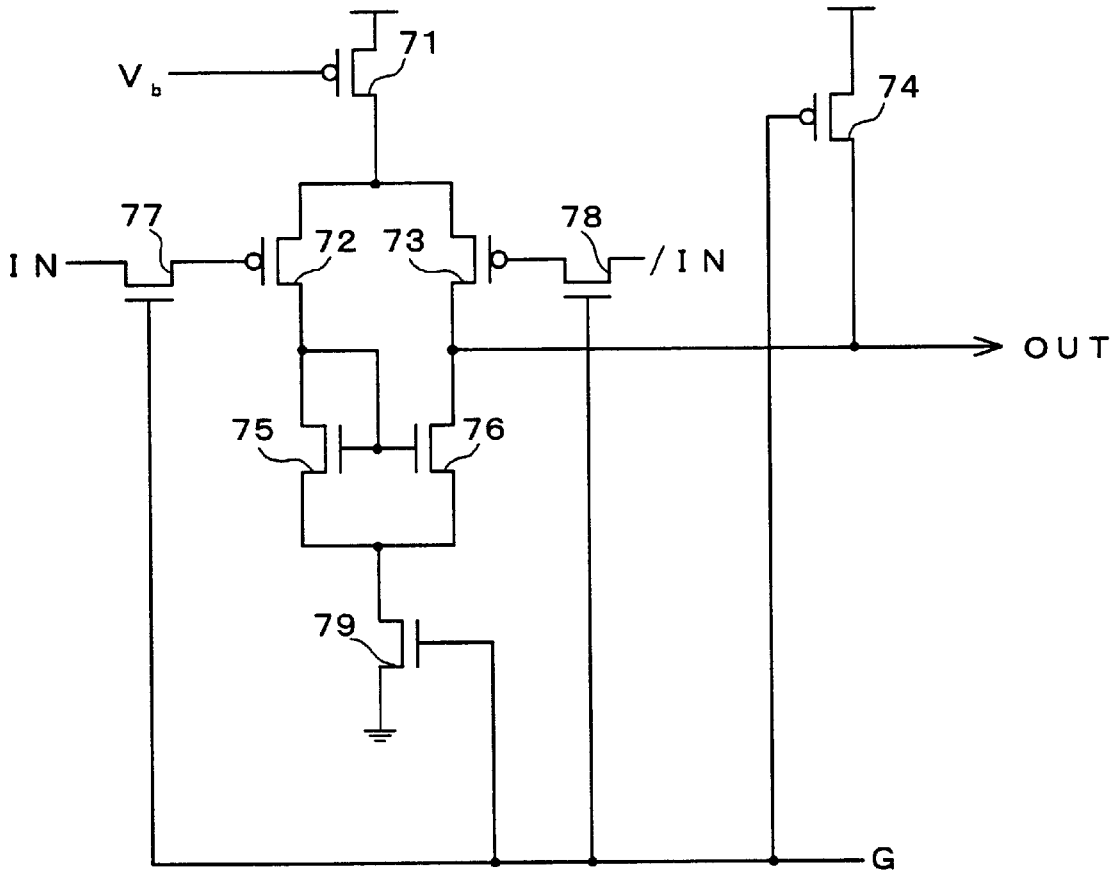
FIG. 39 is a circuit diagram showing another structure of the level shift circuit incorporated into the flip-flop of the shift register of the data signal line drive circuit of FIG. 36.

Meanwhile, in order to achieve (2), for example, a level shift circuit as shown in FIG. 39 can be used.

This level shift circuit is composed of P-channel transistors 71 to 74 and N-channel transistors 75 to 79. The P-channel transistor 71 functions as a constant current source, and is controlled by a voltage Vb. The N-channel transistors 75 and 76 form a current mirror circuit and function as active loads of the P-channel transistors 72 and 73, respectively. In order to input the input signals IN and /IN, the N-channel transistors 77 and 78 are controlled by the activating signal G. Moreover, the N-channel transistor 79 connects or disconnects a part (level shift function section), which has the level shift function and is composed of the transistors 71 to 73, 75 and 76, to/from the ground line by the activating signal G. The P-channel transistor 74 connects or disconnects an output line for outputting the output signal OUT to/from the power supply line by the activating signal G.

The operation of the level shift circuit having such a configuration also varies according to the state of the activating signal G. When the activating signal G is active, this level shift circuit is operated as a normal level shift circuit. On the other hand, when the activating signal G is inactive, since the level shift function section is disconnected from the ground line by the N-channel transistor 79, the current path in the level shift function section is cut off and therefore the feedthrough current does not flow. Besides, the output line is fixed at a power supply potential by the P-channel transistor 74.

Incidentally, this embodiment explains the shift register 11 of the data line driver 3. However, the shift register 11 of the scanning line driver 2 also includes the flip-flops 11*a* or 11*b* similar to the above.

Sixth Embodiment

Figure 40:
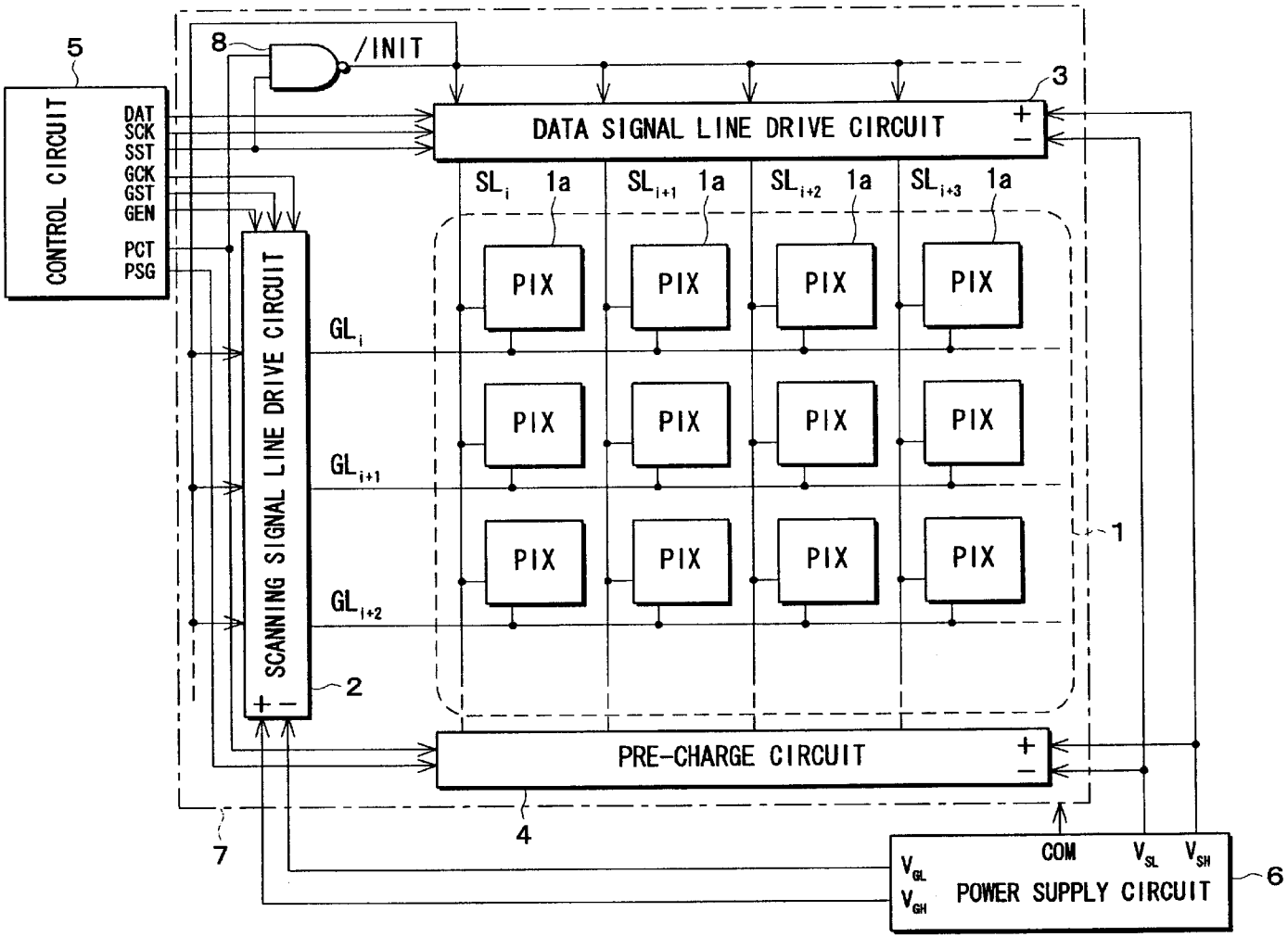
FIG. 40 is a block diagram showing a structure of an image display device according to the sixth embodiment of the present invention.
Figure 41:
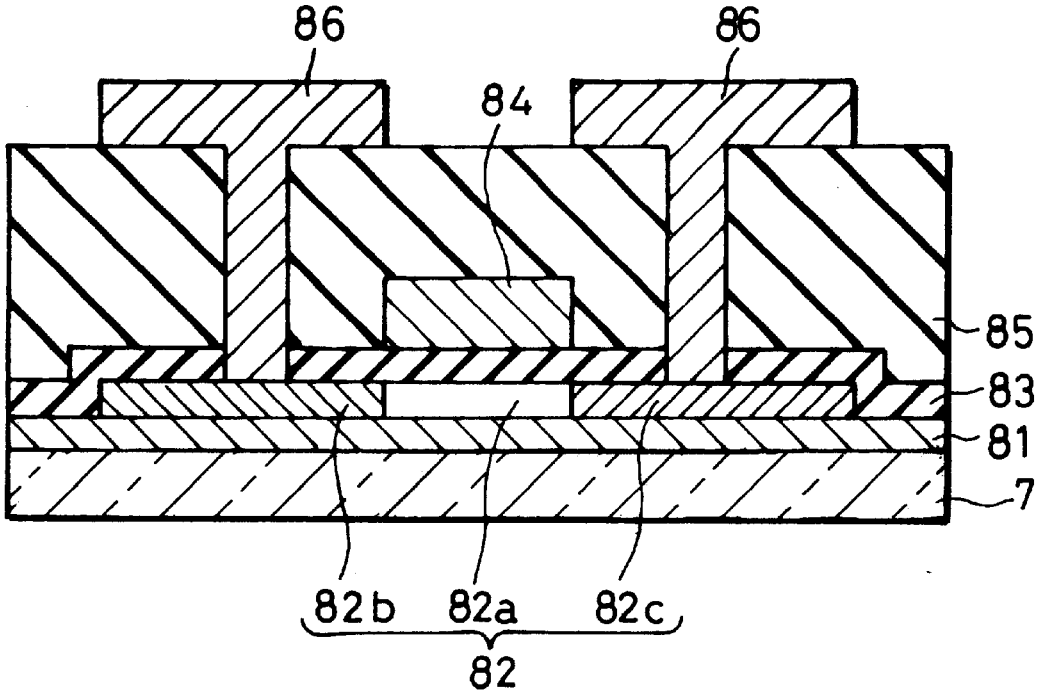
FIG. 41 is a cross sectional view showing a structure of a polycrystalline silicon thin-film transistor constituting the image display device of FIG. 40.
Figure 42:
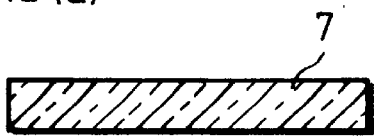
FIGS. 42(*a*) through 42(*k*) are cross sectional views showing a structure in each of manufacturing steps of the polycrystalline silicon thin-film transistor of FIG. 41.
Figure 42:
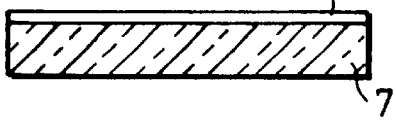
Figure 42:
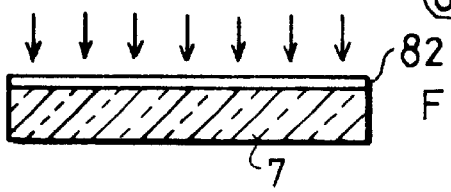
Figure 42:
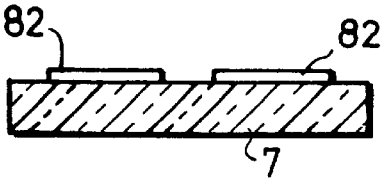
Figure 42:
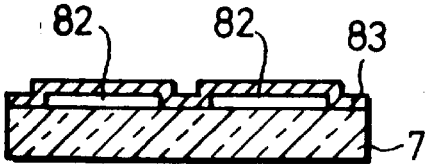
Figure 42:
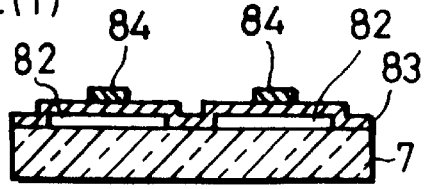
Figure 42:
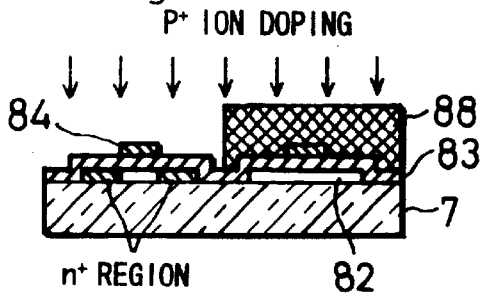
Figure 42:
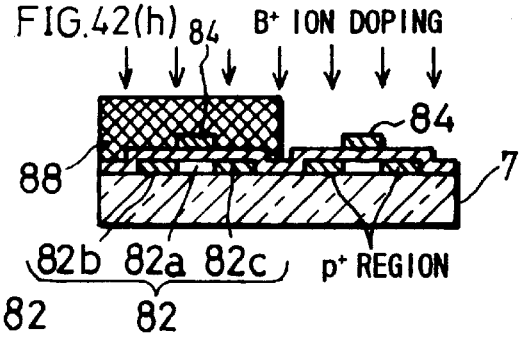
Figure 42:
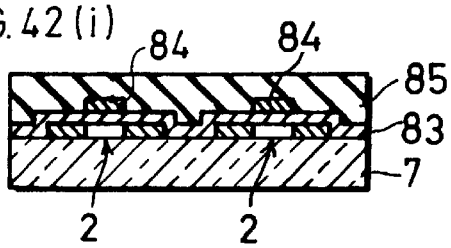
Figure 42:
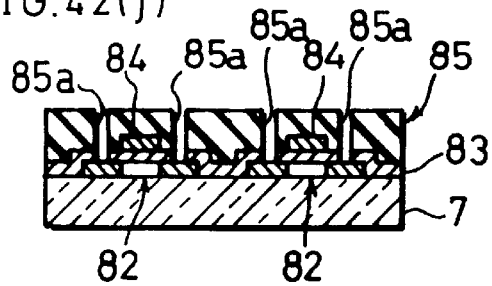
Figure 42:
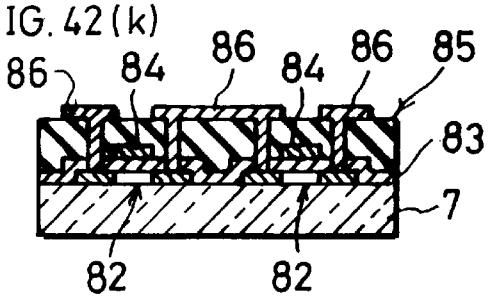
Figure 43:
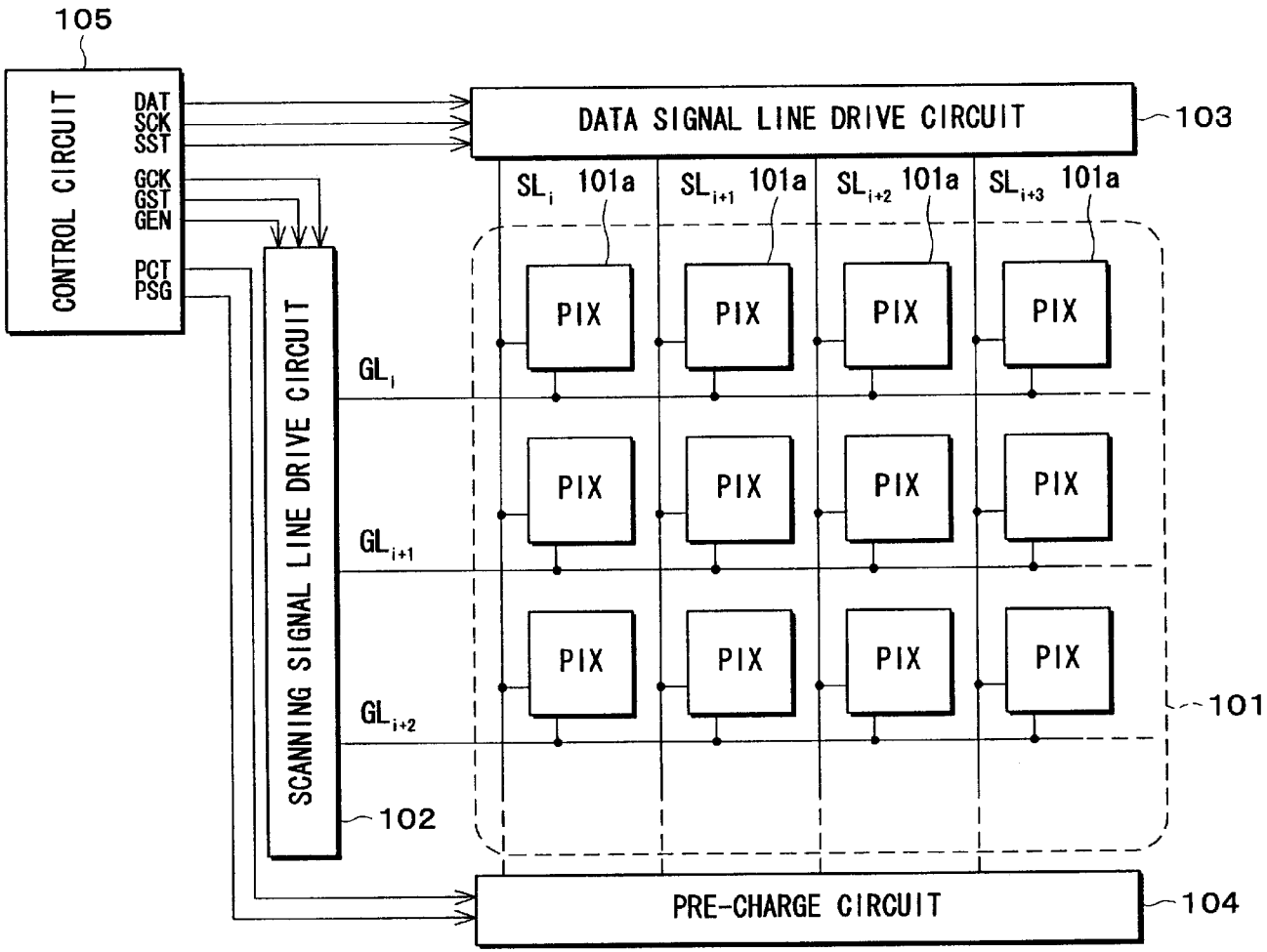
FIG. 43 is a block diagram showing a structure of a conventional image display device.
Figure 44:
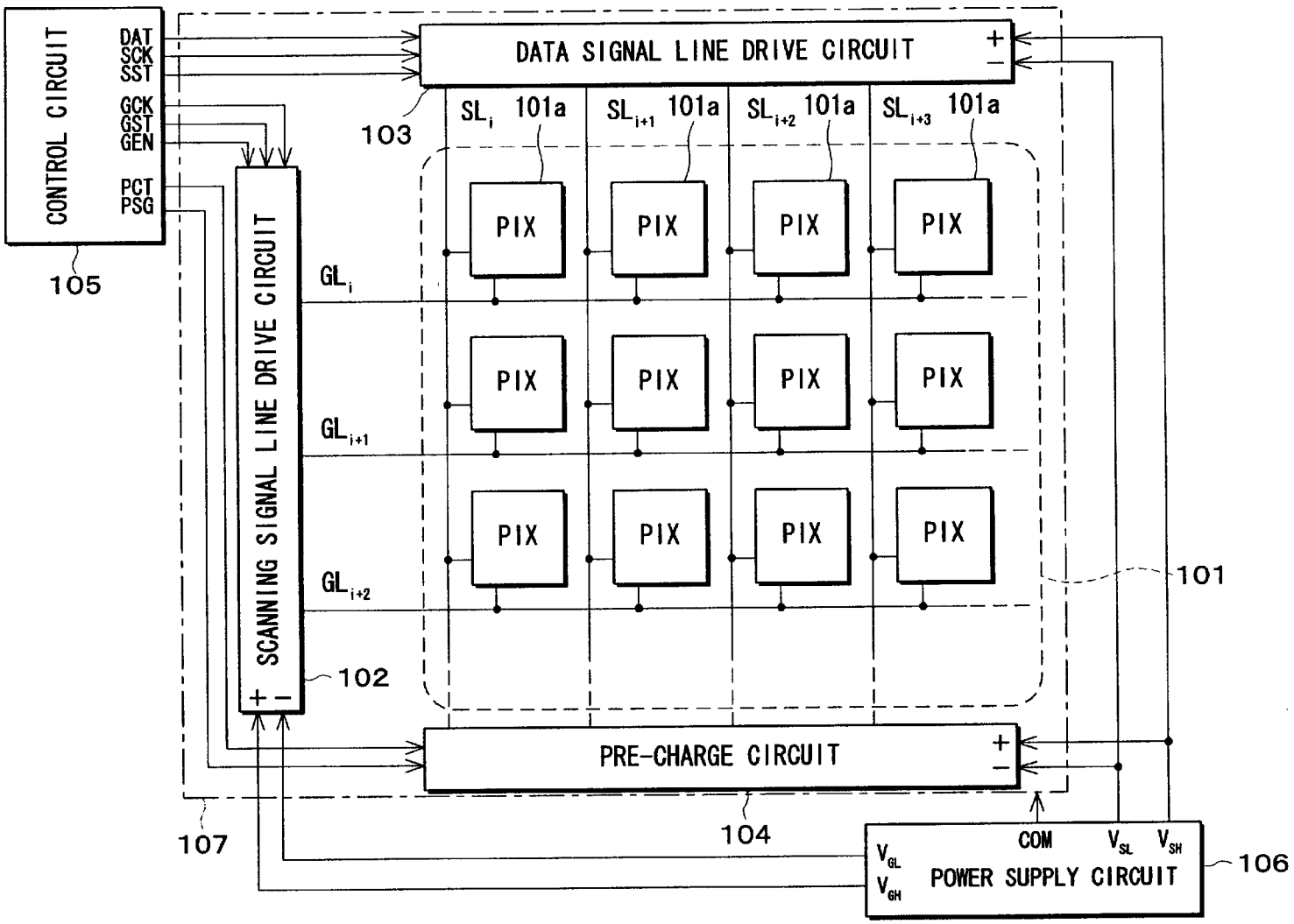
FIG. 44 is a block diagram showing another structure of a conventional image display device.
Figure 45:
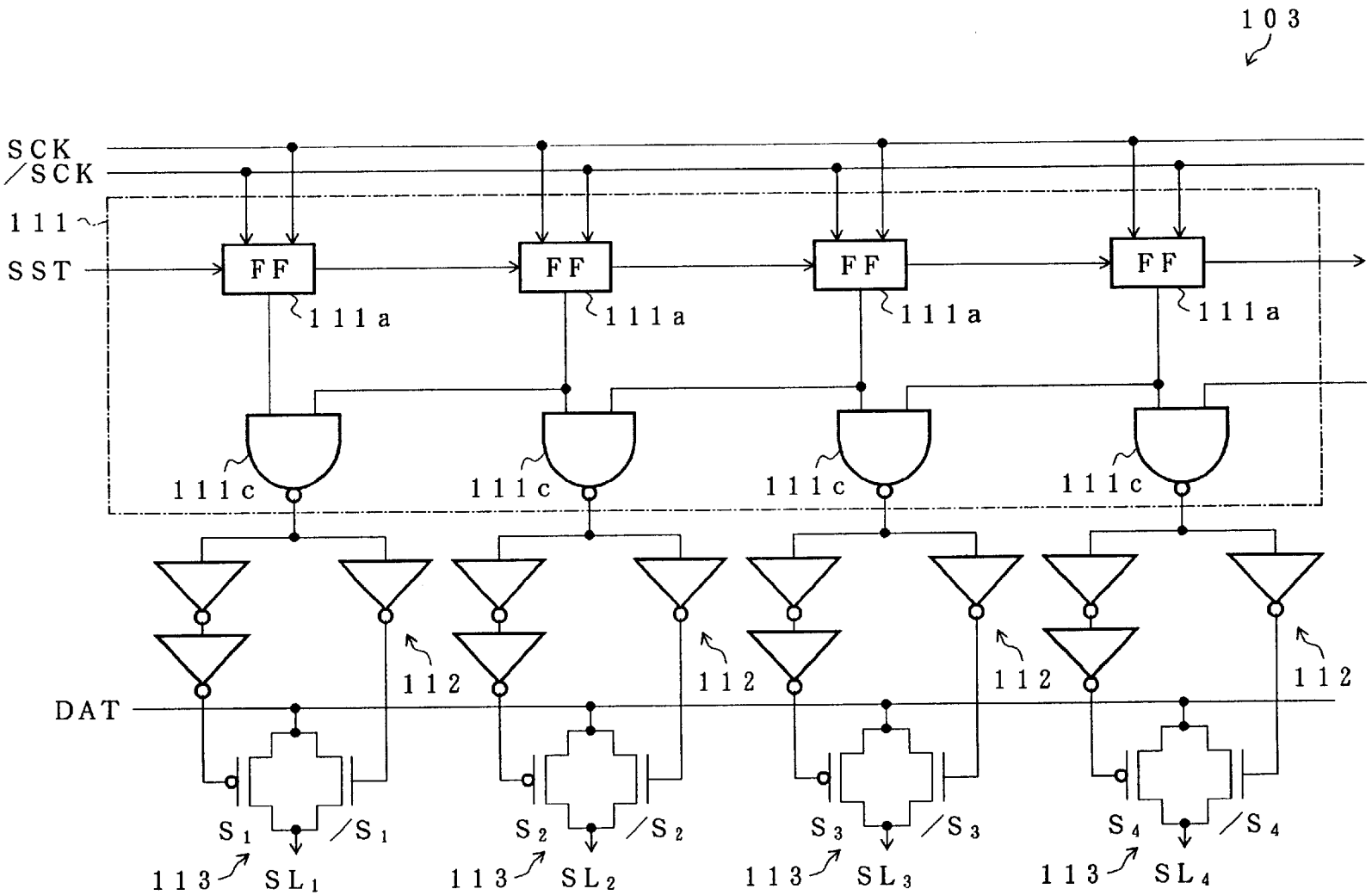
FIG. 45 is a circuit diagram showing a structure of a data signal line drive circuit provided in the image display devices of FIGS. 43 and 44.
Figure 46:
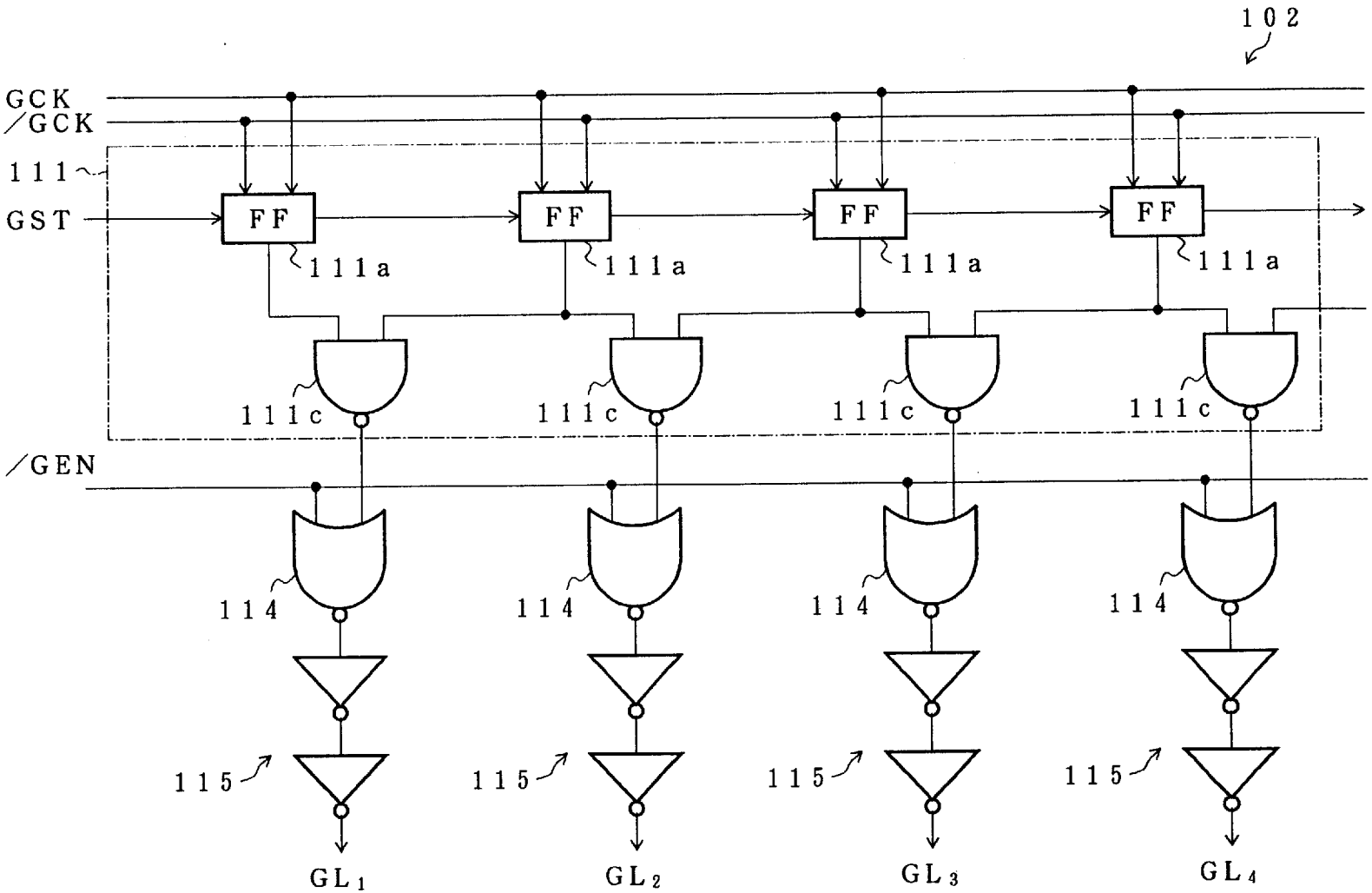
FIG. 46 is a circuit diagram showing a structure of a scanning signal line drive circuit provided in the image display devices of FIGS. 43 and 44.
Figure 47:
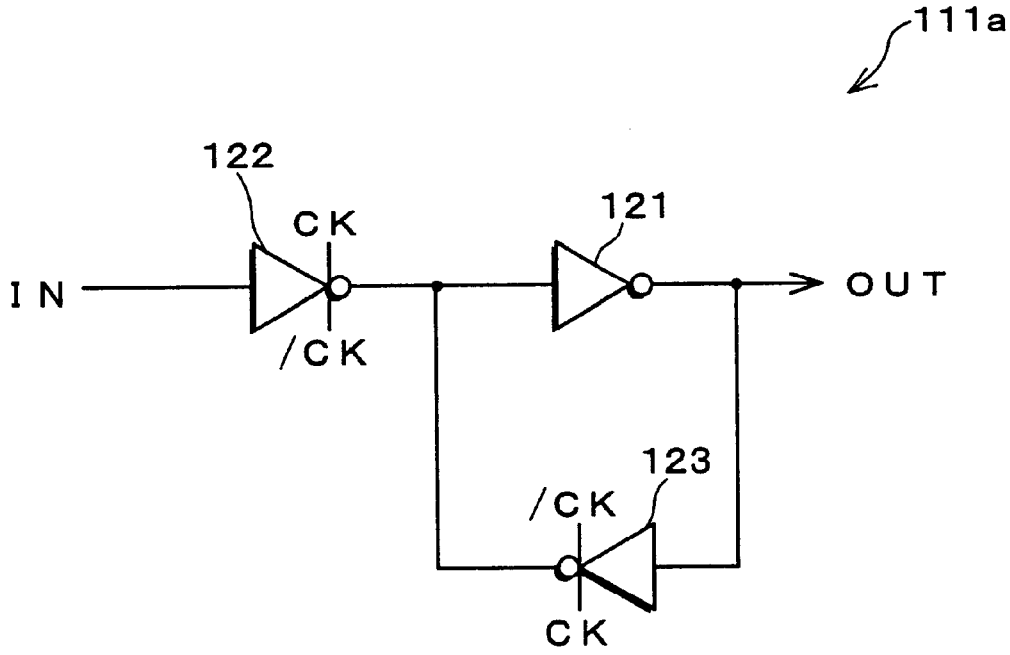
FIG. 47 is a circuit diagram showing a structure of a D-type flip-flop constituting a shift register of the data signal line drive circuit of FIG. 45.
Figure 48:
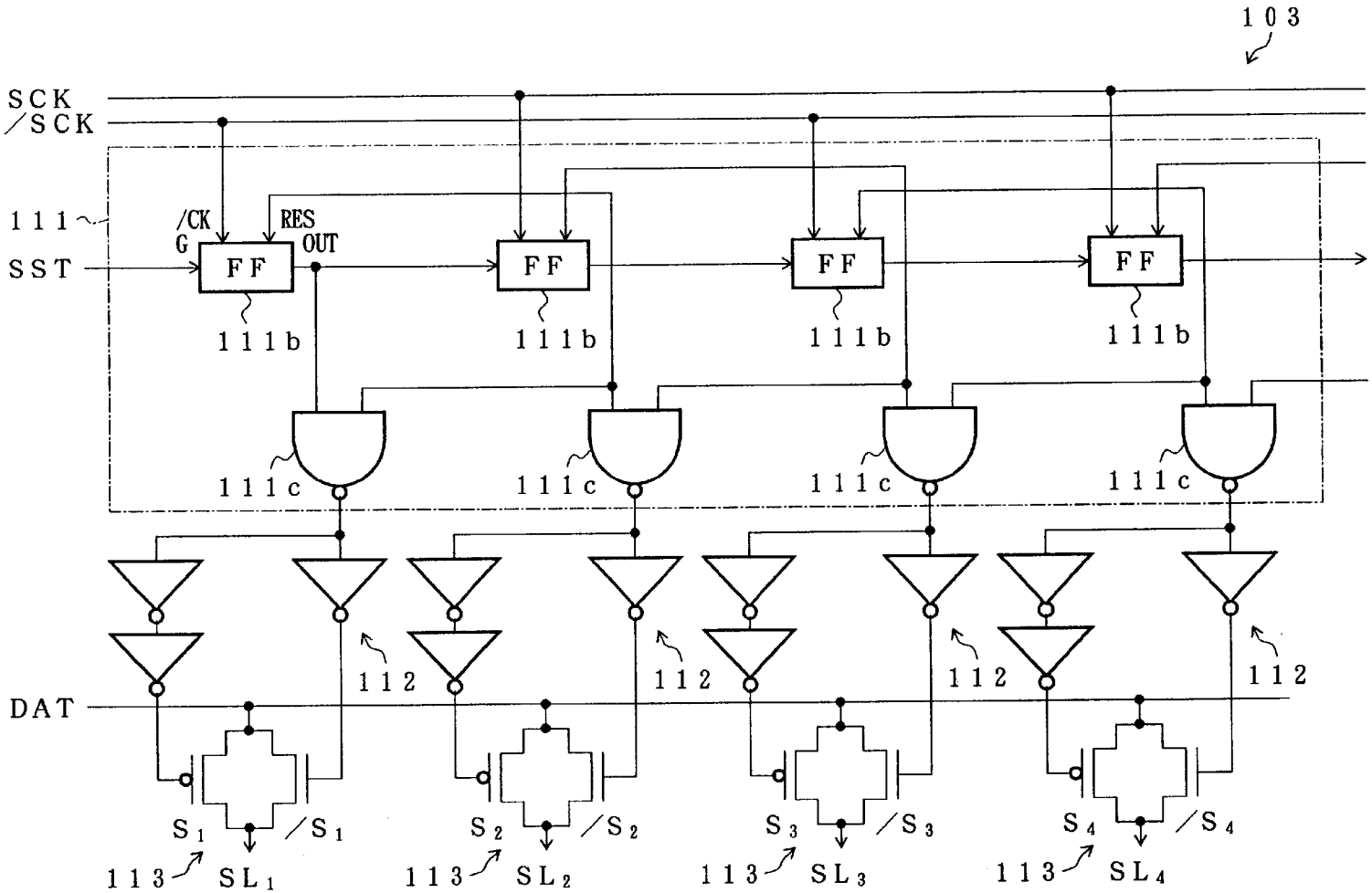
FIG. 48 is a circuit diagram showing another structure of the data signal line drive circuit provided in the image display devices of FIGS. 43 and 44.
Figure 49:
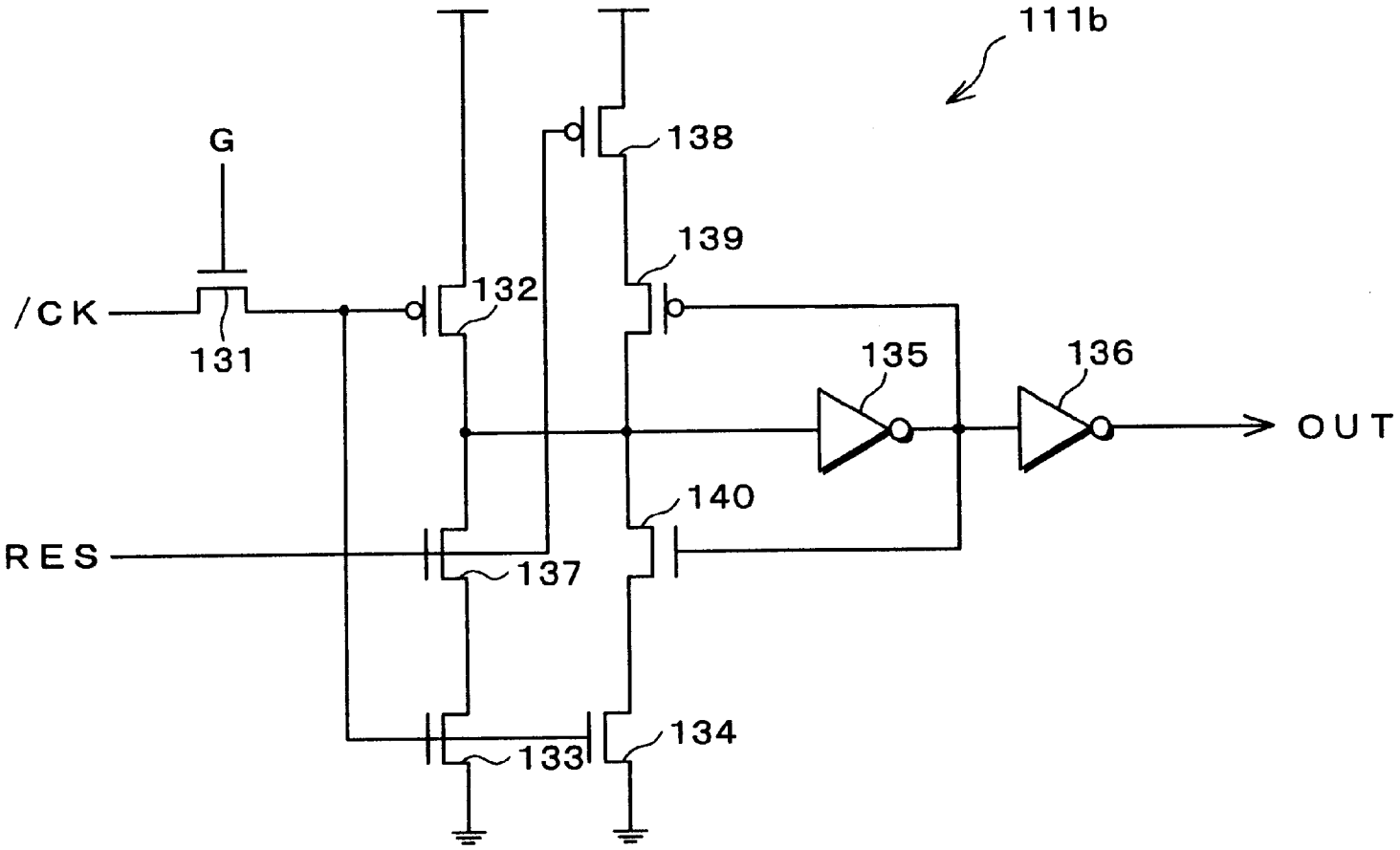
FIG. 49 is a circuit diagram showing a structure of an R-S flip-flop constituting a shift register of the data signal line drive circuit of FIG. 48.

The following description will explain the sixth embodiment of the present invention with reference to FIGS. 40, 41 and 42(*a*) to 42(*k*).

Like the above-mentioned image display device of the first embodiment, as shown in FIG. 40, an image display device of this embodiment includes a pixel array 1, a scanning line driver 2, a data line driver 3, a pre-charge circuit 4, a control circuit 5, and a power supply circuit 6.

In this image display device, the scanning line driver 2 and data line driver 3 are formed together with the pixel array 1 on an insulating substrate, for example, a glass substrate 7 (driver monolithic structure). As the insulating substrate (substrate), a sapphire substrate, quartz substrate, no-alkali glass substrate, etc. are often used. Besides, a thin-film transistor is used as a pixel transistor SW, and the scanning line driver 2 and data line driver 3 are formed by thin-film transistors.

Incidentally, in FIG. 40, the structure formed on the glass substrate 7 is the same as the drive system (the drivers 2 and 3, pre-charge circuit 4 and NAND gate 8) shown in FIG. 3. However, the structure is not necessarily limited to this, and the structures explained in the above-described embodiments may be used.

The power supply circuit 6 outputs a power supply voltage $V_{HG}$ of a high potential and a power supply voltage $V_{HL}$ of a low potential to be supplied to the scanning line driver 2, and a power supply voltage $V_{HS}$ of a high potential and a power supply voltage $V_{SL}$ of a low potential to be supplied to the data line driver 3 and pre-charge circuit 4. Moreover, the power supply circuit 6 outputs a common potential COM to be supplied to a common electrode on a glass substrate (not shown) disposed to face the glass substrate 7.

In such a structure, since the scanning line driver 2 and data line driver 3 are dispersed within a region having substantially the same length as the screen (display area), the line for supplying the control signals including the clock signal is extremely long. Hence, the load capacity of the control signal supply line is extremely large, and consequently the effect of reducing the load capacity of the control signal line obtained by locally inputting the control signals is increased.

Moreover, since this image display device has a structure mentioned in the above-described embodiments in which the supply of the reset signal from an external device is not necessary, there is no need to additionally provide a signal line for supplying the reset signal. It is therefore possible to prevent the load of the signal line from the control circuit 5 to the scanning line driver 2 and data line driver 3 from being excessively large. Consequently, the operation of the image display device is stabilized. Moreover, it is not necessary to increase the drive ability of the external IC incorporating the control circuit 5 and the supply ability of the power supply circuit 6, and thus the cost and power consumption of the external IC can be reduced.

Furthermore, by forming the data line driver 3 and scanning line driver 2 in a monolithic form on the same glass substrate 7 together with the pixels 1*a*, only the control signal from the control circuit 5 and various voltages from the power supply circuit 6 are input from the outside of the glass substrate 7. In this image display device, therefore, the number of input terminals to the glass substrate 7 is smaller in comparison with an image display device using an external IC as a driver. As a result, the cost for mounting the parts on the glass substrate 7 and occurrence of mounting defects can be decreased. It is thus possible to reduce the manufacturing cost, mounting cost of the drive circuits and improve the reliability of the drive circuit.

Incidentally, the above-mentioned thin-film transistor is a polycrystalline silicon thin-film transistor having a structure as shown in FIG. 41. In this structure, contamination-preventing silicon oxide film 81 is deposited on the glass substrate 7, and a field-effect transistor is formed on this film.

The above-mentioned thin-film transistor is formed by a polycrystalline thin film 82 composed of a channel region 82*a*, a source region 82*b* and a drain region 82*c* formed on the silicon oxide film 81, a gate insulating film 83 formed on the polycrystalline silicon film 82, a gate electrode 84, an interlayer insulating film 85 and metal wires 86.

The above-mentioned thin-film transistor has a forward stagger (top gate) structure having the polycrystalline silicon thin film on the insulating substrate as an active layer. However, this embodiment is not necessarily limited to this structure, and may use a transistor having other structure such as a reverse stagger structure. Moreover, it is also possible to apply a single crystal silicon thin-film transistor, an amorphous silicon thin-film transistor, or a thin-film transistor made of other material to this image display device.

By using the above-mentioned polycrystalline silicon thin-film transistor, the scanning line driver 2 and data line driver 3 having a practical drive ability can be formed on the glass substrate 7, on which the pixel array 1 is to be formed, by substantially the same manufacturing process as for the pixels 1*a*. Moreover, the polycrystalline silicon thin-film transistor has a drive ability smaller than that of a single crystal silicon transistor (MOS transistor) by a 1- to 2-digit scale. Therefore, in order to form a shift register by using such a transistor, it is necessary to increase the size of the transistor, and consequently the input load capacity tends to increase. Hence, the effect of reducing the load capacity of the control signal supply line obtained by locally inputting the control signal is enhanced.

Furthermore, since the characteristics, such as the threshold voltage, of the polycrystalline thin-film transistor are inferior to those of the MOS transistor on single crystal, in order to form the above-mentioned level shift circuit by using such a transistor, it is sometimes necessary to adopt a current-drive type structure in which a steady-state current flows. Thus, by performing initialization when power is supplied as in the image display device of this embodiment, the effect of preventing a flow of excess current becomes particularly notable.

For example, the above-mentioned thin-film transistor is manufactured by the following process.

First, on the glass substrate 7 shown in FIG. 42(*a*), an amorphous silicon thin film a-Si is deposited (FIG. 42(*b*)). Next, by applying eximer laser to the amorphous silicon thin film a-Si, the polycrystalline silicon thin film 82 is formed (FIG. 42(*c*)). By patterning the polycrystalline silicon thin film 82 into a desired pattern (FIG. 42(*d*)), the gate insulating film 83 of silicon dioxide is formed on the polycrystalline silicon film 82 (FIG. 42(*e*)).

In addition, the gate electrode 84 is formed of aluminum, etc. (FIG. 42(*f*)). Thereafter, impurities (phosphorous for an n-type region and boron for a p-type region) are introduced into portions of the polycrystalline silicon thin film 82, which serve as the source region 82*b* and drain region 82*c* (FIGS. 42(*g*) and 42(*h*)). When introducing the impurity into the n-type region, the p-type region is masked by a resist 88 (FIG. 42(*g*)). Meanwhile, when introducing the impurity into the p-type region, the n-type region is masked by the resist 88 (FIG. 42(*h*)).

Then, the interlayer insulating film 85 made of silicon dioxide, silicon nitride, etc. is deposited (FIG. 42(*i*) and contact holes 85*a* are formed in the interlayer insulating film 85 (FIG. 42(*j*) Finally, the metal wires 86 such as aluminum wires are formed in the contact holes 85*a* (FIG. 42(*k*)).

The maximum temperature in the above-mentioned process is not higher than 600° C. for the formation of the gate insulating film 83. Therefore, it is not necessary to use an expensive quartz substrate having an extremely high heat resistance as the insulating substrate, and inexpensive high heat-resistance glass such as 1737 glass available from Corning Inc. in the U.S.A. can be used. Consequently, a liquid crystal display device can be provided at a low price.

When manufacturing a liquid crystal display device, a transparent electrode (for a transmission-type liquid crystal display device) or a reflective electrode (for a reflection-type liquid crystal display device) is formed on the thin-film transistor fabricated as described above with another interlayer insulating film therebetween.

By adopting the above-mentioned process, it is possible to form a polycrystalline silicon thin-film transistor on a glass substrate that can be produced to have a large area at low costs. It is therefore possible to readily achieve a low-cost large image display device.

As described above, the first matrix type image display device of the present invention includes a plurality of pixels arranged in a matrix form; a plurality of data signal lines for supplying image data to be written in the pixels; a plurality of scanning signal lines for controlling writing of the image data in the pixels; a data signal line drive circuit for driving the data signal lines; a scanning signal line drive circuit for driving the scanning signal lines; and reset means for resetting an internal state of at least one of the data signal line drive circuit and the scanning signal line drive circuit, wherein the reset means generates a reset signal for resetting the internal state of a shift register that forms at least one of the data signal line drive circuit and the scanning signal line drive circuit, based on a combination of a plurality of signals which are not used during normal driving.

With this structure, since the shift register is reset (initialized) when power is supplied, etc., if signals (such as clock signals) for controlling the shift registers functioning as essential sections of the data signal line drive circuit and the scanning signal line drive circuit are selectively input, it is possible to prevent the signal line load from being excessively large. Consequently, the operation of the image display device is stabilized, and there is no need to increase the drive ability of an external IC for supplying a control signal and the supply ability of a power supply circuit. It is therefore possible to reduce the cost and power consumption of the external IC.

As described above, the second matrix type image display device of the present invention includes the pixels, data signal lines, scanning signal lines, data signal line drive circuit and scanning signal line drive circuit like the first matrix type image display device, and further includes reset means for generating a reset signal for resetting an internal state of a shift register that forms at least one of the data signal line drive circuit and the scanning signal line drive circuit, based on a combination of a plurality of signals which do not affect a displayed image.

With this structure, by the use of a combination of signals which do not affect a displayed image, it is possible to reset the internal state of the shift register without affecting the displayed image and prevent an indefinite state when power is supplied. Consequently, like the first image display device, it is possible to stabilize the operation of the image display device and reduce the cost and power consumption of the external IC.

As described above, the third matrix type image display device of the present invention includes the pixels, data signal lines, scanning signal lines, data signal line drive circuit, scanning signal line drive circuit and reset means like the first matrix type image display device, and further includes a pre-charge circuit for preliminarily charging the data signal lines before being driven, according to signals input from outside of a substrate, wherein at least one of the data signal line drive circuit, scanning signal line drive circuit and pre-charge circuit is formed on the substrate on which the pixels are formed, and the reset means generates a reset signal for resetting an internal state of a shift register that forms at least one of the data signal line drive circuit and the scanning signal line drive circuit, based on a combination of a plurality of signals input from outside of the substrate to at least one of the data signal line drive circuit, scanning signal line drive circuit and pre-charge circuit formed on the substrate.

As described above, the fourth matrix type image display device of the present invention includes the pixels, data signal lines, scanning signal lines, data signal line drive circuit, scanning signal line drive circuit and reset means like the first matrix type image display device, wherein at least one of the data signal line drive circuit and scanning signal line drive circuit is formed on a substrate together with the pixels, and the reset means generates a reset signal for resetting an internal state of a shift register that forms at least one of the data signal line drive circuit and the scanning signal line drive circuit, based on a combination of a plurality of signals input from outside of the substrate to at least one of the data signal line drive circuit and scanning signal line drive circuit formed on the substrate.

According to the third and fourth structures, in order to reset the internal state of the shift register, since there is no need to supply the reset signal from outside of the substrate to the circuits on the substrate independently of a signal input to the circuits on the substrate from outside of the substrate, it is possible to reduce the number of signals supplied to the circuits on the substrate from outside of the substrate.

As a result, the number of signal lines for supplying signals to the circuits on the substrate from outside of the substrate can be decreased, thereby reducing the cost and size of the device. Moreover, it is not necessary to improve the drive ability of the external IC for supplying signals to the circuits on the substrate from outside of the substrate and the supply ability of a power supply circuit, and consequently the cost and power consumption of the external IC can be reduced.

In the first to third image display devices, it is preferable that the reset means generates the reset signal based on a pre-charge control signal for controlling the operation of the pre-charge circuit for preliminarily charging the data signal lines before being driven and an enable signal for enabling the scanning signal line drive circuit to output a drive signal for driving the scanning lines. Since the pre-charge control signal and enable signals are signals that do not became active simultaneously in a normal image display mode, there is no possibility that the displayed image is affected by the initialization (resetting) of the shift register based on these signals. It is thus possible to improve the reliability of resetting.

In the first to third image display devices, it is preferable that the reset means generates the reset signal based on a pre-charge control signal for controlling the operation of the pre-charge circuit for preliminarily charging the data signal lines before being driven and a start signal for starting an operation of the scanning signal line drive circuit. With this structure, it is possible to use the pre-charge control signal and the start signal of the scanning signal line drive circuit as signals that do not became active simultaneously in a normal image display period. In order to realize this, a period in which these signals became active simultaneously is arranged not to coincide with the image display period by, for example, adding a dummy flip-flop to the shift register constituting the scanning signal line circuit so as to shift the image display period. Hence, there is no possibility that the displayed image is affected by the initialization (resetting) of the shift register based on these signals. It is thus possible to improve the reliability of resetting.

In the first to third image display devices, it is preferable that the reset means generates the reset signal based on a pre-charge control signal for controlling the operation of the pre-charge circuit for preliminarily charging the data signal lines before being driven and a start signal for starting an operation of the data signal line drive circuit. Since the pre-charge control signal and the start signal of the data signal line drive circuit are signals that do not became active simultaneously in a normal image display period, there is no possibility that the displayed image is affected by the initialization (resetting) of the shift register based on these signals. It is thus possible to improve the reliability of resetting.

In the first to fourth image display devices, it is preferable that the reset means generates the reset signal based on a first start signal for starting an operation of the scanning signal line drive circuit and a second start signal for starting an operation of the data signal line drive circuit. With this structure, it is possible to use the start signal of the scanning signal line drive circuit and the start signal of the data signal line drive circuit as signals that do not became active simultaneously in a normal image display period. In order to realize this, a period in which these signals became active simultaneously is arranged not to coincide with the image display period by, for example, adding a dummy flip-flop to the shift register constituting the scanning signal line circuit so as to shift the image display period. Hence, there is no possibility that the displayed image is affected by the initialization (resetting) of the shift register based on these signals. It is thus possible to improve the reliability of resetting.

In all of the above-described image display devices, it is preferable that the signals, based on which the reset signal is generated, are being input to the reset means in a period from the supply of power to the start of normal driving. The shift register is initialized (reset) by inputting the above combination of signals to the image display device in a certain period during the supply of power, and thereafter the drive circuit can be driven normally.

Alternatively, in all of the above-described image display devices, it is preferable that the signals, based on which the reset signal is generated, are being input to the reset means during a period in which display is being interrupted after the supply of power. Even if the display is interrupted when a scanning pulse is present in the shift register, the shift register is initialized (reset) during the period in which the display is being interrupted, and thereafter the drive circuit can be driven normally.

In all of the above-described image display devices, it is preferable that a period in which the signals, based on which the reset signal is generated, are being input is between 1 $\mu$sec and 100 msec. Within this period, the shift register can be certainly initialized (reset), and a serious trouble does not occur on the display.

As described above, the fifth matrix type image display device of the present invention includes the pixels, data signal lines, scanning signal lines, data signal line drive circuit and scanning signal line drive circuit like the first matrix type image display device, and further includes a capacitor added to an internal node for resetting the internal node of a shift register that forms at least one of the data signal line drive circuit and scanning signal line drive circuit.

With this structure, since the shift register is initialized (reset) by the use of the capacitor when power is supplied, it is not necessary to use a switch for initialization, thereby providing the effect of decreasing the scale of the circuit in addition to the effects of the first image display device. Moreover, it is not necessary to generate a signal for driving the initialization switch, thereby producing the effect of simplifying the circuit structure.

In the fifth image display device, it is preferable that the capacitors are connected between the internal nodes to be reset to a power supply potential and a power supply line. With this structure, since the electric potential of the internal node to be reset to the power supply level is increased by a capacitive coupling when the electric potential of the power supply line is increased at the time power is supplied, it is possible to reset the internal state to the power supply level.

In the fifth image display device, it is preferable that the capacitor is connected between the internal node to be reset to a ground potential and a ground line. In this case, since the internal node is reset to the ground level by a capacitive coupling, the electric potential of the internal node to be reset to the ground level is not increased even when the electric potential of the power supply line is increased at the time power is supplied. It is therefore possible to more certainly reset the internal state.

As described above, the sixth matrix type image display device of the present invention includes the pixels, data signal lines, scanning signal lines, data signal line drive circuit, scanning signal line drive circuit and reset means like the first matrix type image display device, wherein the reset means are resistors added to internal nodes for resetting the internal node of a shift register that forms at least one of the data signal line drive circuit and scanning signal line drive circuit.

In the sixth image display device of the present invention, since the reset means are resistors added to the internal nodes, it is not necessary to use a switch for initialization, thereby decreasing the scale of the circuit. Moreover, it is not necessary to generate a signal for driving the initialization switch, thereby simplifying the circuit structure.

In the sixth image display device, it is preferable that the resistor is added between the internal node to be reset to a power supply potential and a power supply line. Since the electric potential of the internal node to be reset to the power supply level tends to approach the power supply level due to a very small current from the power supply line, it is possible to reset the internal state.

In the sixth image display device, it is preferable that the resistor is connected between the internal node to be reset to a ground potential and a ground line. In this case, since the electric potential of the internal node tends to approach the ground level due to a very small current from the ground line, it is possible to reset the internal state.

In all of the above-described image display devices, it is preferable that the reset means resets the internal nodes of a plurality of D-type flip-flops constituting the data signal line drive circuit or the scanning signal line drive circuit. By serially connecting D-type flip-flops for a plurality of stages, it is possible to form a shift register. In the shift register thus formed, it is possible to readily change the width of the scanning pulse by changing the width of the start signal.

Alternatively, in all of the above-described image display devices, it is preferable that the reset means resets the internal nodes of a plurality of set-reset flip-flops constituting the data signal line drive circuit or the scanning signal line drive circuit. By serially connecting set-reset flip-flops for a plurality of stages, it is possible to form a shift register. The shift register thus formed has advantages that the load of the clock signal to be input is small and the operation speed is high.

In the image display device having the above set-reset flip-flops, it is preferable that the set signal of the set-reset flip-flop is made inactive and the reset signal is made active. By making not only the reset signal of the set-reset flip-flop active, but also making the set signal inactive, it is possible to certainly initialize the flip-flop.

In all of the above-described image display devices, it is preferable that the reset means resets the internal nodes of all of the flip-flops constituting the data signal line drive circuit or the scanning signal line drive circuit. When initializing all of the set-reset flip-flops constituting the shift register, since all stages are formed by the same circuit, the timing of the signals can hardly deviate.

Alternatively, in all of the above-described image display devices, it is preferable that the reset means resets the internal nodes of a half of flip-flops constituting the data signal line drive circuit or the scanning signal line drive circuit. For example, by initializing the flip-flops constituting the shift register every other stage, it is possible to initialize the flip-flop in the next stage. In this case, the total number of elements added for the purpose of initialization can be reduced.

In all of the above-described image display devices, it is preferable to further include a transfer gate for inputting clock signals to a plurality of flip-flops constituting the data signal line drive circuit or the scanning signal line drive circuit, and controlling the input of the clock signals by output signals from the flip-flops of one stage or a plurality of stages including at least the previous stage of a flip-flip to which the clock signals are to be input. In this structure, since the clock signals are input via the transfer gate only to a stage to which the clock signals need to be input, the load capacity of the clock signal line is reduced. It is therefore possible to decrease the power consumption and the drive ability of the external controller.

It is preferable that the image display device having the transfer gate further includes a booster circuit which is disposed in a succeeding stage of the transfer gate, boosts the clock signals having amplitudes smaller than an amplitude of a drive voltage of the data signal line drive circuit or the scanning signal line drive circuit to become the drive voltage and is operated under control by a signal that controls the transfer gate. In this structure, the booster circuit is operated only within a period in which the clock signal is being input. In other words, the operation of the booster circuits corresponding to most of the flip-flops is halted. For this reason, when the booster circuit is of a type in which a feedthrough current flows during the operation, it is possible to significantly reduce the current consumption and eliminate a possibility of occurrence of an operation error due to a voltage drop caused by excess steady-state current. Besides, if the booster circuit is incorporated into each flip-flip, it is possible to prevent an increase in the power consumption and a voltage drop due to excess steady-state current.

Moreover, in this image display device, it is preferable that a signal of such a level that does not cause a current to flow in the booster circuit is input to the booster circuit during a period in which the transfer gate is being cut off. In this structure, since the current does not flow in the booster circuits corresponding to most of the flip-flops to which the clock signals are not input, it is possible to significantly reduce the current consumption and eliminate a possibility of occurrence of an operation error due to a voltage drop caused by excess current.

In the above-described two image display devices having the booster circuit, it is preferable that the booster circuit is disconnected from at least one of the power supply line and the ground line during the period in which the transfer gate is being cut off. In this structure, since the current does not flow in the booster circuits corresponding to most of the flip-flops to which the clock signal is not input, it is possible to significantly reduce the current consumption and eliminate a possibility of occurrence of an operation error due to a voltage drop caused by excess current.

In all of the above-described image display devices (except for the third and fourth image display devices), it is preferable that at least one of the data signal line drive circuit and the scanning signal line drive circuit is formed on a substrate on which the pixels are to be formed. In such a structure, it is possible to fabricate at least one of the data signal line drive circuit and the scanning signal line drive circuit and the pixels on a single substrate in a single process. As a result, the mounting cost of the drive circuit can be reduced, and the reliability can be improved.

The image display device of the present invention can be suitably applied to a matrix type image display device, i.e., an active matrix type image display device, which further comprises an active switching element for writing image data supplied through the data signal lines to the pixels under the control by the scanning signal lines.

In this active matrix type image display device, it is preferable that an active element constituting at least one of the data signal line drive circuit, scanning signal line drive circuit and active switching element is a polycrystalline silicon thin-film transistor. When a transistor is formed by the use of polycrystalline silicon thin film, since an extremely high driving force is obtained compared with an amorphous silicon thin-film transistor used in a conventional active matrix type liquid crystal display device, there is an advantage that the pixels and the signal line drive circuits can be readily formed on a single substrate in addition to the above-mentioned effects. It is therefore possible to expect a reduction in the manufacturing cost and mounting cost and an improvement of the non-defective ratio in mounting.

Besides, in the above-described image display device in which the active element is a polycrystalline silicon thin-film transistor, it is preferable that the active element is formed at a temperature of no higher than 600° C. When the polycrystalline silicon thin-film transistor is formed at a process temperature of no higher than 600° C., it is possible to use glass, which is inexpensive and readily achieves an increase of the size though it has a low distortion point, for the substrate. It is therefore possible to provide the effect of manufacturing a large image display device at low costs in addition to the above-mentioned effects.

This embodiment and the above-mentioned embodiments have illustrated some examples. However, the present invention is not necessarily limited to these embodiments, and is thus applicable to structures given by combinations of the respective embodiments and also to all structures based on the same concept.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A matrix type image display device comprising:

a plurality of pixels arranged in a matrix form;

a plurality of data signal lines for supplying image data to be written in the pixels;

a plurality of scanning signal lines for controlling writing of the image data in the pixels;

a data signal line drive circuit for driving the data signal lines;

a scanning signal line drive circuit for driving the scanning signal lines;

reset means for resetting an internal state of at least one of the data signal line drive circuit and the scanning signal line drive circuit; and a shift register as a part of the data signal line drive circuit and the scanning signal line drive circuit, wherein the reset means generates a reset signal for resetting the internal state of the shift register that forms at least one of the data signal line drive circuit and the scanning signal line drive circuit, based on a combination of a plurality of signals which are not used during normal driving.

2. The matrix type image display device as set forth in claim 1, wherein at least one of the data signal line drive circuit and the scanning signal line drive circuit is formed on a substrate on which the pixels are formed.

3. The matrix type image display device as set forth in claim 1, wherein the reset means generates the reset signal based on a pre-charge control signal for controlling an operation of a pre-charge circuit for preliminarily charging the data signal lines before being driven and an enable signal for enabling the scanning signal line drive circuit to output a drive signal for driving the scanning lines.

4. The matrix type image display device as set forth in claim 1, wherein the reset means generates the reset signal based on a pre-charge control signal for controlling an operation of a pre-charge circuit for preliminarily charging the data signal lines before being driven and a start signal for starting an operation of the scanning signal line drive circuit.

5. The matrix type image display device as set forth in claim 1, wherein the reset means generates the reset signal based on a pre-charge control signal for controlling an operation of a pre-charge circuit for preliminarily charging the data signal lines before being driven and a start signal for starting an operation of the data signal line drive circuit.

6. The matrix type image display device as set forth in claim 1, wherein the reset means generates the reset signal based on a first start signal for starting an operation of the scanning signal line drive circuit and a second start signal for starting an operation of the data signal line drive circuit.

7. The matrix type image display device as set forth in claim 1, wherein the reset means is formed of a NAND gate for generating, based on a combination of two signals, a reset signal which is low level in a period in which both of the signals are high level and inverters for inverting an output signal of the NAND gate.

8. The matrix type image display device as set forth in claim 1, wherein the reset means is formed of a NAND gate for generating, based on a combination of two signals, a reset signal which is low level in a period in which both of the signals are high level.

9. The matrix type image display device as set forth in claim 1, wherein the signals, based on which the reset signal is generated, are being input to the reset means in a period from supply of power to a start of normal driving.

10. The matrix type image display device as set forth in claim 1, wherein the signals, based on which the reset signal is generated, are being input to the reset means during a period in which display is being interrupted after supply of power.

11. The matrix type image display device as set forth in claim 1, wherein a period in which the signals, based on which the reset signal is generated, are being input is between 1 μsec and 100 msec.

12. The matrix type image display device as set forth in claim 1, wherein the reset means resets internal nodes of a plurality of D-type flip-flops constituting the data signal line drive circuit or the scanning signal line drive circuit.

13. The matrix type image display device as set forth in claim 1, wherein the reset means resets internal nodes of a plurality of set-reset flip-flops constituting the data signal line drive circuit or the scanning signal line drive circuit.

14. The matrix type image display device as set forth in claim 13, wherein the reset means makes a set signal of the set-reset flip-flop inactive and a reset signal thereof active.

15. The matrix type image display device as set forth in claim 1, wherein the reset means resets internal nodes of all of flip-flops constituting the data signal line drive circuit or the scanning signal line drive circuit.

16. The matrix type image display device as set forth in claim 1, wherein the reset means resets internal nodes of a half of flip-flops constituting the data signal line drive circuit or the scanning signal line drive circuit.

17. The matrix type image display device as set forth in claim 1, further comprising a transfer gate for inputting clock signals to a plurality of flip-flops constituting the data signal line drive circuit or the scanning signal line drive circuit, and controlling input of the clock signals by output signals from the flip-flops of one stage or a plurality of stages including at least a previous stage of the flip-flip to which the clock signals are to be input.

18. The matrix type image display device as set forth in claim 17, further comprising a booster circuit which is disposed in a succeeding stage of the transfer gate, boosts the clock signals having amplitudes smaller than an amplitude of a drive voltage of the data signal line drive circuit or the scanning signal line drive circuit to become the drive voltage, and is operated under control by a signal that controls the transfer gate.

19. The matrix type image display device as set forth in claim 18, wherein a signal of such a level that does not cause a current to flow in the booster circuit is input to the booster circuit during a period in which the transfer gate is being cut off.

20. The matrix type image display device as set forth in claim 18, wherein the booster circuit is disconnected from at least one of a power supply line and a ground line during a period in which the transfer gate is being cut off.

21. The matrix type image display device as set forth in any one of claim 1, further comprising an active switching element for writing the image data supplied through the data signal lines in the pixels under control by the scanning signal lines.

22. The matrix type image display device as set forth in claim 21, wherein an active element constituting at least one of the data signal line drive circuit, scanning signal line drive circuit and active switching element is a polycrystalline silicon thin-film transistor.

23. The matrix type image display device as set forth in claim 22, wherein the active element is formed at a temperature of not more than 600° C.

24. The matrix type image display device as set forth in claim 1, wherein the combination, which allows the reset means to generate the reset signals for resetting the internal state of the shift register that forms at least one of the data signal line drive circuit and the scanning signal line drive circuit, is a combination of the plurality of signals that is arranged so as not to affect a displayed image.

25. The matrix type image display device as set forth in claim 1, wherein the combination of the plurality of signals is not used in a normal image display period.

26. A matrix type image display device comprising:

a plurality of pixels arranged in a matrix form;

a plurality of data signal lines for supplying image data to be written in the pixels;

a plurality of scanning signal lines for controlling writing of the image data in the pixels;

a data signal line drive circuit for driving the data signal lines;

a scanning signal line drive circuit for driving the scanning signal lines;

reset means for resetting an internal state of at least one of the data signal line drive circuit and the scanning signal line drive circuit; and a shift register as a part of the data signal line drive circuit and the scanning signal line drive circuit, wherein the reset means generates a reset signal for resetting the internal state of the shift register that forms at least one of the data signal line drive circuit and the scanning signal line drive circuit, based on a combination of a plurality of signals which do not affect a displayed image.

27. The matrix type image display device as set forth in claim 26, wherein at least one of the data signal line drive circuit and the scanning signal line drive circuit is formed on a substrate on which the pixels are formed.

28. The matrix type image display device as set forth in claim 26, wherein the reset means generates the reset signal based on a pre-charge control signal for controlling an operation of a pre-charge circuit for preliminarily charging the data signal lines before being driven and an enable signal for enabling the scanning signal line drive circuit to output a drive signal for driving the scanning lines.

29. The matrix type image display device as set forth in claim 26, wherein the reset means generates the reset signal based on a pre-charge control signal for controlling an operation of a pre-charge circuit for preliminarily charging the data signal lines before being driven and a start signal for starting an operation of the scanning signal line drive circuit.

30. The matrix type image display device as set forth in claim 26, wherein the reset means generates the reset signal based on a pre-charge control signal for controlling an operation of a pre-charge circuit for preliminarily charging the data signal lines before being driven and a start signal for starting an operation of the data signal line drive circuit.

31. The matrix type image display device as set forth in claim 26, wherein the reset means generates the reset signal based on a first start signal for starting an operation of the scanning signal line drive circuit and a second start signal for starting an operation of the data signal line drive circuit.

32. The matrix type image display device as set forth in claim 26, wherein the reset means generates a reset signal for resetting the internal state of the shift register that forms at least one of the data signal line drive circuit and the scanning signal line drive circuit, based on the combination of the plurality of signals, arranged so as not to affect the displayed image, that is one of combinations of signals.

33. A matrix type image display device comprising:

a plurality of pixels formed in a matrix form on a single substrate;

a plurality of data signal lines for supplying image data to be written in the pixels;

a plurality of scanning signal lines for controlling writing of the image data in the pixels;

a data signal line drive circuit for driving the data signal lines according to a signal input from outside of the substrate;

a scanning signal line drive circuit for driving the scanning signal lines according to signals input from outside of the substrate;

a pre-charge circuit for preliminarily charging the data signal lines before being driven, according to signals input from outside of the substrate;

reset means for resetting an internal state of at least one of the data signal line drive circuit and the scanning signal line drive circuit; and a shift register as a part of the data signal line drive circuit and the scanning signal line drive circuit, wherein at least one of the data signal line drive circuit, scanning signal line drive circuit and pre-charge circuit is formed on the substrate on which the pixels are formed, and the reset means generates a reset signal for resetting the internal state of the shift register that forms at least one of the data signal line drive circuit and the scanning signal line drive circuit, based on a combination of a plurality of signals which are input from outside of the substrate to at least one of the data signal line drive circuit, scanning signal line drive circuit and pre-charge circuit formed on the substrate.

34. The matrix type image display device as set forth in claim 33, wherein the reset means generates the reset signal based on a pre-charge control signal for controlling an operation of the pre-charge circuit and an enable signal for enabling the scanning signal line drive circuit to output a drive signal for driving the scanning lines.

35. The matrix type image display device as set forth in claim 33, wherein the reset means generates the reset signal based on a pre-charge control signal for controlling an operation of the pre-charge circuit and a start signal for starting an operation of the scanning signal line drive circuit.

36. The matrix type image display device as set forth in claim 33, wherein the reset means generates the reset signal based on a pre-charge control signal for controlling an operation of the pre-charge circuit and a start signal for starting an operation of the data signal line drive circuit.

37. A matrix type image display device comprising:

a plurality of pixels formed in a matrix form on a single substrate;

a plurality of data signal lines for supplying image data to be written in the pixels;

a plurality of scanning signal lines for controlling writing of the image data in the pixels;

a data signal line drive circuit for driving the data signal lines according to a signal input from outside of the substrate;

a scanning signal line drive circuit for driving the scanning signal lines according to signals input from outside of the substrate;

reset means for resetting an internal state of at least one of the data signal line drive circuit and the scanning signal line drive circuit; and a shift register as a part of the data signal line drive circuit and the scanning signal line drive circuit, wherein at least one of the data signal line drive circuit and scanning signal line drive circuit is formed on the substrate on which the pixels are formed, and the reset means generates a reset signal for resetting the internal state of the shift register that forms at least one of the data signal line drive circuit and the scanning signal line drive circuit, based on a combination of a plurality of signals which are input from outside of the substrate to at least one of the data signal line drive circuit and scanning signal line drive circuit formed on the substrate.

38. The matrix type image display device as set forth in claim 37, wherein the reset means generates the reset signal based on a first start signal for starting an operation of the scanning signal line drive circuit and a second start signal for starting an operation of the data signal line drive circuit.

39. A matrix type image display device comprising:

a plurality of pixels arranged in a matrix form;

a plurality of data signal lines for supplying image data to be written in the pixels;

a plurality of scanning signal lines for controlling writing of the image data in the pixels;

a data signal line drive circuit for driving the data signal lines;

a scanning signal line drive circuit for driving the scanning signal lines;

reset means for resetting an internal state of at least one of the data signal line drive circuit and the scanning signal line drive circuit; and a shift register as a part of the data signal line drive circuit and the scanning signal line drive circuit, wherein the reset means is capacitors which are added to internal nodes of the shift register that forms at least one of the data signal line drive circuit and the scanning signal line drive circuit, for resetting the internal nodes.

40. The matrix type image display device as set forth in claim 39, wherein the capacitor is a capacitor connected between the internal node to be reset to a power supply potential and a power supply line.

41. The matrix type image display device as set forth in claim 39, wherein the capacitor is a capacitor connected between the internal node to be reset to a ground potential and a ground line.

42. A matrix type image display device comprising:

a plurality of pixels arranged in a matrix form;

a plurality of data signal lines for supplying image data to be written in the pixels;

a plurality of scanning signal lines for controlling writing of the image data in the pixels;

a data signal line drive circuit for driving the data signal lines;

a scanning signal line drive circuit for driving the scanning signal lines;

reset means for resetting an internal state of at least one of the data signal line drive circuit and the scanning signal line drive circuit; and a shift register as a part of the data signal line drive circuit and the scanning signal line drive circuit, wherein the reset means are resistors which are added to internal nodes of the shift register that forms at least one of the data signal line drive circuit and the scanning signal line drive circuit, for resetting the internal nodes.

43. The matrix type image display device as set forth in claim 42, wherein the resistor is connected between the internal node to be reset to a power supply potential and a power supply line.

44. The matrix type image display device as set forth in claim 42, wherein the resistor is connected between the internal node to be reset to a ground potential and a ground line.

* * * * *

UNITED STATES PATENT AND TRADEMARK OFFICE

CERTIFICATE OF CORRECTION

PATENT NO. : 6,559,824 B1
DATED : May 6, 2003
INVENTOR(S) : Yasushi Kubota et al.

It is certified that error appears in the above-identified patent and that said Letters Patent is hereby corrected as shown below:

Title page,
Item [76], Inventors, change "[76]" to -- [75] --; and insert
-- [73] Assignee: Sharp Kabushiki Kaisha Osaka, Japan --;
Also, after "*Primary Examiner*" for the *Attorney, Agent, or Firm* information please insert:
-- EDWARDS & ANGELL, LLP
David G. Conlin
John J. Penny, V --

Signed and Sealed this

Ninth Day of September, 2003

JAMES E. ROGAN
*Director of the United States Patent and Trademark Office*